US007073436B2

(12) United States Patent
Takahashi

(10) Patent No.: US 7,073,436 B2
(45) Date of Patent: Jul. 11, 2006

(54) DUPLEX PRINTING DEVICE CONFIGURED FOR DUPLEX PRINTING ON THE FRONT AND REVERSE SIDES OF A SHEET OF PRINTING PAPER AND SIMPLEX PRINTING ON ONLY ONE SIDE OF THE SHEET

(75) Inventor: Mituru Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 11/023,671

(22) Filed: Dec. 29, 2004

(65) Prior Publication Data

US 2005/0243153 A1 Nov. 3, 2005

(30) Foreign Application Priority Data

Jan. 7, 2004 (JP) ..... 2004-002415

(51) Int. Cl.
*B41F 5/02* (2006.01)
*B41C 1/14* (2006.01)

(52) U.S. Cl. ..... 101/229; 101/128.4

(58) Field of Classification Search ..... 101/114–118, 101/229, 231, 425, 128.4, 129
See application file for complete search history.

(56) References Cited

U.S. PATENT DOCUMENTS 5,640,904 A * 6/1997 Sato et al. ..... 101/128.4
6,293,193 B1 * 9/2001 Bolza-Schunemann ..... 101/229
6,645,327 B1 * 11/2003 Austin et al. ..... 156/64
6,718,872 B1 * 4/2004 Kanno ..... 101/118
6,915,738 B1 * 7/2005 Mori ..... 101/128.4

FOREIGN PATENT DOCUMENTS

| | | | |
|---|---|---|---|
| JP | 6-71997 | | 3/1994 |
| JP | 8-118774 | | 5/1996 |
| JP | 8-332768 | | 12/1996 |
| JP | 9-95033 | | 4/1997 |
| JP | 10-129100 | | 5/1998 |
| JP | 2880052 | | 1/1999 |
| JP | 2002172839 | * | 6/2002 |
| JP | 2003-200645 | | 7/2003 |
| JP | 2003-237207 | | 8/2003 |
| JP | 2003-312914 | | 11/2003 |

* cited by examiner

*Primary Examiner*—Andrew H. Hirshfeld
*Assistant Examiner*—Wasseem H. Hamdan
(74) *Attorney, Agent, or Firm*—Oblon, Spivak, McClelland, Maier & Neustadt, P.C.

(57) ABSTRACT

A duplex printing device including a duplex printing master on which two images are perforated in series over a single plate, and a simplex printing master on which a third image is perforated over the single plate. Either master is wrapped around an outer peripheral surface of a print drum, enabling duplex printing operation in which one of the two images is printed by pressing a front side of a sheet against the duplex printing master on the print drum using a presser which can be brought into and out of contact with the print drum, after which the other image is printed by reversing and refeeding the sheet and pressing a reverse side of the sheet against the duplex printing master on the print drum using the presser, and a simplex printing operation done by pressing one side of the sheet against the simplex printing master.

14 Claims, 32 Drawing Sheets

WHOLE SIDE IMAGE

DUPLEX PRINTING DEVICE CONFIGURED FOR DUPLEX PRINTING ON THE FRONT AND REVERSE SIDES OF A SHEET OF PRINTING PAPER AND SIMPLEX PRINTING ON ONLY ONE SIDE OF THE SHEET

BACKGROUND OF THE INVENTION

1. Field of the Invention

The present invention relates to a duplex printing device, including duplex stencil printing devices and the like, and more particularly to a duplex printing device which is capable of a duplex printing operation in which printing is performed on the front and reverse sides of a sheet of printing paper (to be referred to simply as "sheet" hereafter), and a simplex printing operation in which printing is performed on only one side of the sheet.

2. Description of the Background Art

Digital, thermal stencil printing is known conventionally as a simple printing method. In this stencil printing, a thermoplastic resin film typically having a thickness of approximately 1 to 2 μm is adhered to a porous support constituted by Japanese paper fiber, synthetic fiber, a mixture of Japanese paper fiber and synthetic fiber, or the like to form a stencil master ("master" hereafter) having a laminate structure. The thermoplastic resin film surface of the master is caused to contact heat-generating elements of a thermal head such that the master is heat-perforated and cut by an operation of the thermal head in a main scanning direction. The perforated master is then conveyed in a sub scanning direction (master conveyance direction) orthogonal to the main scanning direction by master conveyance means such as platen rollers, and thus wrapped around a rotatable print drum comprising on the outer peripheral portion thereof a porous, cylindrical plate cylinder constituted by resin or gauze mesh screen wound into a plurality of layers, for example. Ink is then supplied to the perforated master on the plate cylinder by an ink supplying member provided in the interior of the print drum, whereupon a sheet is pressed against the perforated master on the plate cylinder continuously by pressing means such as a press roller, impression cylinder, or in-press roller (to be represented by a press roller hereafter). As a result, ink is transferred onto the sheet from the porous part of the plate cylinder and the perforated part of the master such that printing is performed on the sheet.

Note that the term "print drum" sometimes refers simply to a plate cylinder, and sometimes to a plate cylinder provided on the outer peripheral portion of a print drum, but hereafter in this specification, usage of the term "print drum" is assumed to include the plate cylinder.

In recent years, duplex printing, in which printing is performed on the front and reverse sides of a sheet (also referred to as "both sides of the sheet" hereafter), has come to occupy the greater part of such stencil printing in addition to simplex printing, in which printing is performed on only one side of the sheet, with the aim of reducing sheet consumption and document storage space. A conventional duplex printing method uses a typical stencil printing device for performing simplex printing, such as that described above, to obtain duplex printed matter by passing a sheet stacked on a sheet feeding portion through a printing portion to print an image on one side (the front side) of the sheet, discharging and stacking the sheet onto a sheet discharge tray or the like, reversing the printed sheet, and again passing the sheet through the printing portion to print another image onto the other side (the reverse side) of the sheet. With this duplex printing method, however, the total printing time increases greatly since printing must be performed twice, or else time must be wasted waiting for the ink on one side of the printed sheet to dry, or set, sufficiently following simplex printing. Moreover, it is extremely troublesome to arrange simplex-printed sheets properly or to reset a simplex-printed sheet in the sheet feeding portion.

To improve this conventional duplex printing method which is based on a manual operation, development of duplex printing devices which can perform duplex printing automatically is flourishing. Many methods have been proposed as aspects of such a duplex printing device, but these can be divided mainly into the following six methods, which have the advantages and disadvantages described below.

(1) Two-Pass Duplex Printing Method in which a Sheet is Printed on One Side, Stocked, and Refed A discharge unit comprising a discharge tray is constituted movably in relation to a device having a substantially identical constitution to that of a conventional simplex printing device. Furthermore, a sheet feed tray function is added to the discharge tray, and a novel reverse feed path and so on is added to form a so-called "automatic refeed mechanism". By means of this constitution, a sheet stacked on a sheet feeding portion is passed through a printing portion and thereby subjected to surface printing, whereupon the surface-printed sheet is discharged onto the discharge tray, conveyed to the reverse feed path from the discharge tray, and thus fed automatically to a reprinting portion where reverse side printing is performed. Thus a duplex-printed sheet is obtained (see Japanese Patent Publication No. 2880052, for example). An advantage of this duplex printing method is that it can be used simply by making slight modifications to the constitution of a conventional simplex stencil printing device (annexing the automatic refeed mechanism described above thereto).

However, with the duplex printing method described in (1) above, firstly, perforation and printing must be performed twice, and therefore twice the perforation and printing time is required to obtain a duplex-printed sheet. Moreover, switching time is required to perform automatic refeeding. Hence time productivity, which is an advantage of a duplex printing device, is poor in this method. Secondly, due to the limitations of the automatic refeed mechanism, only a few sheets can be subjected to duplex printing at once, and when a larger number of duplex-printed sheets is desired, the single duplex printing cycle described above must be repeated. In this case, it is possible to read images on both sides of an original once using an automatic document feeder (ADF), but in order to refeed an original that has been read once and discharged, and read the image printed thereon, an extremely expensive automatic reversing document feeder or recycling document handler (ARDF or RDH) must be installed. Accordingly, the duplex printing cycle cannot be repeated unless expensive image memory is installed.

Fourthly, time is required for perforation and plate loading every time duplex printing is repeated, and although the printing durability of the master (which indicates the number of sheets that can be printed from one perforated master) is sufficient, cost is wasted to re-perforate a new master. Fifthly, when duplex printing is complete, the ink on the printed sheet has not dried, or set, sufficiently, and hence if printing is performed on the reverse side of a printed sheet that has just been printed on the front side, pressing means such as the conveyance roller and press roller are pressed against the image portion such that the printed image is contaminated or disturbed by ink and the like. As a result, sheets which have completed printing on the front side must be separated and conveyed anew, which increases the likelihood of a jam, and moreover, the size of the printing device must be increased, among other problems.

(2) One-Pass Simultaneous Duplex Printing Method Having Two Facing Drums

This method comprises a first print drum, a second print drum disposed opposite the first print drum via a sheet conveyance path, and moving means for bringing the outer peripheral surface of the first drum and the outer peripheral surface of the second drum into and out of contact with each other. By moving the moving means such that the print drums are pressed together, front side printing in which one side, i.e. the front side, of a sheet is printed, and reverse side printing in which the other side, i.e. the reverse side, of the sheet is printed, are performed by passing the sheet only once, or in other words in one pass. Thus a duplex-printed sheet is obtained (see Japanese Unexamined Patent Application Publication H6-71996, for example).

In the duplex printing method described in (1) above, firstly, the two print drums are disposed one above the other and pressed together, and hence the second print drum is required even when simplex printing is performed. Since the two print drums must be pressed together, a perforated master must be wrapped around one of the print drums and a non-perforated master must be wrapped around the other print drum, resulting in the wasteful consumption of a master during simplex printing. Since two master plates are required even during simplex printing, plate costs double in comparison with a typical simplex printing device. Secondly, perforation and plate loading are performed for two plates, and even though perforation may be performed at a higher speed on the non-perforated master, the first print time (FPT) must be slowed.

Thirdly, the inner peripheral surface of a typical print drum is circular, and convex type clampers protruding outward from the outer peripheral surface are provided to hold the master on the outer peripheral surface of the print drums. Hence, either recessed portions must be formed on each print drum in the positions at which the clampers face each other when the two print drums are pressed together to prevent the convex portions of the clampers from interfering with each other, or the two print drums must be separated from each other at these positions. When two printing drums having the same large outer diameter are used, compared with a combination of a print drum and a press roller having a comparatively small outer diameter, the recessed portions must be formed over a wide enough area to enable the clampers to avoid each other, and yet to ensure that the printing area does not become too small, the outer diameter of the print drum must be increased further, thereby creating a vicious circle.

Fourthly, a loud noise is produced when the print drums are brought into contact. Moreover, it is extremely difficult to prevent discharged sheets from becoming wrapped around the print drums, among other problems.

(3) Single Drum Transfer, Single Pressing Means One-Pass Duplex Printing Method

A divided perforated master (duplex printing master) formed with a first perforated image (front side image) and a second perforated image (reverse side image) is wrapped around the outer peripheral surface of a print drum. The reverse side perforated image on the print drum is subjected to intermediate transfer onto a press roller (transfer/pressing means), whereupon printing is performed on the front and reverse sides of a sheet passed therethrough simultaneously (see Japanese Unexamined Patent Application Publication H8-332768, for example). In the duplex printing method of section (3), masters are used efficiently rather than being wasted during simplex printing, and the transfer of wet ink can be suppressed since duplex printing is performed in a single step. As a result, high quality printed images can be obtained. Moreover, the device can be simplified and reduced in size.

However, in the duplex printing method described in (3), firstly, there is a large difference between the density of the front side image, which is produced by transferring one of the first perforated image and second perforated image (front side image and reverse side image) directly onto the sheet from the print drum, and the density of the reverse side image, which is produced by transferring the other perforated image onto the press roller, which has a different ink absorbency to the sheet, and then re-transferring the image onto the sheet. As a result, the image density of the images on the sheet differs between the front side and reverse side.

Secondly, with this method, the sheet feed timing differs greatly between normal simplex printing and duplex printing. As a result, the mechanisms and control system of the sheet feed system become complicated, leading to an increase in cost. Thirdly, the perforated image on the perforated master used during normal stencil printing is a mirror image, and hence in this method, in which intermediate transfer is performed onto a press roller, the perforated image on the transfer side of the master must be created as a normal image. When only mirror images are created, the cost of mirror image processing can be reduced by selecting the master conveyance direction, the orientation of the thermal head, and so on appropriately. In this case, however, where both normal images and mirror images are perforated, a mirror image reversal circuit must be added, leading to an increase in cost.

(4) One-Pass Simultaneous Duplex Printing Method with Two Facing Drums and an Interposed Transfer Cylinder In this duplex printing method, first and second rotatable print drums comprising ink supply means and having a master wrapped around the outer peripheral surface thereof are used together with a transfer cylinder positioned between the first and second print drums. An ink image is transferred to the transfer cylinder from the second print drum, whereupon the ink image on the transfer cylinder is transferred again onto the reverse side of a sheet, and thus printing is performed simultaneously on the front and reverse sides of the sheet (see Japanese Unexamined Patent Application Publication H8-118774, for example). In the duplex printing method of (4), differences remain in the density and image quality of the printed images on the front side and reverse side, and since a total of three drums, including the transfer cylinder, are disposed in printing device, the size of the device increases. Moreover, cleaning must be performed, and so on.

(5) Duplex Printing Method Comprising a Single Drum, Employing Divided Printing and Simultaneous Reversal In this duplex printing method, the front and reverse sides of a sheet are printed simultaneously through a single perforation step and a single printing step using a print drum around which a perforated master formed with a first image and a second image is wrapped, sheet supply means for supplying sheets to the vicinity of the print drum, first pressing means for pressing a first side of a sheet supplied by the sheet supply means against the first image on the print drum to form a first printed image on a first side of the sheet, sheet reversing means for reversing the sheet printed with the first printed image on its first side, and second pressing means for pressing a second side of the sheet reversed by the sheet reversing means against the second image on the print drum to form a second printed image on the second side of the sheet (see Japanese Unexamined Patent Application Publication H9-95033, for example).

In the duplex printing method described in (5), by restricting the image size during duplex printing, the printing device can be made more compact than that of the three duplex printing methods described above and the single drum, dividing transfer cylinder, one-pass duplex printing method to be described below. Moreover, there are no obstructions to simplex printing, and no difference in density or the like between the printed images on the front and reverse sides. Duplex printing can be performed at a high speed and in a short amount of time, thus enabling time-saving and high productivity.

However, in the printing device of the duplex printing method described in (5), in the aforementioned Japanese Unexamined Patent Application Publication H9-95033, for example, there remain questions as to the reliability of sheet conveyance and responsiveness to high speed printing. Moreover, the peripheral constitution of the printing portion is complicated, requiring two pressing means (primary and secondary press rollers 17, 24 serving as the first and second pressing means), and two corresponding ink supplying means (7, 8) within the print drum.

(6) Single Drum, Divided Printing, Transfer Cylinder, One-Pass Duplex Printing Method This is a duplex printing method positioned between the methods described above in (4) and (5) (see Japanese Unexamined Patent Application Publication H10-129100, for example). The basic constitution of a stencil printing device employing this single drum, dividing transfer cylinder, one-pass duplex printing method comprises a print drum having a front side printing area and a reverse side printing area on the outer peripheral surface of the same drum, a transfer cylinder formed on its surface with a reverse side ink image which is transferred by ink passing through the reverse side printing area of the print drum, conveyance means for conveying a sheet between the print drum and the transfer cylinder on which the reverse side ink image is formed, and so on.

In the duplex printing method described in (6), printing is performed on the front and reverse sides of the sheet in a single pass when the sheet passes between the print drum and the transfer cylinder formed with the reverse side ink image. In other words, in this duplex printing method, all that is required is a single print drum, a single ink supply means, a single transfer cylinder, a single perforation unit, and a single plate discharge unit, and hence reductions in the size and cost of the device can be achieved due to the small number of components. Moreover, by setting the diameter ratio of the print drum and transfer cylinder to 2:1, printing can be performed continuously by rotating the print drum and transfer cylinder at a constant rotation speed.

However, in the duplex printing method described in (6), the ease with which ink is released from the outer peripheral surface of the print drum is equal in both the front side printing area and the reverse side printing area, and furthermore, an ink-repellent material is used on the outer peripheral surface layer of the transfer cylinder such that in comparison with a case where printing is performed simultaneously on the front and reverse sides on the basis of an identical perforated image produced from an identical original, for example, the amount of ink transferred from the outer peripheral surface of the print drum to the outer peripheral surface of the transfer cylinder is smaller than the amount of ink transferred directly onto the sheet from the outer peripheral surface of the print drum. As a result, unevenness and differences in the print image density of the front side printed image and the reverse side printed image occur in this duplex printing method also.

(7) A single-step duplex printing device has been proposed which solves all of the problems described above in (1) through (5). In this duplex printing device, simplex printing can be performed without wasting a master, a printed sheet having favorable image quality with no unevenness and differences in the print image density of the front side printed image and the reverse side printed image printed on the sheet can be obtained during duplex printing, and increases in installation space can be suppressed. This novel duplex printing device (see Japanese Unexamined Patent Application Publication 2003-200645 and Japanese Unexamined Patent Application Publication 2003-237207, for example) uses the basic duplex printing method (to be referred to hereafter as "single drum, single pressing means duplex printing method") described in (5) (employing a press roller as the single pressing means and a single ink supply means), but eliminates the lack of sheet conveyance reliability and high speed printing responsiveness therein.

The duplex printing device disclosed in Japanese Unexamined Patent Application Publication 2003-200645 and Japanese Unexamined Patent Application Publication 2003-237207, proposed by the present applicant and employing the single drum, single pressing means duplex printing method described above has a basic constitution comprising a printing portion having a print drum around which a divided perforated master formed with a first image and a second image side by side (within the length of a single plate (the length of the master corresponding to the circumference of the print drum, likewise hereafter) is wrapped in the rotary direction of the print drum, and pressing means selectively which can be brought into or out of contact with the print drum, a sheet feeding portion for feeding a sheet toward the printing portion, a sheet discharging portion for discharging a printed sheet printed in the printing portion, an auxiliary tray (reefed storage means) for temporarily storing the printed sheet printed with a printed image on its front side in the printing portion, refeeding means for reversing the front-side printed sheet temporarily stored in the auxiliary tray and refeeding the sheet toward the printing portion, and a switching member (switching means) for guiding the sheet coming out of the printing portion toward the reefed storage means or the sheet discharging portion.

During duplex printing, a first sheet is fed from the sheet feeding portion to the printing portion, where either one of the first image and second image is printed on its front side, and then the switching member guides the printed first sheet toward the auxiliary tray. Next, a second sheet is fed from the sheet feeding portion to the printing portion and printed with either one of the first image and second image on its front side, while the first sheet is refed by the sheet refeeding means to the printing portion, where the other of the first image and second image is printed on the reverse side thereof. The switching member then guides the first sheet toward the sheet discharging portion, and guides the second sheet toward the auxiliary tray. Thus both sides of the sheet can be printed in a single rotation of the print drum, excluding the first and last sheet passage.

In the duplex printing device disclosed in Japanese Unexamined Patent Application Publication 2003-237207, during duplex printing, a first image is perforated from a first position at a predetermined remove from the leading end of a master, irrespective of the size of the sheet, and a second image is perforated from a second position at a predetermined remove from the first position such that a gap (margin portion) is provided between the first image and second image. By provided an appropriate margin portion, deviation in the image positions on the front and reverse sides of the sheet can be prevented. Reading information about the original image is stored in an image memory and recalled during perforation. According to this duplex printing device, deviation in the image positions on the front and reverse sides of the sheet can be prevented, time productivity during duplex printing can be improved, and simplex printing can be implemented without waste.

In the duplex printing device (1) disclosed in Japanese Unexamined Patent Application Publication 2003-200645, as illustrated in FIG. 7 and described in paragraph [0008], the following keys (buttons) and display devices are provided on an operating panel (103): a duplex print key (117) for selecting and setting a duplex print mode for performing duplex printing; a simplex print key (118) for selecting and setting a simplex print mode for performing simplex printing; a perforation start key (104) also referred to as a start key for activating and setting a series of operations comprising plate discharging, original image reading, plate perforation and wrapping, and printing; a print start key (105) also referred to as a print key for activating and setting a normal duplex printing operation or simplex printing operation; and so on. When the duplex print key (117) is depressed, an LED (117*a*) in the vicinity of the duplex print key (117) is illuminated, and when the simplex print key 118 is depressed, an LED (118*a*) in the vicinity of the simplex print key (117) is illuminated, thereby showing the operator that the duplex print mode or the simplex print mode has been set. The duplex printing device (1) illuminates the LED (118*a*) to indicate that the simplex mode is set in a preset initial state (also referred to as "initial set mode").

However, the duplex printing method described in (7) has the following problems. Firstly, if a mistake is made in setting the duplex print mode for performing duplex printing and the simplex print mode for performing simplex printing, then a master is wasted during perforation.

This problem occurs as follows. In the duplex printing device (1) of Japanese Unexamined Patent Application Publication 2003-200645 and Japanese Unexamined Patent Application Publication 2003-237207, as described above, the LED (118*a*) is illuminated in the initial set mode of the duplex printing device (1) to show the operator that the simplex print mode is set. However, in cases such as when the operator is in a hurry to perform duplex printing, for example, s/he may press the print start key (105) without noticing that the LED 118*a* indicating the simplex print mode is illuminated, as a result of which simplex printing is performed wastefully in the simplex print mode. Alternatively, s/he may press the perforation start key (104) with the intention of activating perforation for duplex printing, as a result of which perforation is performed for simplex printing mistakenly in the simplex print mode, causing an expensive master to be wasted.

This suggests that it is desirable for the operator or user (to be referred to as "user" hereafter) to be able to select and set either the duplex print mode or the simplex print mode freely as the initial set mode (default), which is set in advance when the power of the duplex printing device (1) is switched on or during mode clearance to clear the various modes executed by the duplex printing device (1), depending on the frequency with which the user performs duplex printing or simplex printing. It also suggests that the user is not given sufficient warning by simple display means such as the LED (118*a*).

Secondly, the maximum sheet size of the sheets used during duplex printing in the duplex printing device (1) of the two aforementioned publications, comprising a plate cylinder (print drum) (12) which is capable of performing simplex printing on A3 size sheets, for example, is A4 portrait (described as A4 "landscape" in Japanese Unexamined Patent Application Publication 2003-200645, but described hereafter as A4 "portrait" in a direction seen from a user who is facing the operating panel (103)). However, when duplex printing is performed on sheets having a greater size than A4 portrait (also referred to simply as "A4" hereafter), sheet jams occur. This also occurs in a duplex printing device having bank feeding means for selectively feeding sheets of a plurality of sizes stacked on a plurality of feed tables.

Thirdly, the duplex printing device (1) of the two aforementioned publications comprises a sheet thickness setting key (116) for selecting and setting a sheet thickness (one of either "normal", "thin", or "thick", for example). However, if "normal" is selected and set as the sheet thickness by depressing the key (116) mistakenly when "thick" was intended, again a sheet conveyance jam occurs.

Technologies relating to the present invention are also disclosed in, e.g. Japanese Unexamined Patent Application 2003-312914.

SUMMARY OF THE INVENTION

The present invention has been designed in consideration of these circumstances, and it is a principal object thereof to provide a duplex printing device which is capable of solving the problems described above, in particular eliminating wastage during master supply and preventing sheet conveyance jams and the like during duplex printing, and which in addition exhibits the effects of each of the claims to be described hereafter.

In accordance with the present invention, a duplex printing device comprises a duplex printing master on which a first image and a second image are perforated in series over the length of a single plate, and a simplex printing master on which a third image having an image area equivalent to the first image and the second image is perforated over the length of a single plate. The duplex printing master or simplex printing master is wrapped around an outer peripheral surface of a print drum, thereby enabling a duplex printing operation in which one of the first image and second image is printed by pressing a front side of a sheet against the duplex printing master on the print drum using pressing means which can be brought into and out of contact with the print drum, after which the other of the first image and the second image is printed by reversing and refeeding the sheet and pressing a reverse side of the sheet against the duplex printing master on the print drum using the pressing means, and a simplex printing operation in which the third image is printed by pressing one side of the sheet against the simplex printing master on the print drum. When power is supplied to the duplex printing device, during mode clearance for clearing various modes executed by the duplex printing device, and soon, a preset initial set mode can be switched between a duplex print mode for performing the duplex printing operation and a simplex print mode for performing the simplex printing operation.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Figure 1:
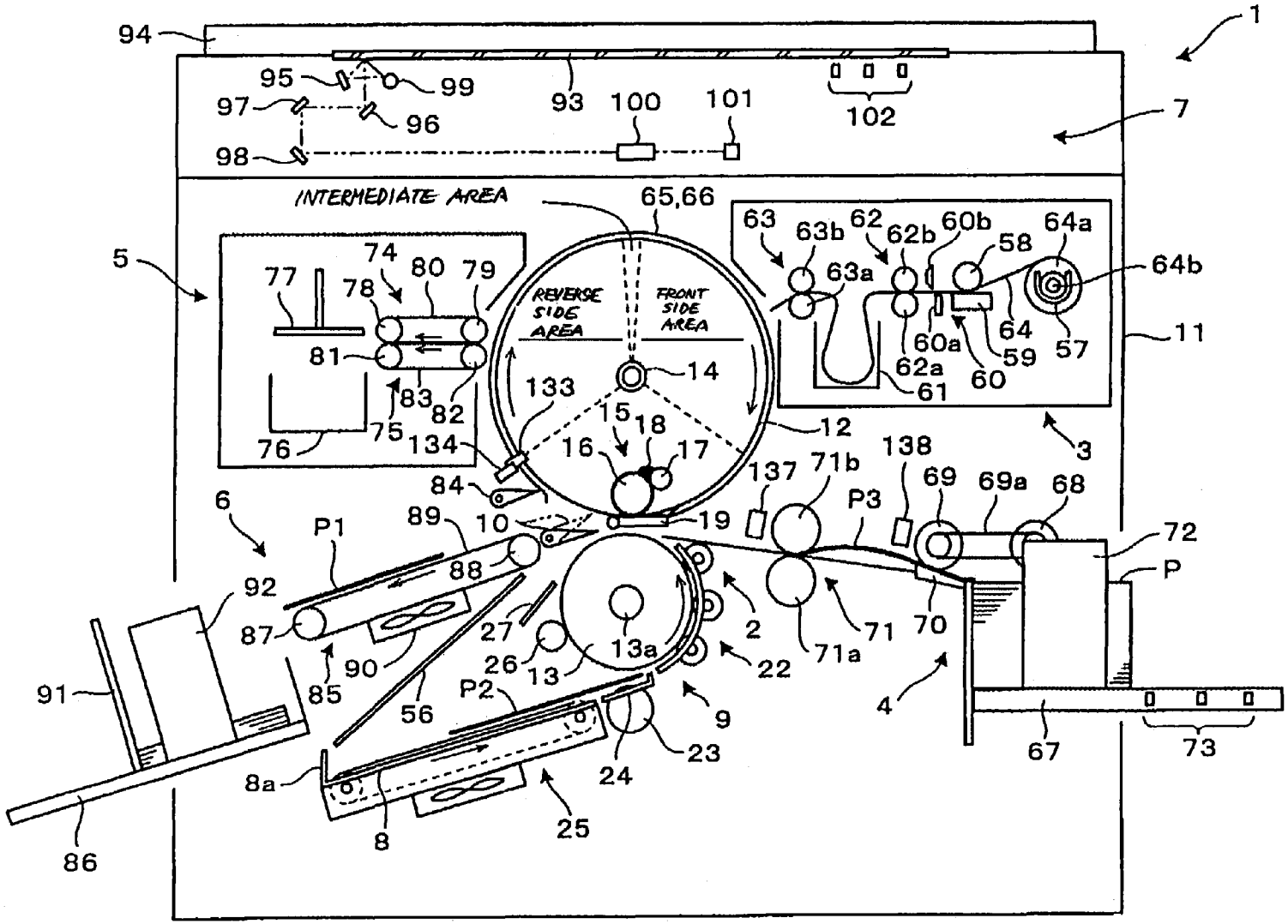
FIG. 1 is a front view of a duplex stencil printing device according to a first and a second embodiment of the present invention.

Embodiments of the present invention will be described below with reference to the drawings. Note that in the examples and so on of each embodiment, constitutional elements of members, constitutional components, and soon having identical functions, shapes, and so on have been allocated identical reference symbols, and are described only once. To simplify the drawings and descriptions, constitutional elements which ought to be noted in a drawing, but need no specific description in relation to the drawing, have been omitted where appropriate. When citing the constitutional elements of Japanese Unexamined Patent Application Publications and so on, including the conventional examples described in the above Background Art section, the reference symbols for these constitutional elements are placed in parentheses to differentiate them from the constitutional elements of the embodiments and so on.

First Embodiment

Referring to FIG. 1 and FIGS. 5 through 19A and 19B, the constitution of a duplex stencil printing device 1 serving as an example of a duplex printing device of a first embodiment will be described simply below together with an outline of a printing operation. As shown in FIG. 1, the duplex stencil printing device 1 has a similar constitution to the duplex stencil printing device (1) disclosed in the aforementioned Japanese Unexamined Patent Application Publication 2003-200645, apart from the constitutions and operating parts particular to the present invention, which will be described below, and is therefore capable of performing a similar operation. The duplex stencil printing device 1 employs the single drum, single pressing means duplex printing method described above to perform a reverse refeeding operation. The constitution and operations of the duplex stencil printing device 1 will now be described in detail.

A print drum 12 is driven to rotate in the direction of the arrow (in a clockwise direction). A duplex printing master 65 shown in FIG. 8 and so on or a simplex printing master 66 shown in FIG. 11, which is cut and perforated by a plate making portion 3 serving as perforating means, is wrapped around the outer peripheral surface of the print drum 12 and clamped at its leading end portion by a clamper 19.

Figure 8:
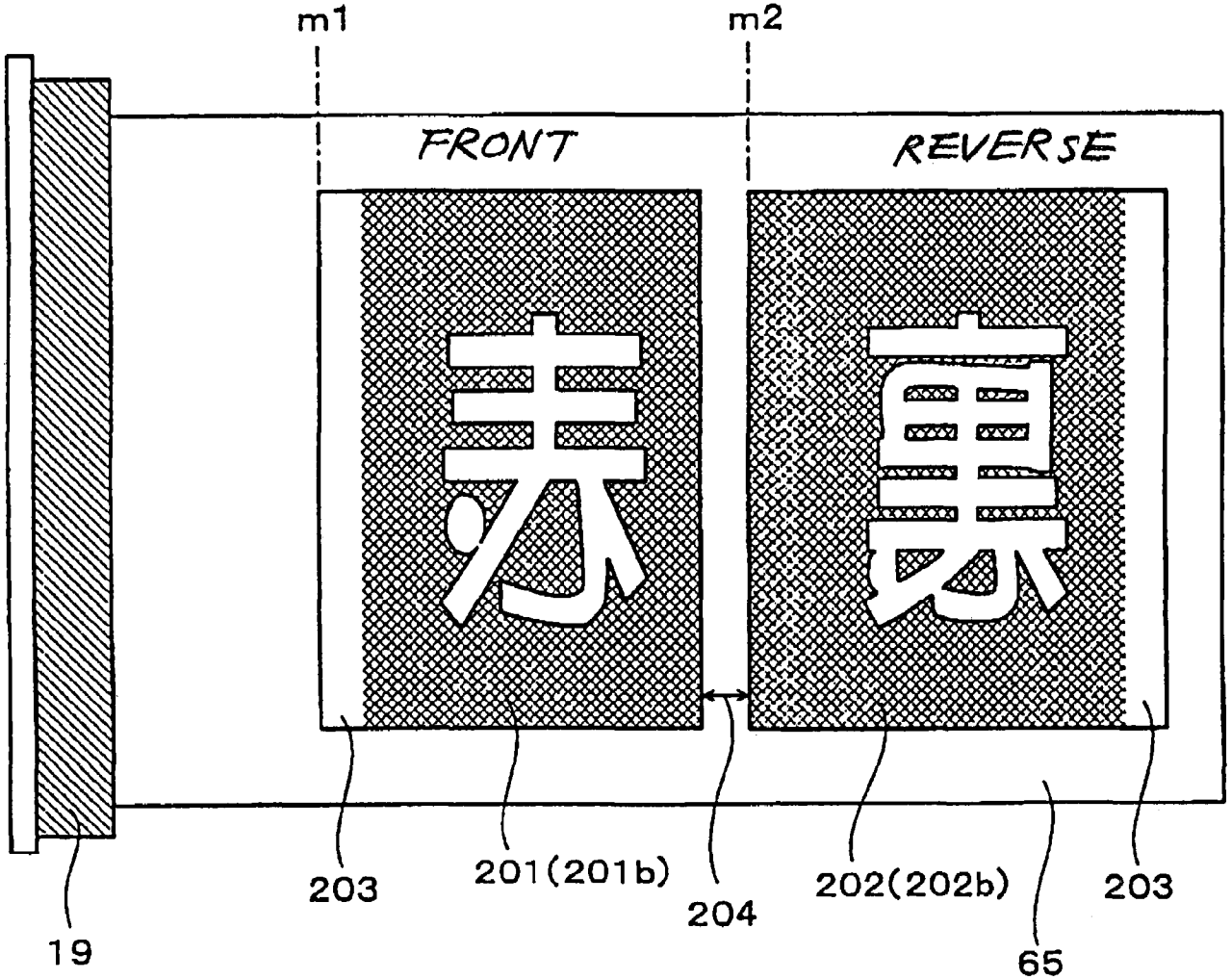
FIG. 8 is a plan view illustrating a duplex printing master on which a front side image and a reverse side image are formed.

As shown in FIG. 8, a first image 201 for front side printing (to be referred to hereafter as "front side image 201") and a second image 202 for reverse side printing (to be referred to hereafter as "reverse side image 202") are formed on the duplex printing master 65 in succession in the rotary direction of the print drum 12. Hereafter, the duplex printing master 65 will occasionally be referred to simply as "master 65", and the simplex printing master 66 simply as "master 66".

During stencil printing, ink is transferred directly onto a sheet of paper (recording medium) through the perforated part of the duplex printing master 65, and therefore the image on the master 65 is a mirror image. FIG. 8 shows the duplex printing master 65 which is wrapped around the print drum 12 in an opened state, from the side of the thermoplastic resin film surface which constitutes the master 65. A predetermined gap 204 is set between the front side image 201 and reverse side image 202. In FIG. 8, the reference numeral 203 denotes a side binding margin portion. The front side image 201 and reverse side image 202 are perforated images. The duplex printing master 65 may also be referred to as a divided perforated master 64.

Figure 20:
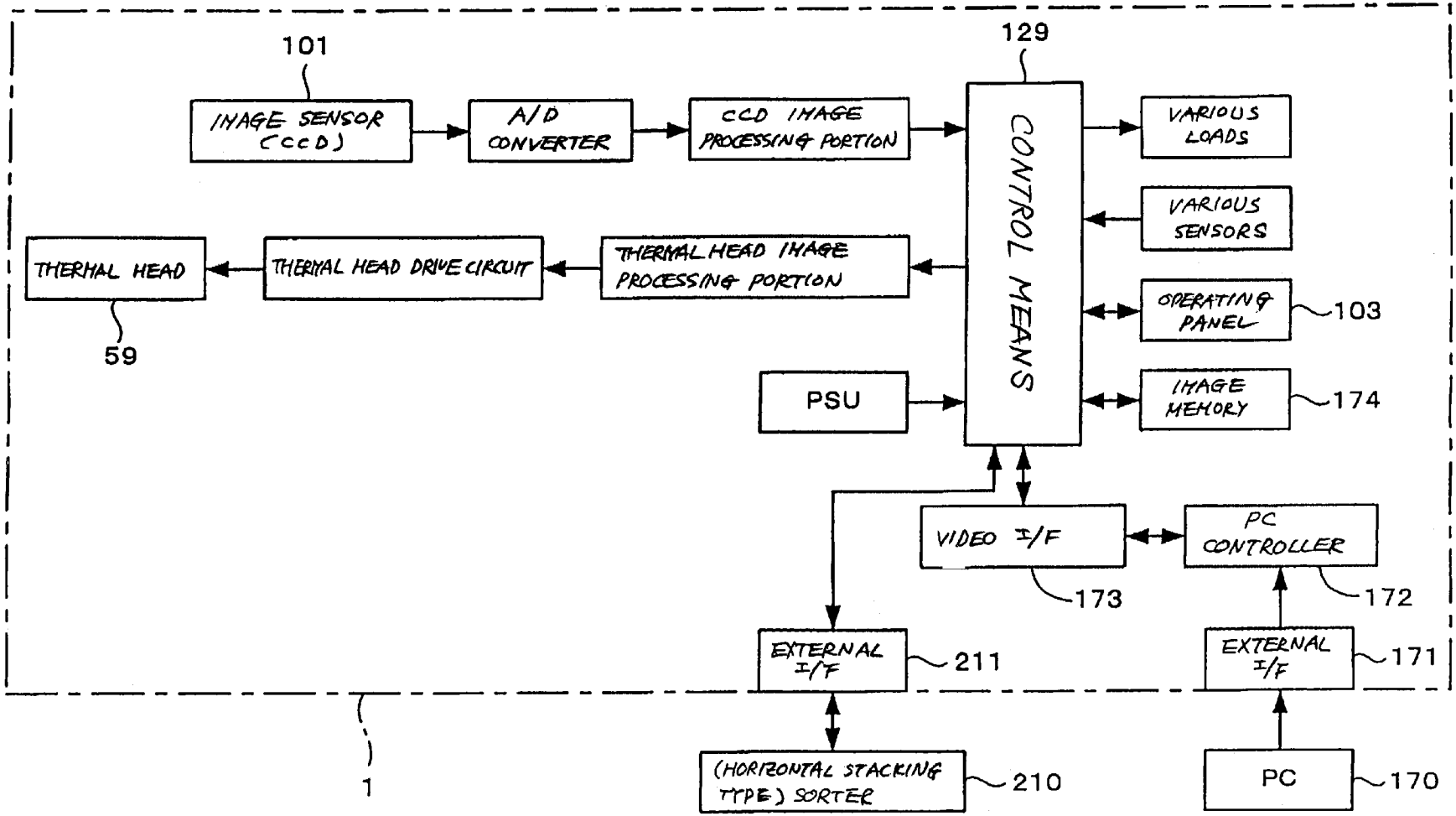
FIG. 20 is a block diagram showing a control constitution of a second example of the first embodiment.

The digital image data used to perform duplex printing perforation, which serve as the source of the images on the duplex printing master 65, are created by reading an original, not shown in the drawing, using an image reading portion (scanner) 7 serving as image reading means. Setting of the original is performed using an automatic document feeder (ADF) or automatic reversing document feeder (ARDF), not shown in the drawing, or through an operation performed by a user for setting the original on a contact glass 93. These digital image data are subjected to image processing to be described below, and then transmitted to the plate making portion 3, where the duplex printing master is perforated. Alternatively, as shown in FIG. 20, the digital image data used for duplex printing perforation may be inputted into control means 129 from a network connected to be capable of communication through a PC (personal computer) controller 172.

Sheets P are stacked onto a feed tray 67 serving as an elevatable feed table. The sheets P have a size corresponding to the size of the front side image 201 and reverse side image 202. More specifically, when the maximum printing size for simplex printing, which is determined according to the outer diameter of the print drum 12, or in other words the printable area of the print drum 12 principally in the rotary direction thereof, is set at A3, for example, the maximum printing size for duplex printing is approximately A4, and the maximum sheet passing size is also A4. The sheet passage direction is the transverse (portrait) direction. Needless to say, if the outer diameter of the print drum 12 in the duplex stencil printing device 1 changes, the respective maximum printing sizes during simplex printing and duplex printing also change (likewise in the following examples of the embodiment).

The sheets P are fed one by one from the feeding portion 4 to a nip portion of a registration roller pair 71, and halted there temporarily so that skew can be corrected. In this state, the sheet becomes a sheet P3. The sheet P3 is then conveyed from the registration roller pair 71 at a predetermined phase timing toward a print pressure portion between the print drum 12 and a press roller 13 serving as pressing means and a pressing member.

Figure 5:
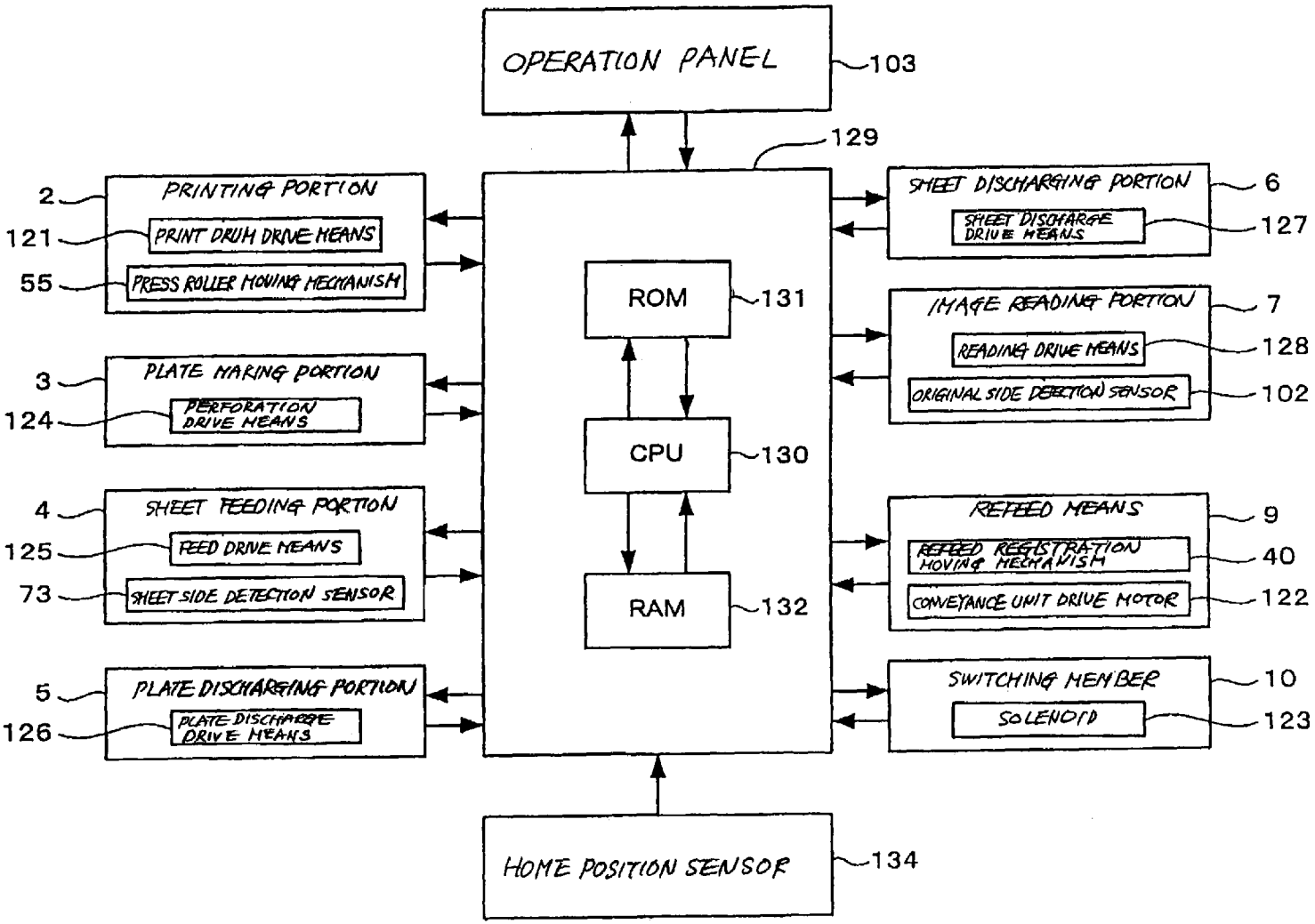
FIG. 5 is a block diagram showing a control constitution of a first example of the first embodiment.

A typical method of generating a phase timing, including the aforementioned predetermined phase timing, will now be described. A phase timing detection plate 133 is mounted on the print drum 12, and a phase timing signal is generated by a home position sensor (photointerruptor) 134 disposed on a device main body 11 side from the phase timing detection plate 133. The feeding portion 4 shown in FIG. 5 is capable of detecting and recognizing in real time the rotary phase position (timing) of the print drum 12 using this phase timing signal and a rotary pulse signal generated every time a main motor, not shown in the drawing, rotates by a fixed angle.

To generate the phase timing signal at a desired phase angle of the print drum 12, the phase timing detection plate 133 generates the phase timing signal after detecting a rotary phase position (timing) corresponding to the desired phase angle of the print drum 12. Thus the phase timing signal can be generated at a delay. As a result, the feeding portion 4 is capable of generating the phase timing signal at the desired phase angle of the print drum 12.

Having been printed with a front side printed image corresponding to the front side image 201 by a printing portion 2, the sheet P2 is guided in the lower left direction of FIG. 1 by a switching member 10 which is switched upward (to the position shown by the dot/dot/dash line), and thus discharged toward a refeed tray 8. The discharged sheet P2 abuts against an end fence 8*a* of the refeed tray 8, and lands in the refeed tray 8.

The sheet P2 stored in the refeed tray 8 is then conveyed in the direction of the arrow (rightward) by a belt type suction conveyance device, to be described below, until the leading end thereof abuts against a stopper 24*a* formed integrally with a refeed positioning member 24.

The sheet P2 remains in this state while the next sheet P3 is conveyed to the printing portion at a timing for printing the front side image 201 thereon and then refed toward the printing portion along the periphery of the press roller 13 at a timing for printing the reverse side image 202 thereon. A front side printed image corresponding to the front side image 201 is formed and printed on the surface of the sheet P2 contacting the press roller 13, and since the sheet P2 is adhered to the surface of the press roller 13, misregistration does not occur, thereby preventing defects such as blurring and line thickening.

An appropriate interval corresponding to the predetermined gap 204 exists between the rear end of the aforementioned next sheet P3 and the leading end of the sheet P2. The refed sheet P2 is reversed by rotation of the press roller 13 in the direction of the arrow in the drawing such that the non-printed side faces upward. A reverse side printed image corresponding to the reverse side image 202 is then formed and printed on this upward-facing side.

Having completed duplex printing and passed through the printing portion 2, the sheet P1 is guided leftward by the switching member 10, which is switched downward (to the position shown by the solid line in the drawing), conveyed by the belt type suction conveyance device to be described below, and thus discharged and stacked onto a discharge tray 86 serving as a discharge table.

Figure 10B:
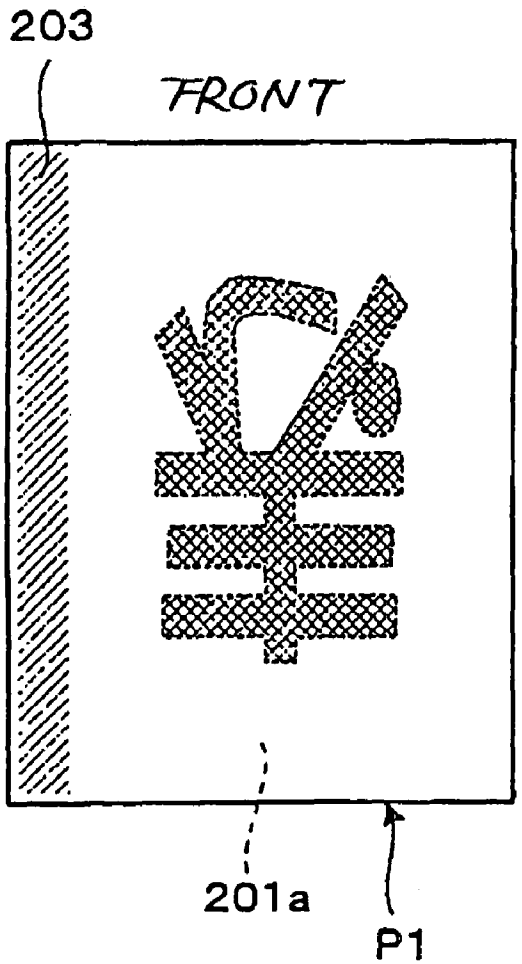
FIGS. 10A and 10B are plan views showing a state in which a duplex-printed sheet formed with a front side printed image and a reverse side printed image is discharged.
Figure 10A:
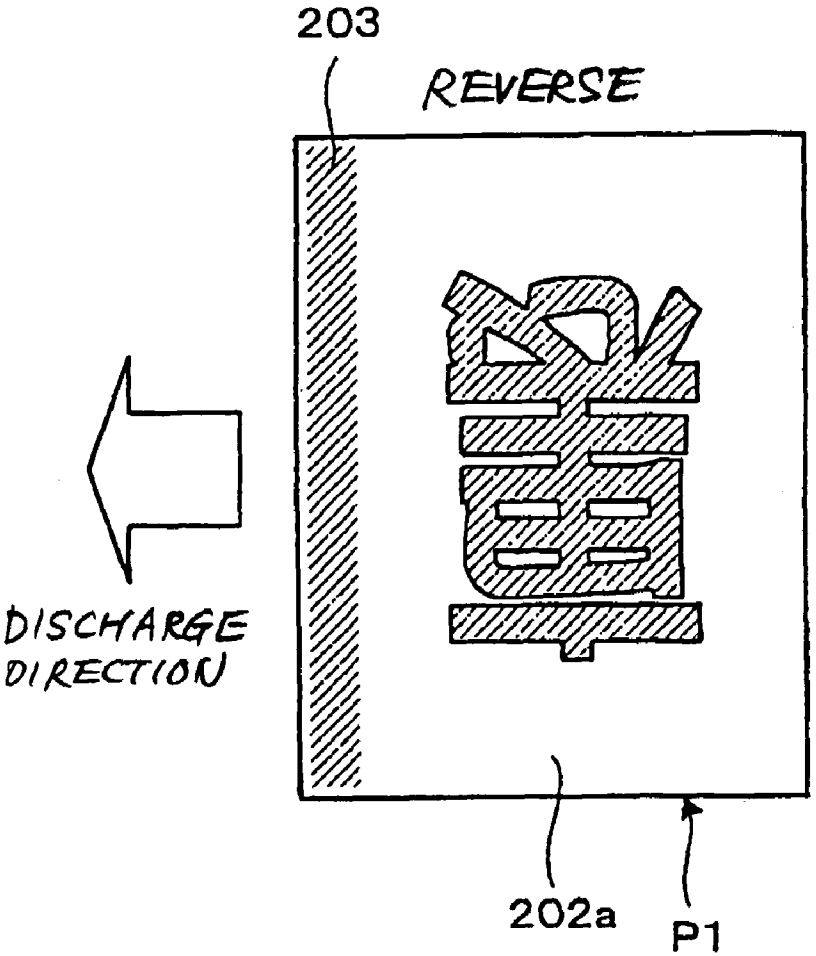

As shown in FIG. 10A, the sheet P1 is discharged with a reverse side printed image 202*a, shown by shading in the drawing, facing upward. FIG. 10B shows a front side printed image 201***a* on the other side of the discharged sheet P1 in a mesh pattern. To simplify description, the process of forming and printing the front side printed image 201*a* in accordance with the front side image 201 serving as a perforated image will be referred to hereafter as "the front side image 201 is printed". Similarly, the process of forming and printing the reverse side printed image 202*a* in accordance with the reverse side image 202 serving as a perforated image will be referred to as "the reverse side image 202 is printed".

Figure 6:
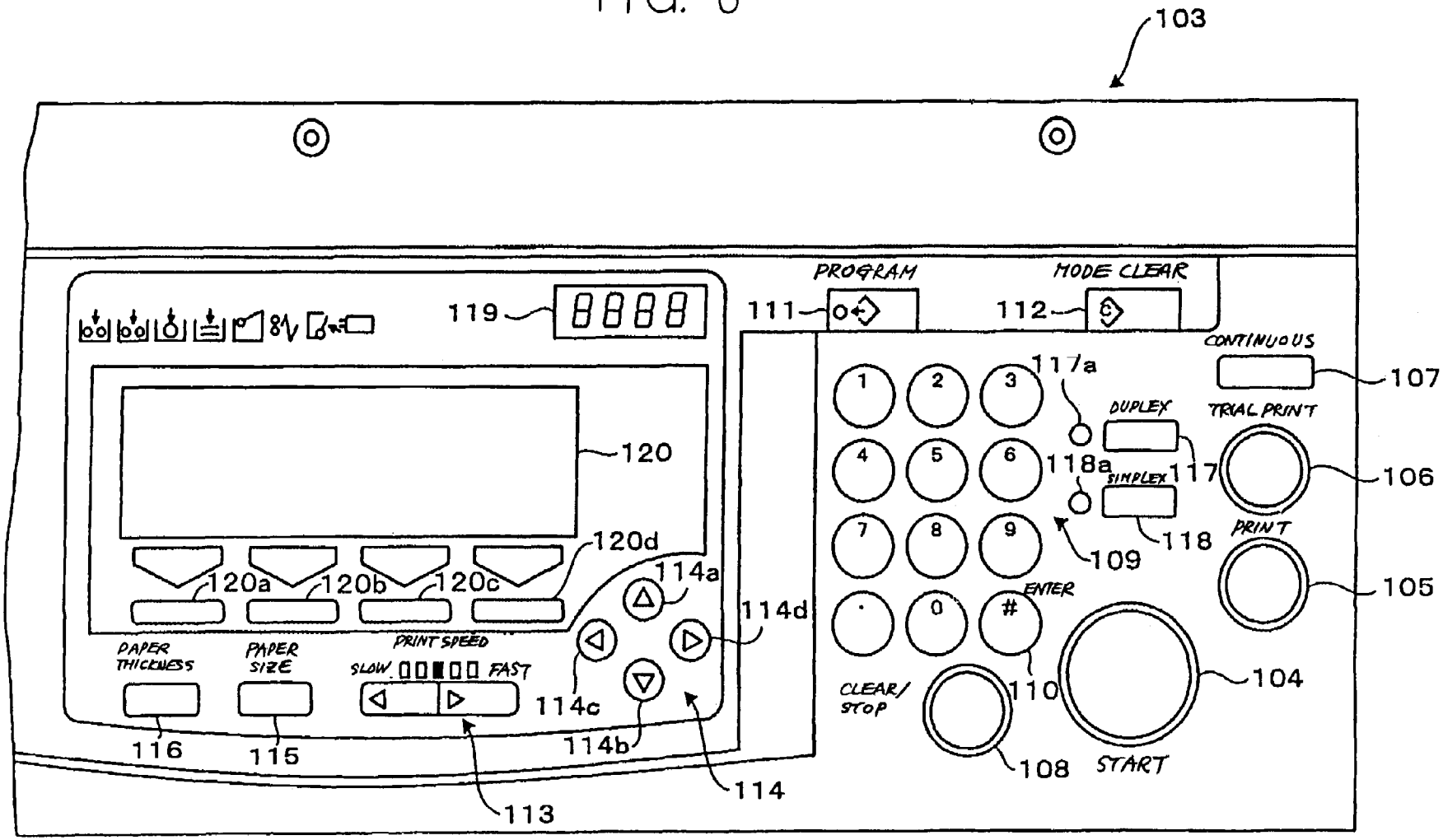
FIG. 6 is a plan view of the main parts of an operating panel of the duplex stencil printing device of FIG. 1.

When duplex printing is to be performed, a user presses a duplex print mode key 117 on an operating panel 103 shown in FIG. 6. When the duplex print mode key 117 is depressed, a duplex print mode display lamp 117*a* constituted by an LED (light-emitting diode display device) is illuminated, and thus the user is able to confirm that the duplex print mode has been set. Next, the user sets the thickness of the sheet P to be used by appropriately pressing a sheet thickness setting key 116, to be described below, and then presses a perforation start key 104 to generate a start signal which is transmitted to control means 129 shown in FIGS. 5 and 7. The control means 129 then issue a command relating to plate mounting and the start of a duplex printing operation.

Figure 11:
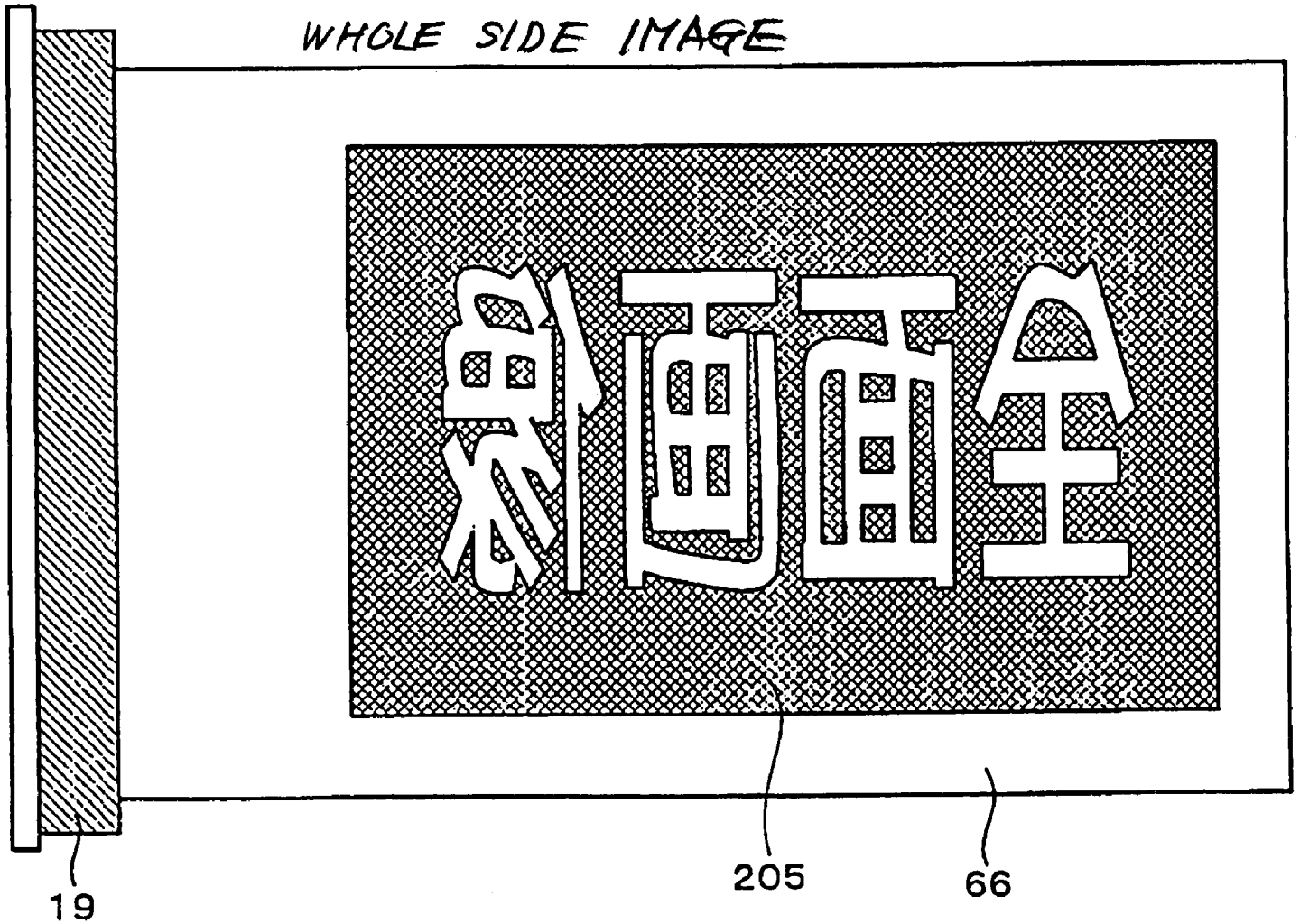
FIG. 11 is a plan view illustrating a simplex printing master formed with a whole side image.
Figure 12:
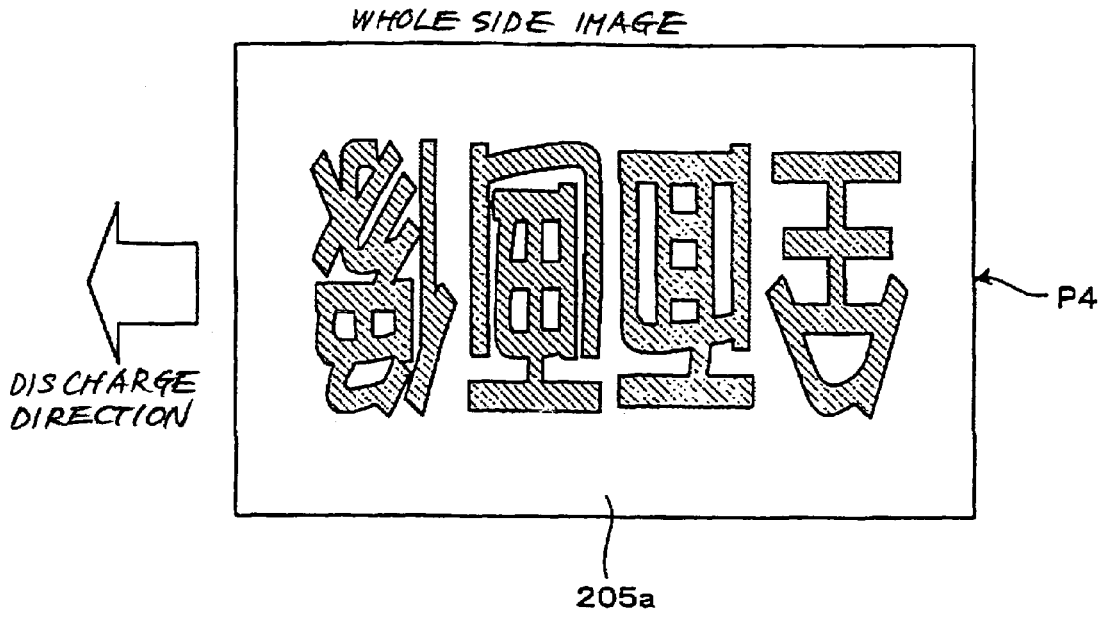
FIG. 12 is a plan view illustrating a state in which a simplex-printed sheet formed with a whole side printed image is discharged.

On the other hand, when simplex printing is to be performed, the user presses a simplex print mode key 118 as shown in FIG. 6, whereby a simplex print mode display lamp 118*a* constituted by an LED is illuminated. Thus the user is able to confirm that the simplex print mode has been set. Next, the user presses the perforation start key 104 to generate a start signal which is transmitted to the control means 129 shown in FIGS. 5 and 7. The control means 129 then issue a command relating to plate mounting and the start of a simplex printing operation. In the case of simplex printing, a whole side image 205 is perforated on the master 64 as shown in FIG. 11. In other words, in the case of simplex printing, an image can be disposed over the entire area of the front side image 201 and reverse side image 202 (including the predetermined gap 204).

Having completed simplex printing and passed through the printing portion 2, a sheet P4 (see FIG. 12) is formed and printed with a whole side printed image 205*a* corresponding to the whole side image 205, guided leftward by the switching member 10, which is switched downward, conveyed by the aforementioned suction conveyance device, and discharged and stacked on the discharge tray 86. Thus simplex printing can be performed in an identical manner to a normal simplex printing device.

Figure 9:
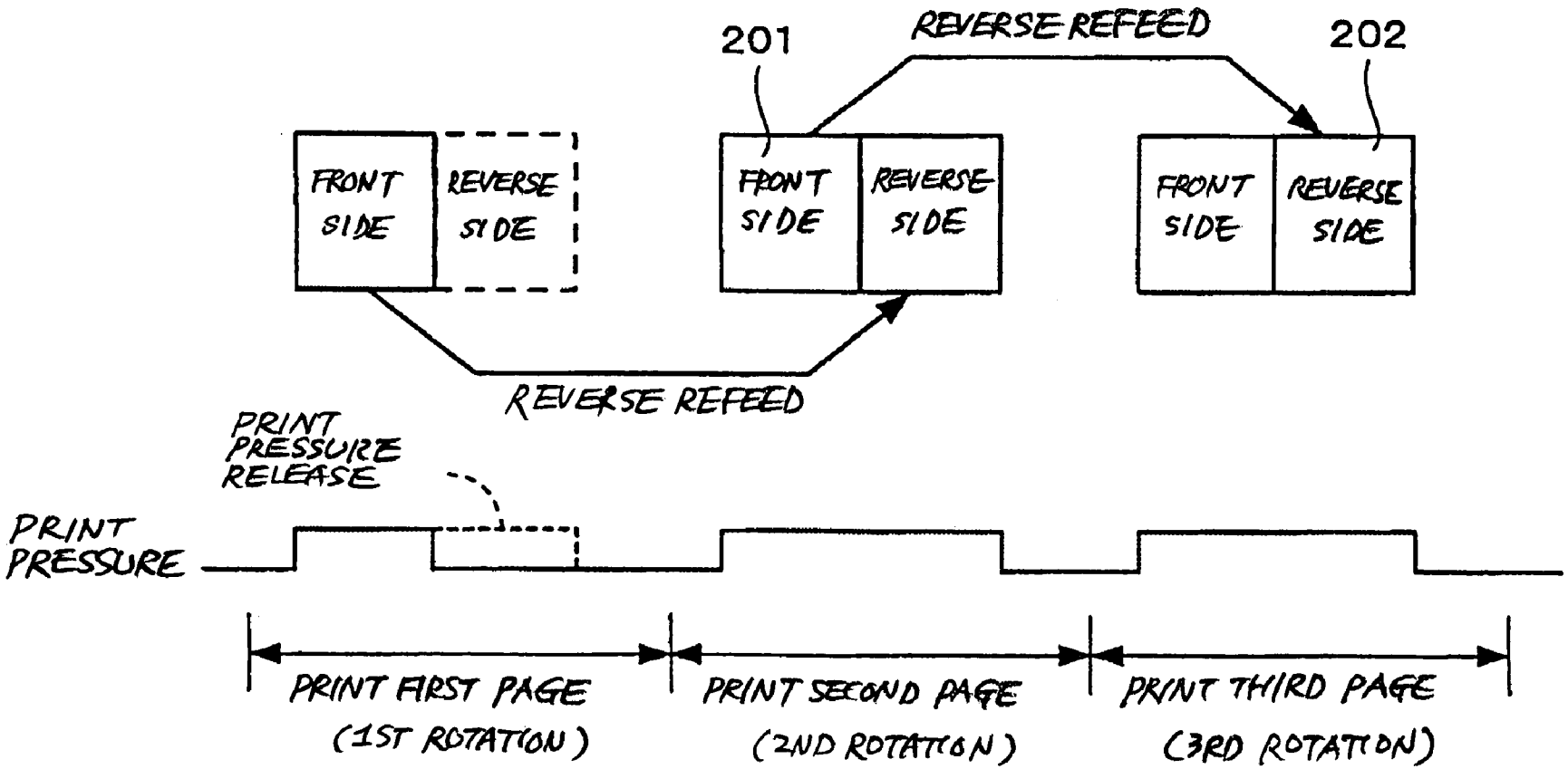
FIG. 9 is a flowchart illustrating a print pressure timing.

Next, print pressure control will be described on the basis of FIG. 9. During duplex printing, no sheet is stacked intermediately on the refeed tray 8 during printing of the first sheet. Hence no sheet is refed from the refeed tray 8, and when the press roller 13 presses against the print drum 12 in the area corresponding to the reverse side image 202, the press roller 13 contacts the master 64 directly and thereby becomes contaminated with ink, inviting ink contamination on the next sheet. To prevent this, print pressure must be released in the area of the reverse side image 202 during printing of the first sheet.

Hence in this embodiment, the print pressure is controlled selectively using three cam plates comprising a cam plate for applying print pressure only in the area of the front side image 201, a cam plate for applying print pressure in all areas, and a cam plate for applying print pressure only in the area of the reverse side image 202.

During printing of the first sheet, the cam plate for applying print pressure only in the area of the front side image 201 is selected. Next, the cam plate for applying print pressure in all areas is selected. During refeeding of the final sheet, the cam plate for applying print pressure only in the area of the reverse side image 202 is selected.

During simplex printing, the conveyance path of the sheet P is comparatively linear, and hence printing can be performed without problems even on thick sheets. However, during duplex printing, the sheet P is reversed while adhered to the press roller 13, which has a comparatively small diameter, and it is therefore difficult to convey and print thick sheets such as 135 kg sheets, for example.

In this embodiment, as shown in FIG. 6, sheet thickness values are displayed on a liquid crystal display 120 constituted by an LCD (liquid crystal display) when the sheet thickness setting key 116 is pressed repeatedly, and thus the sheet thickness can be selected and set. When the set thickness of the sheet P is greater than a predetermined thickness and the duplex print mode has been selected, the selection is canceled by the control means 129 and a warning such as "duplex printing cannot be performed due to the thickness of the paper", for example, is displayed on the liquid crystal display 120. Thus the user can be prevented from performing duplex printing on thick sheets, which may lead to defects such as a sheet jam.

Further, by pressing a sheet size setting key 115 on the operating panel 103 repeatedly, sheet sizes are displayed on the liquid crystal display 120, and thus the sheet size can be selected and set. During duplex printing in this embodiment, the maximum sheet size is A4, and moreover, the sheet must pass in the transverse direction. Hence when a sheet P having a larger size than A4 is set on the feed tray 67 serving as a feed table or an A4 sheet is set to be passed in the longitudinal direction, duplex printing cannot be performed normally, and therefore a warning such as "duplex printing cannot be performed due to an inappropriate paper size", for example, is displayed on the liquid crystal display 120.

The size of the sheet P stacked and set on the feed tray 67 is detected by the detection information of a detection sensor 73 for detecting a plurality of sheet sizes, which is provided on the feed tray 67 and constitutes sheet size detection means, and detection means not shown in the drawing for detecting the set width of a side fence 72. The size is then recognized and determined by the control means 129 on the basis of this detection information.

As shown in FIG. 8, the predetermined gap 204 is provided between the front side image 201 and reverse side image 202 formed on the duplex printing master 65. This predetermined gap 204 prevents the sheets P from overlapping.

If the predetermined gap 204 is not provided or is too small, the refed sheet P2 on which the reverse side image 202 is to be printed overlaps with the upper side of the rear end portion of the sheet P2 on which the front side image 201 alone is printed. In this case, the image is not printed in the desired position, and moreover, when the printed sheet P2 formed with the front side printed image 201*a* is discharged to the refeed tray 8, the duplex-printed sheet P1 formed with the reverse side printed image 202*a* may also be discharged to the refeed tray 8. The duplex-printed sheet P1 must be discharged to the discharge tray 86, and therefore by providing the predetermined gap 204, such defects can be avoided.

In FIG. 8, the reference symbols 201*b* and 202*b*, which are provided in parentheses for ease of description, denote a front side original image, which is an original image corresponding to the perforated front side image 201, and a reverse side original image, which is an original image corresponding to the perforated reverse side image 202, respectively.

When the duplex print mode has been selected, an original comprising the front side original image 201*b* shown in FIG. 8 and an original comprising the reverse side original image 202*b* shown in FIG. 8 are set in series on the contact glass 93 of an image reading portion 7 shown in FIG. 1 in a joined state or with a slight gap therebetween. At this time, the control means 129 serving as perforation control means determines the overall size of the original on the basis of detection information from a detection sensor (reflection photosensor) 102 for detecting a plurality of original sizes.

On the basis of the original size detected by the control means 129, a first half length, which is half of the length of the original in the horizontal direction, is recognized as the front side original image 201*b*, and the length of the remaining half is recognized as the reverse side original image 202*b*. The front side original image 201*b* and reverse side original image 202*b* are recognized in a similar manner when carried on a single original sheet. As shown in FIG. 8, the control means 129 control the plate making portion 3 to perforate the front side image 201 from a position m1 (a setting reference position on the contact glass 93 or a reading reference position for automatic feeding) on the master 64 in tandem with the reading operation of the front side original image 201*b*, and to convey the master 64 past the predetermined gap 204 (20 mm for A4 in this embodiment) once the front side image 201 has been perforated so that the reverse side image 202 can be perforated from a position m2.

Reading and perforation of the reverse side image 202 begins when a carriage (not shown) of the image reading portion 7 has been returned to the home position and then moved to the leading end position of the reverse side image 202. However, the operation to the return the carriage need not be performed, and instead, the carriage may be halted such that reading and perforation are begun when the master 64 has been conveyed past the predetermined gap 204.

When the size of the original and the sheet P is smaller than A4, the predetermined gap 204 is enlarged accordingly, but the perforation reference position m1 of the front side image 201 and the perforation reference position m2 of the reverse side image 202 do not change.

In this embodiment, the detection sensor 102 for detecting a plurality of original sizes, disposed under the contact glass 93, is used as original size detection means, but when the ADF, not shown in the drawing, is used, the original size is detected by a combination of the original side fence width of the ADF and the original length, for example.

Alternatively, original size input means, not shown in the drawing, may be provided on the operating panel 103, for example, such that the original size is inputted manually rather than detected automatically.

During duplex printing, in this embodiment the maximum size of the perforated image formed on the duplex printing master 65 is A4, as shown in FIG. 8, and moreover, perforation must be performed transverse (in portrait) to the sub scanning direction and original conveyance direction. Hence when an original having a larger size than A4 is set on the contact glass 93 or an original loading table of the ADF, not shown in the drawing, or an A4 original is set with a longitudinal sub scanning direction (original conveyance direction or the conveyance direction of the aforementioned carriage), normal perforation for duplex printing cannot be performed, and therefore the control means 129 control the image reading portion 7 to align the original with the sheet size by executing automatic image processing such as reduction of the original image or rotation processing to rotate the original image ninety degrees.

Next, referring to FIGS. 1 through 5, the constitution and printing operation of the duplex stencil printing device 1 in this embodiment will be described in detail.

As shown in FIG. 1, the duplex stencil printing device 1 comprises the printing portion 2, plate making portion 3, feeding portion 4, a plate discharging portion 5, a sheet discharging portion 6, the image reading portion 7, the refeed tray 8, which is also referred to as the auxiliary tray 8 serving as refeed storage means, refeed means 9, the switching member 10 serving as switching means, and so on, similarly to the duplex printing device (1) disclosed in the aforementioned Japanese Unexamined Patent Application Publication 2003-200645 or Japanese Unexamined Patent Application Publication 2003-237207. The duplex stencil printing device 1 is also capable of a similar simplex printing operation to that of the duplex printing device (1) disclosed in the aforementioned Japanese Unexamined Patent Application Publication 2003-200645 (see paragraph [0106] thereof), including plate mounting (see paragraphs [0092] through [0104] thereof) and trial printing (see paragraphs [0092] through [0104] thereof), and a similar duplex printing operation to that of the same publication (see paragraph [0132] onward thereof), including duplex print perforation (see paragraphs [0107] through [0125] thereof) and test duplex printing (see paragraphs [0126] through [0131] thereof). These basic operations are performed similarly in the examples of each of the following embodiments, as well as the first embodiment, under the control of the various control means, and hence detailed description thereof has been omitted.

The constitution and operations of this embodiment can be understood easily by referring to Japanese Unexamined Patent Application Publication 2003-200645 and changing the main constitutional elements thereof such that "auxiliary tray 8" in the publication is read as "refeed tray 8", "refeed conveying member 25" in the publication is read as "refeed conveyance unit 25", "print cylinder 12" in the publication is read as "print drum 12", "first perforated image 65A" in the publication is read as "first image 201", "second perforated image 65B" in the publication is read as "second image 202", "divided perforated master 65" in the publication is read as "duplex printing master 65", "perforated master 66" in the publication is read as "simplex printing master 66", "duplex printing key 117" in the publication is read as "duplex print mode key 117", "LED 117*a*" in the publication is read as "duplex print mode display lamp 117*a*", "simplex printing key 118" in the publication is read as "simplex print mode key 118", "LED 118*a*" in the publication is read as "simplex print mode display lamp 118*a*", and "display device 200" in the publication is read as "liquid crystal display 200". Therefore, detailed description of the constitution and operations has been omitted.

As shown in FIG. 1, the printing portion 2 is disposed substantially in the center of the device main body 11, and comprises the print drum 12 and the press roller 13. In this embodiment, and also in the following embodiments, the print drum 12, ink supply means 15, and press roller 13 are all provided singly. The print drum 12 is constituted mainly by drum flanges constituted by a pair of end plates, not shown in the drawing, that are supported rotatably on a shaft 14 which doubles as an ink supply pipe, a porous support plate, not shown in the drawing, constituting a plate cylinder that is wrapped around and fixed to the outer peripheral surface of each drum flange, and a mesh screen, not shown in the drawing, that is wrapped around the outer peripheral surface of the porous support plate, not shown in the drawing. The print drum 12 is driven to rotate by print drum driving means 121 (see FIG. 5) comprising the aforementioned main motor and so on, via driving force transmission means comprising a gear and an endless belt, not shown in the drawing, and is constituted to be detachable from the device main body 11. The print drum 12 is large enough so that printed matter having a maximum size of A3 can be obtained during simplex printing.

The ink supply means 15 are disposed in the interior of the print drum 12. The ink supply means 15 comprise the shaft 14, an ink roller 16, a doctor roller 17, and so on. The ink roller 16 is supported rotatably between side plates, not shown in the drawing, provided in the print drum 12, and disposed such that its peripheral surface contacts with the inner peripheral surface of the print drum 12. The ink roller 16 is driven to rotate in the same direction as the print drum 12 upon transmission of the driving force of the print drum driving means 121. The doctor roller 17 is also supported rotatably between the aforementioned side plates, and disposed such that its peripheral surface contacts the peripheral surface of the ink roller 16. The doctor roller 17 is driven to rotate in the opposite direction to the print drum 12. A plurality of small holes are formed in the shaft 14 such that ink supplied through the shaft 14 gathers in a space having a wedge-shaped cross section, formed at the contact portion between the ink roller 16 and the doctor roller 17, thereby forming an ink well 18.

A stage portion is formed on the outer peripheral surface of the print drum 12 so as to form a plane in the axial direction of the print drum 12. The clamper 19 is disposed on the stage for clamping the leading end portion of the master on the outer peripheral surface of the print drum 12. The clamper 19 is opened and closed by opening/closing means, not shown, when the print drum 12 has rotated to a predetermined position.

Figure 2:
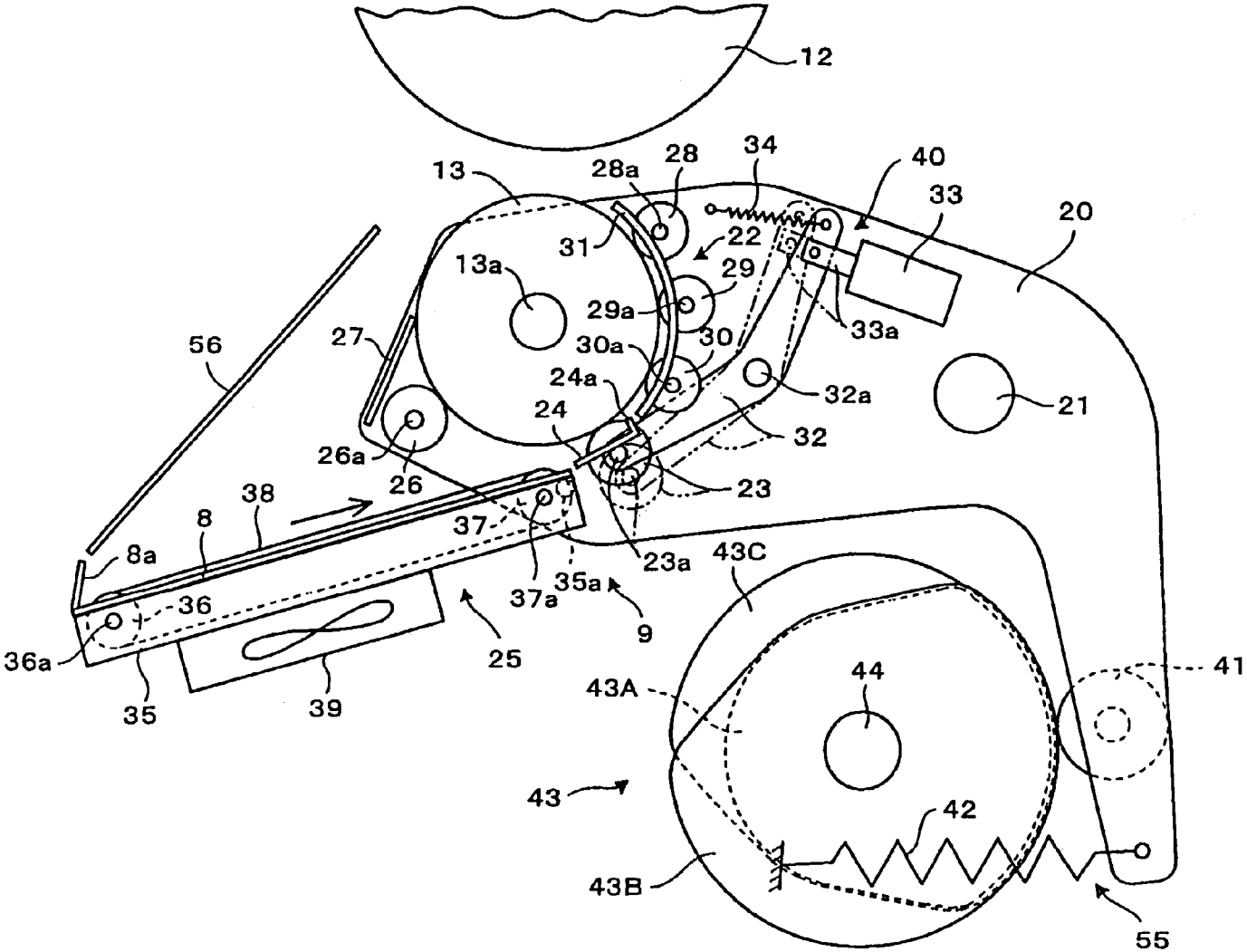
FIG. 2 is a front view illustrating refeeding means, a press roller moving mechanism, and a press roller separated from the outer peripheral surface of a print drum in the duplex stencil printing device of FIG. 1.
Figure 3:
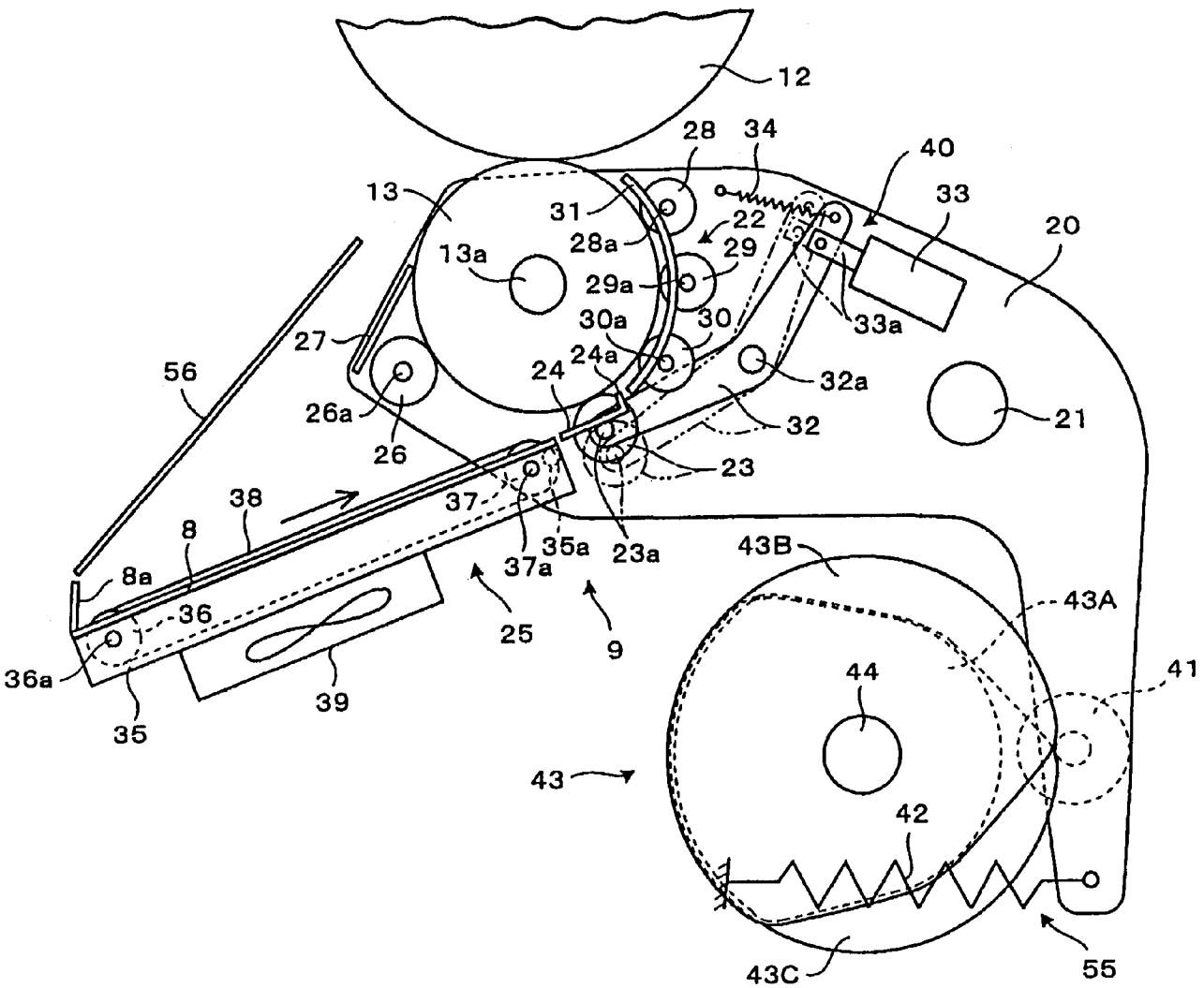
FIG. 3 is a front view illustrating the refeeding means, the press roller moving mechanism, and the press roller in contact with the outer peripheral surface of the print drum in the duplex stencil printing device of FIG. 1.

The press roller 13 is positioned below the print drum 12. The press roller 13 is constituted by a metallic core 13*a* and an elastic body formed from rubber or the like which is wrapped around the core 13*a*, and extends in the axial direction of the print drum 12. As shown in FIG. 2, the two end portions of the core 13*a* are supported rotatably by a pair of arm members 20. Each arm member 20 has a substantial L-shape, and the arm members 20 are integrated by a rocking shaft 21 attached in the vicinity of their bent portions. The rocking shaft 21 is supported rotatably by the device main body 11.

As well as the press roller 13, a refeed guide member 22, a refeed registration roller 23, a refeed positioning member 24, a refeed conveyance unit 25, a cleaning roller 26, a guide plate 27, and so on are provided between the arm members 20. The refeed guide member 22, adjoining the right side of the press roller 13, comprises a plurality of roller-shaped rollers 28, 29, 30, which are provided integrally on respective shafts 28*a*, 29*a*, and 30*a* such that the respective peripheral surfaces thereof press against the peripheral surface of the press roller 13, and a sheet guide plate 31 formed with a curved surface to cause the sheet P to move around the periphery of the press roller 13. The shafts 28*a*, 29*a*, 30*a* are supported rotatably by the arm members 20 at each end thereof, and biased toward the core 13*a* by biasing means, not shown in the drawing.

The rollers 28, 29, 30 extend over substantially the entire width of the press roller 13, and are attached integrally to the corresponding shafts 28*a*, 29*a*, 30*a* with a predetermined gap therebetween. The guide plate 31 is removed from the periphery of press roller 13 by a predetermined distance smaller than the radius of the rollers 28, 29, 30, and is fixed to the arm members 20 at its two end portions. The guide plate 31 has a curved surface forming an arc centered on the core 13*a*, and is formed with a plurality of opening portions enabling the periphery of the rollers 28, 29, 30 to contact the periphery of the press roller 13.

The refeed registration roller 23 is positioned below the press roller 13. The roller-shaped refeed registration roller 23 is supported rotatably on a shaft 23*a* which is mounted on one end of a rocking arm 32. The rocking arm 32 has a substantial boomerang shape, and the bent portion thereof is supported rockably on a shaft 32*a*, which is fixed between the arm members 20. The rocking arm 32 is positioned such that the refeed registration roller 23 is located at substantially the center of the width direction of the press roller 13, and such that the rocking arm 32 itself is positioned in an intermediate position between the respective rollers 30.

A solenoid 33 is mounted on one of the arm members 20 via a bracket, not shown, and comprises a plunger 33*a* connected to the other end of the rocking arm 32. A tension spring 34 is fixed at one end to one of the arm members 20 and at the other end to the above end of the rocking arm 32, thereby biasing the rocking arm 32 counterclockwise, as viewed in FIG. 2, about the shaft 32*a*. When the solenoid 33 is energized and activated, the periphery of the refeed registration roller 23 is brought to a contact position indicated by a solid line in FIG. 2 where it is pressed against the periphery of the press roller 13 with a predetermined pressure. When the solenoid 33 is deactivated, the periphery of the refeed registration roller 23 is brought to a release position indicated by a dot/dot/dash line in FIG. 2 where it is released from the periphery of the press roller 13 under the bias of the tension spring 34. The solenoid 33 and tension spring 34 constitute a refeed registration moving mechanism 40.

The refeed positioning member 24 is positioned above the refeed registration roller 23, and constituted by a plate having an L-shaped cross section. The refeed positioning member 24 has a substantially identical width to the press roller 13, and is fixed to the arm members 20 at its two end portions, with a stopper 24*a* thereof facing upward. A notch portion, not shown, is formed in the refeed positioning member 24 so as not to interfere with the refeed registration roller 23 when the roller 23 is rocked.

The refeed conveyance unit 25 is positioned below the press roller 13 at the left-hand side of the refeed positioning member 24. The refeed conveyance unit 25 comprises a conveyance member main body 35, a drive roller 36, a driven roller 37, an endless belt 38, a suction fan 39, and so on. The refeed tray 8 is positioned above and formed integrally with the refeed conveyance unit 25.

The conveyance member main body 35 is open at its upper face, and takes a box form having a width slightly smaller than the gap between the arm members 20. Bearings, not shown, are mounted on the two side faces of the conveyance member main body 35 at the upstream and downstream sides in the direction of sheet conveyance so as to rotatably support a drive shaft 36*a* and a driven shaft 37*a* respectively. The two end portions of the drive shaft 36*a* penetrate the two side faces of the conveyance member main body 35, and the two penetrating end portions are rotatably supported by bearing members, not shown, which are provided in the device main body 11.

A drive gear, not shown, is mounted on one end of the drive shaft 36*a*. The drive shaft 36*a* is driven to rotate by a conveyance unit drive motor 122 (see FIG. 5) provided in the device main body 11. The two end portions of the driven shaft 37*a* do not penetrate the side faces of the conveyance member main body 35. Bosses 35*a* are formed integrally with the conveyance member main body 35 on the outside of the two side faces thereof at the upstream side end portions thereof in the direction of sheet conveyance. Each boss 35*a* is fitted into a slot, not shown, formed in each arm member 20. With this constitution, when a press roller moving mechanism 55, which will be described later, moves the press roller 13 into or out of contact with the print drum 12, the conveyance member main body 35 is capable of rocking about the drive shaft 36*a* in accordance with the rocking of the arm members 20.

A plurality of the roller-shaped drive rollers 36 is mounted integrally on the drive shaft 36*a*, with a predetermined gap provided between each drive roller 36. Likewise, a plurality of the driven rollers 37, having a similar shape to the drive rollers 36, is mounted integrally on the driven shaft 37*a* with the same gap as the drive rollers 36 therebetween. The endless belt 38, comprising a plurality of hole portions not shown in the drawing, is wrapped around the drive rollers 36 and the corresponding driven rollers 37 at a predetermined tension. The endless belt 38, which is constituted by a friction resistant material, is moved in a direction indicated by an arrow in FIG. 2 when the drive shaft 36*a* is driven to rotate by the conveyance unit drive motor 122.

The suction fan 39 is mounted integrally on the bottom face of the conveyance member main body 35, while the refeed tray 8 is mounted integrally on the top face of the conveyance member main body 35. The refeed tray 8 is formed with a plurality of opening portions, not shown, in order to allow each segment of the endless belt 38 to face a sheet conveying surface. The end fence 8*a* is formed integrally with the refeed tray 8 at the downstream side end portion thereof in the sheet conveyance direction in order to receive the conveyed sheet P.

A hole portion, not shown, is provided in the bottom face of the conveyance member main body 35, which serves as an attachment face for the suction fan 39, so that the suction fan 39 can generate negative pressure in the interior of the box-form conveyance member main body 35 when activated in order to aspirate the sheet P onto the upper face of the moving segments of the endless belt 38. The suction force of the suction fan 39 and the frictional resistance of the endless belt 38 are set at a sufficient strength such that when the leading edge of the sheet P contacts the stopper 24*a* of the refeed positioning member 24, slip occurs between the sheet P and the endless belt 38.

The refeed guide member 22, refeed registration roller 23, refeed positioning member 24 and refeed conveyance unit 25 constitute the refeeding means 9.

The cleaning roller 26 is positioned in the vicinity of the press roller 13 above the refeed conveyance unit 25 in order to clean the peripheral surface of the press roller 13. The cleaning roller 26 has substantially the same width as the press roller 13, and is formed integrally with a core 26*a* at its center. At least the surface of the cleaning roller 26 is formed from Japanese paper, sponge or similar highly water-absorbent material.

The cleaning roller 26 is supoprted rotatably by fitting the core 26*a* into slots, not shown, formed in the arm members 20. Biasing means, not shown, are provided in these slots to bias the cleaning roller 26 toward the press roller 13, thereby pressing the periphery of the cleaning roller 26 against the periphery of the press roller 13 constantly with a predetermined pressure. Cleaning roller drive means, not shown, are provided on one of the arm members 20 for driving the cleaning roller 26 to rotate in the same direction as the press roller 13, but at a peripheral speed of approximately one-tenth of the peripheral speed of the press roller 13, when the press roller 13 is rotated.

Note that the cleaning roller 26 is not an essential constitutional element, and the press roller 13 may be cleaned by hand using an ink absorbent cloth, for example.

The guide plate 27 is positioned above and to the left of the cleaning roller 26. The guide plate 27 is constituted by a plate member, fixed to the arm members 20 at its opposite ends, and serves to guide the sheet P pressed against the print drum 12 by the press roller 13 such that the sheet P moves toward the refeed tray 8 without contacting the cleaning roller 26. The guide plate 27 adjoins the press roller 13 and the periphery of the cleaning roller 26.

Rotatable cam followers 41 are mounted respectively on the other end of each arm member 20 to the end on which the press roller 13 is supported so as to face outward from each other. A print pressure spring 42 is attached to the device main body 11 at one end, and to each arm member 20 in the vicinity of the cam follower 41 at the other end.

As a result, a rotary bias is applied to the arm members 20 in the counterclockwise direction of the drawing about the shaft 21.

A multiple-step cam 43 comprising three cam plates 43A, 43B, and 43C is positioned at the left-hand side of each cam follower 41. Each cam plate 43A, 43B, 43C is mounted on a cam shaft 44, which is supported by its two ends on the device main body 11 to be free to rotate and move in a perpendicular direction to the sheet surface direction of FIG. 2. The cam plates 43A through 43C are positioned in succession from the front side of the device, and spaced from each other at predetermined intervals.

Figure 4:
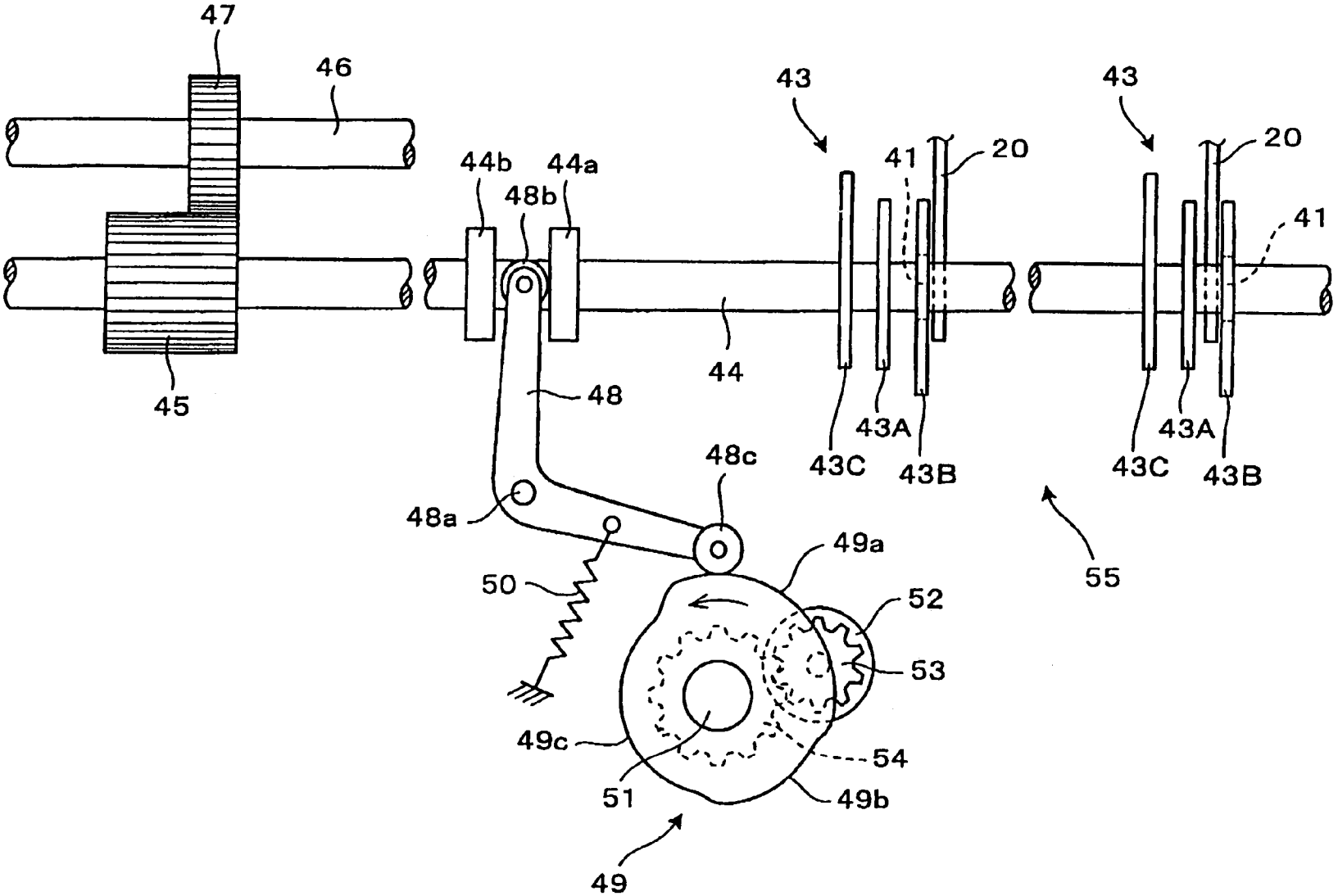
FIG. 4 is a side view illustrating the press roller moving mechanism of the duplex stencil printing device of FIG. 1.

The cam plates 43A, 43B, 43C each have a base portion constituted by a disk, which is concentric with the cam shaft 44, and a projection which protrudes equally from each of the cam plates 43A, 43B, 43C. As shown in FIG. 4, the multiple-step cam 43 is driven to rotate in the clockwise direction of FIG. 2 when the rotary force from the print drum drive means 121 is transmitted thereto via a drive gear 45 mounted on the cam shaft 44 and a transmission gear 47 mounted on a shaft 46 which is supported rotatably on the device main body 11.

When the projection of any one of the cam plates 43A, 43B, 43C is brought into contact with the cam follower 41, the periphery of the press roller 13 is released from the periphery of the print drum 12 to occupy the release position shown in FIG. 2. When the projection is released from the cam follower 41, the periphery of the press roller 13 is pressed against the periphery of the print drum 12 by the bias of the print pressure spring 42 to occupy the contact position shown in FIG. 3. The cam plates 43A, 43B, 43C each are configured such that the base portion thereof does not contact the cam follower 41 when the press roller 13 occupies the contact position. The projection of the cam plate 43A is formed to cause the press roller 13 to contact the print drum 12 in a contact range including all of a front side area, an intermediate area, and a reverse side area shown in FIG. 1. The projection of the cam plate 43B is formed to cause the press roller 13 to contact the print drum 12 over the front side area. Further, the projection of the cam plate 43C is formed to cause the press roller 13 to contact the print drum 12 in a contact range including the downstream side portion of the front side area, the intermediate area, and the reverse side area. The pitch of the cam plates 43A, 43B, 43C is set to be sufficiently greater than the thickness of each arm member 20.

In FIG. 2, press roller locking means, not shown, are positioned at the right-hand side of the arm members 20 for preventing the arm members 20 from rocking when the press roller 13 occupies the release position. More specifically, the press roller locking means, not shown, comprise a solenoid, not shown, for selectively holding and releasing the arm members 20 when switched on and off, respectively. The solenoid, not shown, is energized and activated when the cam follower 41 is held in contact with the projection of any one of the cam plates 43A, 43B, 43C.

As shown in FIG. 4, a moving arm 48 and a stepped cam 49 are positioned below the cam shaft 44. The moving arm 48 takes a substantial L-shape, and is mounted on a shaft 48*a*, which is rotatably supported on the device main body 11, at its bent portion. A roller 48*b* and a cam follower 48*c* are rotatably mounted on one end and the other end of the moving arm 48, respectively. A tension spring 50 is attached at one end to the device main body 11 and at the other end to a part of the moving arm 48 between the other end of the moving arm 48 and the bent portion, thereby applying a rotary bias to the moving arm 48 in the clockwise direction of the drawing, about the shaft 48*a*.

The roller 48*b* is positioned between disks 44*a* and 44*b* fixed to an intermediate portion of the cam shaft 44 with a gap therebetween. The periphery of the cam follower 48*c* is pressed against the periphery of the stepped cam 49 by the bias of the tension spring 50. The gap between the disks 44*a* and 44*b* is set to be slightly greater than the diameter of the roller 48*b*.

The stepped cam 49 comprises cam portions 49*a*, 49*b* and 49*c* in three locations on its periphery, and is fixed to a shaft 51 supported rotatably on the device main body 11. A gear 54 is mounted on the shaft 51 and held in mesh with a gear 53 mounted on the output shaft of a stepping motor 52 attached to the device main body 11. The stepping motor 52 drives the stepped cam 49 to rotate in a direction indicated by an arrow in FIG. 4. With this constitution, when the stepping motor 52 is activated to rotate the stepped cam 49, the moving arm 48 rocks about the shaft 48*a* and causes the roller 48*b* to push the disk 44*a* or 44*b*, thereby causing the cam shaft 44 to move in the right-left direction in FIG. 4.

The cam portions 49*a*, 49*b*, 49*c* are so configured as to move the cam shaft 44 in the following manner. When the cam portion 49*a* contacts the cam follower 48*c*, the cam plate 43B is moved to a position where it can contact the cam follower 41. When the cam portion 49*b* contacts the cam follower 48*c*, the cam plate 43A is moved to the position where it can contact the cam follower 41. Further, when the cam portion 49*c* contacts the cam follower 48*c*, the cam plate 43C is moved to the position where it can contact the cam follower 41.

The cam follower 41, print pressure spring 42, multiple-step cam 43, press roller locking means, not shown, moving arm 48, and stepped cam 49 constitute the press roller moving mechanism 55. The press roller moving mechanism 55 serves as print pressure range variation means which are capable of selectively switching between at least three print pressure range patterns comprising: a first print pressure range pattern in which print pressure is applied only to the front side area, which is a first image area corresponding to the front side image 201 on the duplex printing master 65 on the print drum 12; a second print pressure range pattern in which print pressure is applied only to the reverse side area, which is a second image area corresponding to the reverse side image 202 on the duplex printing master 65 on the print drum 12; and a third print pressure range pattern in which print pressure is applied from the front side area to the reverse side area. The press roller moving mechanism 55 causes the press roller 13 to occupy the release position shown in FIG. 2 and the contact position shown in FIG. 3 selectively.

The switching member 10 for switching the conveyance path of the sheet P is positioned on the sheet conveyance path at the left-hand side of the contact position between the print drum 12 and press roller 13. The path selector 10 is constituted by a plate having substantially the same width as the print drum 12 and press roller 13, and is fixed to a shaft at its downstream end in the sheet conveyance direction. This shaft is supported rotatably on the device main body 11. By activating a solenoid 123 (see FIG. 8), the upstream end of the switching member 10 in the sheet conveyance direction, which has a wedge-shaped cross section, is positioned selectively in a first position indicated by a solid line in FIG. 1 and a second position indicated by a dot/dot/dash line in FIG. 1.

In the first position, the tip end of the switching member 10 adjoins the periphery of the press roller 13 and does not interfere with the clamper 19 mounted on the print drum 12. In the second position, the tip end of the switching member 10 adjoins the periphery of the print drum 12. When held in the first position, the switching member 10 guides the sheet P coming out of the nip between the print drum 12 and the press roller 13 toward the sheet discharging portion 6. When held in the second position, the switching member 10 guides the sheet P toward the refeed tray 8 between the guide plate 27 and a guide plate 56 fixed to the device main body 11.

The plate making portion 3 is disposed in the upper right portion of the device main body 11, and comprises a master support member 57, a platen roller 58, a thermal head 59, cutting means 60, a master stocking portion 61, a tension roller pair 62, and turn roller pair 63, and so on. The plate making portion 3 functions as perforating means for perforating a master 64 to create a front side image 201 and reverse side image 202 such as those shown in FIG. 8, or a whole face image 205 such as that shown in FIG. 11. When the duplex printing master 65 is wrapped around the outer peripheral surface of the print drum 12, the front side image 201 is formed in a position corresponding to the front side area shown in FIG. 1, and the reverse side image 202 is formed in a position corresponding to the reverse side area.

The master support member 57 is provided on each of opposite side plates, not shown in the drawing, of the device main body 11. The master 64 is constituted by a thermoplastic resin film and a porous support adhered to each other, and implemented as a master roll 64*a* rolled onto a core 64*b*. The core 64*b* is rotatably and detachably supported by the stencil support members 57 at its opposite ends.

The platen roller 58, provided at the left-hand side of the master support members 57, is supported rotatably on the side plates, not shown, of the housing 11, and driven to rotate by perforation drive means 124 (see FIG. 5) including a stepping motor. The thermal head 59, positioned beneath the platen roller 58, has a large number of heat-generating elements, and is mounted on the side plates, not shown, of the device main body 11. Biasing means, not shown, press the heating element surface of the thermal head 59 against the platen roller 58. The thermal head 59 causes its heat-generating elements to selectively generate heat in contact with the thermoplastic resin film of the master 64, thereby heat-perforating and cutting the master 64 in selective positions.

The cutting means 60, positioned at the left-hand side of the platen roller 58 and thermal head 59, comprises a stationary edge 60*a* fixed to a frame, not shown, of the device main body 11, and a movable edge 60*b* movably supported by the stationary edge 60*a*. The movable edge 60*b* rotates relative to the stationary edge 60*a* to thereby cut the master 64. This is a well-known constitution.

The master stocking portion 61, positioned downstream of the cutting means 60 in the direction of master conveyance, forms a space for temporarily accommodating a perforated master. The interior of the master stocking portion 61 is partitioned by a plurality of plate members, and a suction fan, not shown, is disposed in the rearmost position thereof. The suction fan generates negative pressure in the master stocking portion 61, which is a closed space, so that the conveyed perforated master is stored in the rearmost portion of the master stocking portion 61.

The tension roller pair 62, positioned between the cutting means 60 and the master stocking portion 61, comprises a drive roller 62*a* and a driven roller 62*b* supported rotatably on the side walls of the device main body 11. Biasing means, not shown, press the periphery of the driven roller 62*b* against the periphery of the drive roller 62*a*, and the perforation drive means 124 rotate the drive roller 62*a* so that the master 64 is conveyed while being nipped therebetween.

The drive roller 62*a* is set to rotate at a slightly higher peripheral speed than that of the platen roller 58, and has a torque limiter in its interior such that a predetermined tension is applied to the master 64 between the platen roller 58 and the tension roller pair 62.

The turn roller pair 63, disposed downstream of the master stocking portion 61 in the direction of master conveyance, is constituted by a drive roller 63*a* and a driven roller 63*b* which are rotatably supported on the side plates, not shown, of the device main body 11. The turn roller pair 63 conveys the master 64 by nipping the master 64 between the drive roller 63*a*, which is driven to rotate by the perforation drive means 124, and the driven roller 63*b*, which is pressed against the drive roller 63*a* by biasing means, not shown in the drawing. A one-way clutch, not shown, is provided in the interior of the drive roller 63*a*.

A movable master guide plate, not shown in the drawing, is disposed between the tension roller pair 62 and the turn roller pair 63. The movable master guide plate is supported rockably by a support member not shown in the drawing. A solenoid, not shown, selectively positions the movable master guide plate to a conveyance position where the upper surface of the plate forms a conveyance path, or an inoperative position where the plate does not obstruct entry of the master 64 into the master stocking portion 61.

The sheet feeding portion 4 is disposed below the plate making portion 3, and comprises a feed tray 67, a sheet feed roller 68, a separator roller 69, a separator pad 70, a registration roller pair 71, and so on. The feed tray 67, which may be loaded with a large number of sheets P, is supported by the device main body 11 so as to be capable of vertical movement. Sheet feed drive means 125 (see FIG. 5) comprising elevating means cause the feed tray 67 to move up and down. The feed tray 67 is sized to allow sheets P of size A3 to be stacked thereon in a portrait position. A pair of side fences 72 are provided on the upper surface of the feed tray 67 and supported movably along rail members, not shown, in the width direction of the sheets P perpendicular to the direction of sheet conveyance.

A plurality of sheet size detection sensors 73 is provided on the free-end side of the feed tray 67 for detecting the size of the sheets P stacked on the feed tray 67. The sheet size sensors 73, functioning as sheet size detection means, have a well-known constitution for detecting the size and orientation (portrait or landscape) of the sheets P through a combination of sensors.

The sheet feed roller 68, disposed above the feed tray 67, comprises a member having high frictional resistance on its surface. The sheet feed roller 68 is supported rotatably on a bracket, not shown, which is supported rockably on the device main body 11. When the elevating means, not shown, raise the feed tray 67, the top sheet P on the feed tray 67 is pressed against the sheet feed roller 68 with a predetermined pressure. The sheet feed roller 68 is driven to rotate by the sheet feed drive means 125.

The separator roller 69 and separator pad 70, located to the left of the sheet feed roller 68, comprise a member having high frictional resistance on their respective surfaces. The separator roller 69 is operatively connected to the sheet feed roller 68 via a timing belt 69*a*, and driven to rotate in synchronization with and in the same direction as the sheet feed roller 68. Biasing means, not shown, bias the separator pad 70 against the separator roller 69. The sheet feed roller 68 and separator roller 69 constitute feeding means for feeding the sheet P toward the registration roller pair 71.

The registration roller pair 71, disposed at the left-hand side of the separator roller 69 and separator pad 70, comprises a drive roller 71*a* and a driven roller 71*b*. The drive roller 71*a* is rotated by a registration roller drive motor, not shown, provided within the sheet feed drive means 125, at a predetermined timing synchronous with the print drum 12, and cooperates with the driven roller 71*b* pressed thereagainst to convey the sheet P toward the printing portion 2 at a predetermined timing.

A registration sensor 137 serving as sheet length detection means for detecting the length of the sheet P in the conveyance direction is disposed on the sheet feed path between the registration roller pair 71, the print drum 12, and the press roller 13, or in other words the sheet feed path further upstream of the sheet conveyance direction than the print drum 12 and press roller 13. The registration sensor 137 is constituted by a reflection type optical sensor, and functions to detect the length of the sheet Pin the conveyance direction by detecting the front end position and rear end position of the sheet P that is fed out from the registration roller pair 71. The registration sensor 137 is also capable of detecting conveyance jams of the sheets P, mis-registration of the sheets P, and so on. The registration sensor 137 is in active use in the third example of the second embodiment, to be described below, and so on.

A sheet thickness sensor 138 serving as sheet thickness detection means for detecting the thickness of the sheet P is disposed on the sheet feed path between the registration roller pair 71, the print drum 12, and the press roller 13. The sheet thickness sensor 138 is used in the fourth example of the second embodiment, to be described below, and so on, and may be omitted from this embodiment.

The plate discharging portion 5 is disposed to the upper left of the printing portion 2. The plate discharging portion 5 comprises an upper plate discharging member 74, a lower plate discharging member 75, a waste plate box 76, a compressor plate 77, and so on.

The upper plate discharging member 74 comprises a drive roller 78, a driven roller 79, an endless belt 80, and so on. Plate discharge drive means 126 (see FIG. 5) rotate the drive roller 78 in the clockwise direction of the drawing to thereby move the endless belt 80 in the direction indicated by an arrow in FIG. 1.

The lower plate discharging member 75 comprises a drive roller 81, a driven roller 82, an endless belt 83, and so on. The drive power of the plate discharge drive means 126, which drive the drive roller 78 to rotate, is transferred to the drive roller 81 via drive transmitting means, not shown, such as a gear or belt, so that the drive roller 81 rotates in the counterclockwise direction of the drawing. Thus the endless belt 83 moves in the direction indicated by an arrow in FIG. 1.

Moving means, not shown, are provided in the plate discharge drive means 126 to move the lower plate discharging member 75 selectively to the position shown in the drawing or a position in which the part of the endless belt 83 on the outer peripheral surface of the driven roller 82 contacts the outer peripheral surface of the print drum 12.

The waste plate box 76 is a container for storing used plates, and is mounted detachably onto the device main body 11. The compressor plate 77 is supported on the device main body 11 to be capable of vertical movement, and moved vertically by elevating means, not shown, provided in the plate discharge drive means 126. The compressor 77 compresses a used plate conveyed by the upper and lower plate discharging members 74 and 75 into the waste plate box 76.

The sheet discharging portion 6 is disposed below the plate discharging portion 5, and comprises a peeling claw 84, a discharge conveyance unit 85, a discharge tray 86, and so on.

A plurality of the peeling claws 84 are provided in the width direction of the drum 12, and mounted integrally on a shaft that is supported rockably on the device main body 11. The plurality of peeling claws 84 is rocked by claw rocking means, not shown, such that the respective tip ends thereof occupy the position shown in the drawing, contacting the periphery of the print drum 12, or a position where they are retracted from the outer periphery of the print drum 12 to avoid obstructions such as the clamper 19. The drive power of the print drum drive means 121 is transferred to the claw rocking means, not shown, via drive power transmitting means, not shown, so that the peeling claws 84 are rocked in synchronization with the rotation of the print drum 12.

The discharge conveyance unit 85 is positioned below the peeling claws 84 to the left of the switching member 10, and comprises a drive roller 87, a driven roller 88, an endless belt 89, a suction fan 90, and so on. The roller-shaped drive roller 87 is mounted on a shaft, not shown, in a plurality of segments having a predetermined pitch, and the shaft is supported rotatably on unit side plates, not shown. Sheet discharge drive means 127 (see FIG. 5) drive the drive rollers 87 to rotate integrally with each other.

The driven roller 88 is also mounted on a shaft, not shown in a plurality of segments having a predetermined pitch, and the shaft is supported rotatably on the same side plates. The endless belt 89 is implemented as segment belts each being passed over one of the segment drive rollers 87 and the corresponding segment driven rollers 88. Each segment belt 89 is formed with a plurality of holes. The suction fan 90 is disposed below the drive roller 87, driven roller 88 and endless belt 89. The sheet P is conveyed in the direction indicated by an arrow in FIG. 1 in accordance with the rotation of the drive roller 87 while being aspirated onto the endless belt 89 by the suction force of the suction fan 90.

The discharge tray 86, which serves as a discharge table on whose upper face sheets P conveyed by the discharge conveyance unit 85 are discharged and stacked, comprises a single end fence 91 movable in the direction of sheet conveyance, and a pair of side fences 92 movable in the width direction of the sheets P.

The image reading portion 7 is disposed on the top of the printing device main body 11*, and includes the contact glass 93 on which originals are placed, a platen 94 provided to be openable away from the contact glass 93, reflection mirrors 95, 96, 97, 98 and a fluorescent lamp 99 for reading the original image through scanning, a lens 100 for focusing the scanned original image, an image sensor 101 such as a CCD for performing photoelectric conversion processing on the focused image, a plurality of document size detection sensors 102 for detecting the size of the original, and so on. The original image reading operation is performed by an operation of reading drive means 128 (see FIG. 5).

Figure 7:
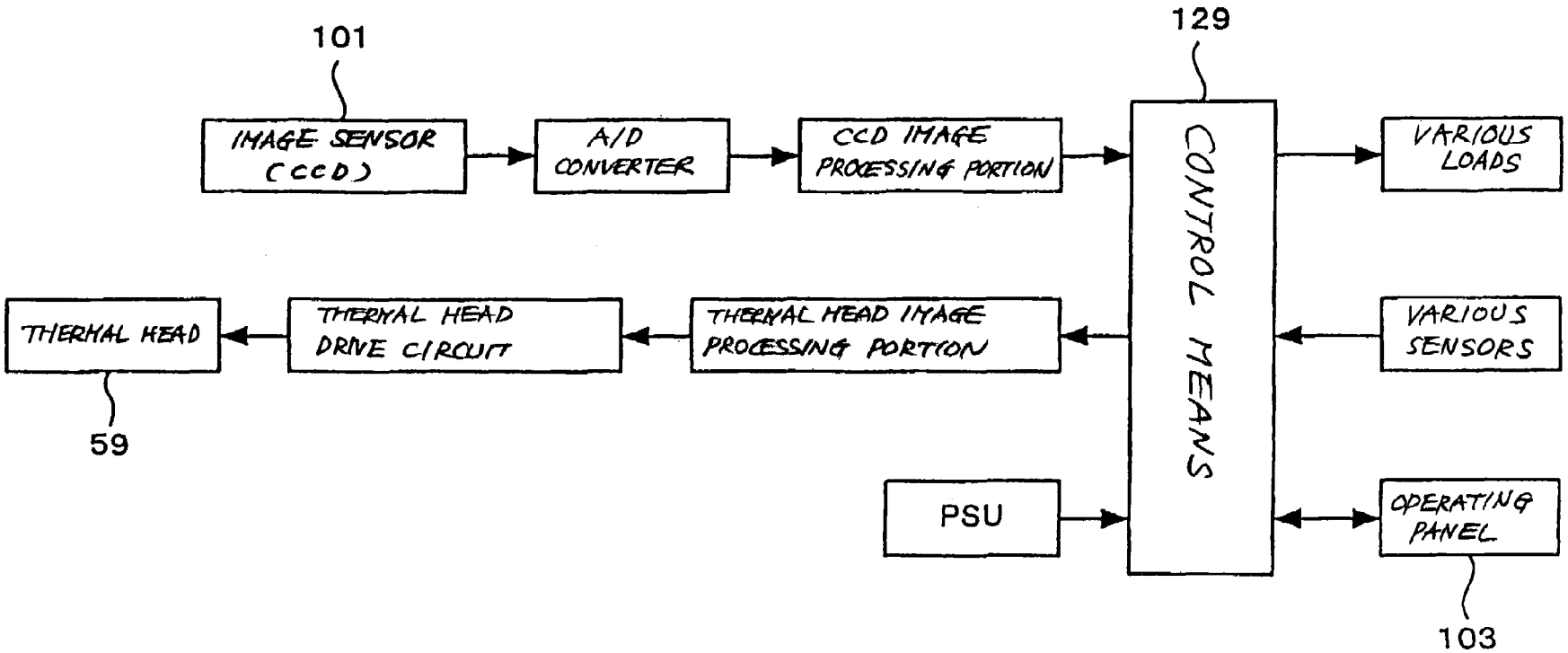
FIG. 7 is a block diagram seen from another perspective of the first example of the first embodiment.
Figure 24:
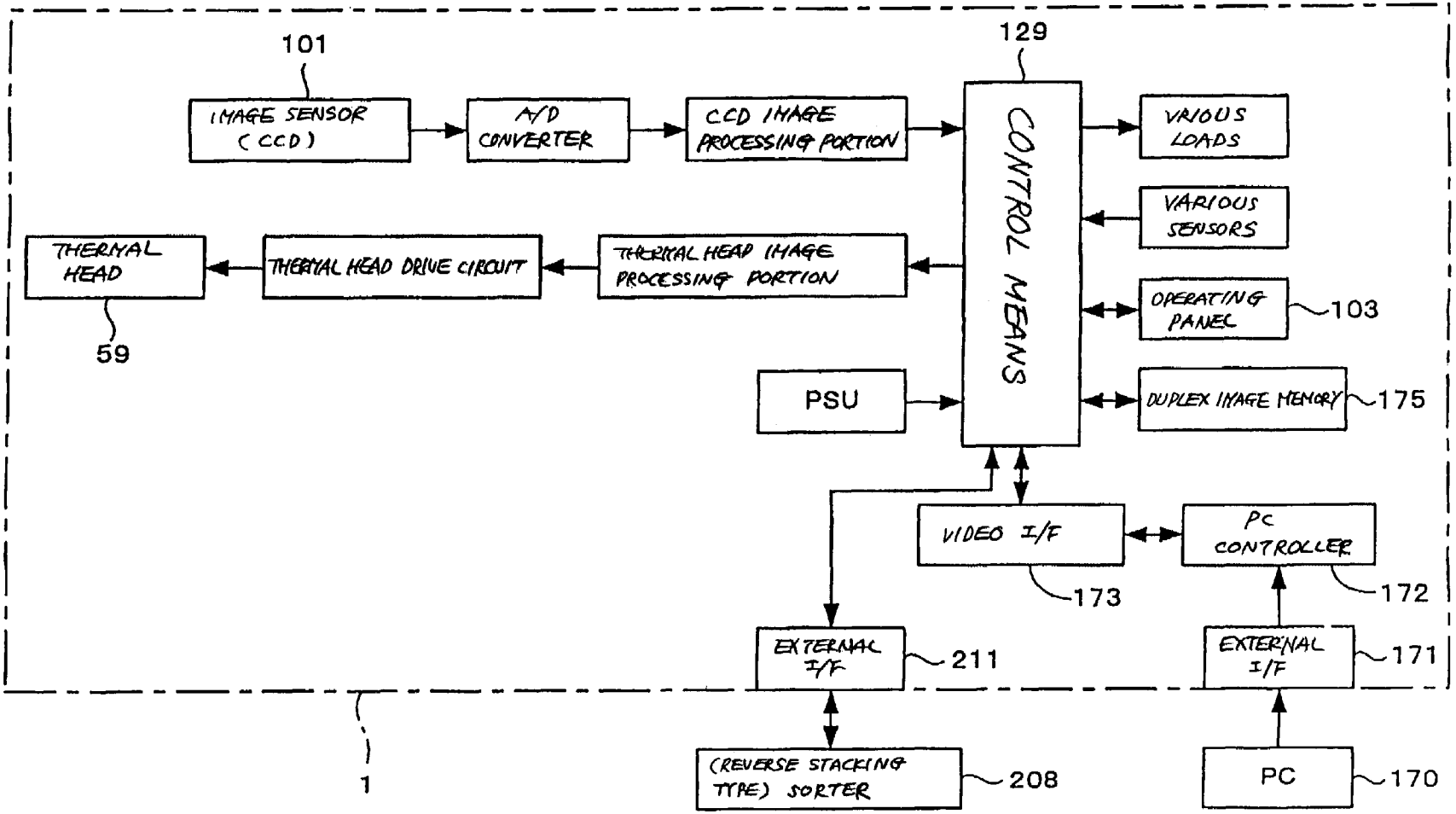
FIG. 24 is a block diagram showing a control constitution of a fourth example of the first embodiment.

As shown in FIGS. 7, 20, 24, and so on, to be described below, analog image data (image information) subjected to photoelectric conversion processing by the image sensor 101 are converted into digital image data (image information) by an A/D converter, subjected to further, well-known image processing by a CCD image processing portion, and then transmitted to and inputted into the control means 129. The digital image data are then subjected to thermal head drive processing (mirror image conversion) in a thermal head image processing portion, under the control of the control means 129, and transmitted to the thermal head 59 via a thermal head drive circuit. The original size sensor 102, functioning as original size detection means, has a well-known constitution for detecting the size and orientation (portrait or landscape) of the original by means of a combination of sensors.

As shown in FIG. 1, a phase timing detection plate 133 is mounted on the circumference of the flanges, not shown, provided on the print drum 12. A home position sensor 134 is mounted on the device main body 11 in the vicinity of the print drum 12. When the print drum 12 is rotated to a position where the clamper 19 faces the press roller 13, the home position sensor 134 detects the phase timing detection plate 133, and outputs a signal to the control means 129 shown in FIG. 5 and so on.

FIG. 6 shows a detailed constitution of the operation panel 103 for operating the duplex stencil printing device 1. The operating panel 103 functions to give various operating instructions to the various portions of the duplex stencil printing device 1, obtain information from the various portions, and so on.

In FIG. 1, the operation panel 103 is provided on the upper front surface of the device main body 11. The operating panel 103 comprises the perforation start key 104, a print start key 105, a trial print key 106, a continuous key 107, a clear/stop key 108, a number keypad 109, an enter key 110, a program key 111, a mode clear key 112, print speed keys 113, direction keys 114, a sheet size setting key 115, a sheet thickness setting key 116, a duplex print mode key 117, a simplex print mode key 118, a display portion 119, the liquid crystal display 120, and so on.

When the perforation start key 104 is depressed to cause the duplex stencil printing device 1 to perform a perforation operation, the printer 1 performs a plate discharging operation and an original reading operation followed by, or in partial parallel with, a perforation operation. A plate mounting operation, also referred to as plate mounting and printing, is then performed, whereby the duplex stencil printing device 1 enters a state of print standby. The perforation start key 104 functions as perforation activating means for generating a start signal which serves as an activation signal for activating a plate mounting and duplex printing operation.

The print start key 105 is depressed to cause the duplex stencil printing device 1 to perform a printing operation. When the print start key 105 is pressed after the duplex stencil printing device 1 has entered a print standby state and the various printing conditions have been set, a printing operation is performed. The trial print key 106 is depressed to cause the duplex stencil printing device 1 to perform a trial print, and when the trial print key 106 is pressed after the various conditions have been set, a single sheet is printed.

The number keypad 109 is used to input numerical values and so on. The enter key 110 is used to set numerical values and so on at the time of setting, while the program key 111 is used to register or recall operations of frequent use. The mode clear key 112 functions as mode cancellation means, and is pressed to cancel (clear) various modes executed by the duplex stencil printing device 1 in order to return to the initial set mode. Plate making and printing differ from normal simplex and duplex printing operations merely in that a prescribed number of printed sheets is not counted and the printing speed is extremely slow.

In the second embodiment, to be described below, the numeral keypad 109, enter key 110, and program key 111 contribute to the unique function of the present invention as initial set mode switching means.

The sheet size setting key 115 is pressed to input a desired sheet size. A sheet size inputted on the sheet size setting key 115 takes priority over the sheet size information detected by the sheet size detection sensors 73. The sheet thickness setting key 116 is depressed to input the thickness of the sheets P prior to duplex printing, and is constituted such that any one of three types, "normal", "thin", and "thick", may be selected.

The duplex print mode key 117 is pressed before the perforation start key 104 to cause the duplex stencil printing device 1 to perform a duplex printing operation. When the duplex print mode key 117 is pressed, the duplex print mode display lamp 117*a* adjacent to the duplex print mode key 117 is illuminated to notify the user that the duplex print mode has been set. When the duplex print mode key 117 is depressed, input through the perforation start key 104 is denied until the user inputs the thickness of the sheets P to be used on the sheet thickness setting key 116. The simplex print mode key 118 is also pressed before the perforation start key 104 to cause the duplex stencil printing device 1 to perform a simplex printing operation, similarly to the duplex print mode key 117. When the simplex print mode key 118 is pressed, the simplex print mode display lamp 118*a* adjacent to the simplex print mode key 118 is illuminated to notify the user that the simplex print mode has been set. Int his embodiment, the simplex print mode display lamp 118*a* is illuminated on the duplex stencil printing device 1 in an initial set mode, and hence the simplex print mode is set automatically as the initial set mode.

When the duplex print mode key 117, the sheet thickness setting key 116, and the perforation start key 104 are pressed in succession, they function as plate mounting and duplex printing activating means for generating an activation signal to begin a series of operations from plate discharging to plate mounting and duplex printing. When the duplex print mode key 117, the sheet thickness setting key 116, the perforation start key 104, and the trial print key 106 are pressed in succession, they function as trial duplex printing activating means for generating an activation signal to begin a trial duplex printing operation.

The display portion 119, constituted by a seven segment LED, mainly displays numerals such as the printed sheet number. The liquid crystal display 120 constituted by an LCD has a hierarchical display structure. By pressing any one of selection setting keys 120*a*, 120*b*, 120*c*, 120*d* positioned below the LCD 120, the operator is capable of selecting and setting the sheet size (in this embodiment, A3 or A4), the sheet type (in this embodiment, three types comprising "normal", "thin", and "thick"), and various modes including a magnification mode and an image position adjustment mode. Note that the direction keys 114 may also be used for selecting and setting the sheet size, and final confirmation of the sheet size may be obtained by pressing the direction keys 114.

The liquid crystal display 120 displays the status of the duplex stencil printing device 1, for example a message not shown in the drawing indicating "Ready to perforate and print", as well as warnings (alarms) indicative of a jam during perforation or plate discharging or a jam during feeding or discharging of the sheet P (to be referred to hereafter as "conveyance jam"), and supply commands for a supply of sheets, masters, ink, or similar. Thus the liquid crystal display 120 functions as information display means and information notifying means for displaying and notifying various information about the duplex stencil printing device 1.

From the second embodiment onward, to be described below, the liquid crystal display 120 also contributes to a function as screen display means for displaying a warning (message) on a liquid crystal screen indicating the duplex print mode or simplex print mode, which are set selectively by the aforementioned initial set mode switching means.

The continuous key 107, clear/stop key 108, print speed setting key 113, and direction keys 114 are identical to those shown in FIG. 7 of the aforementioned Japanese Unexamined Patent Application Publication 2003-200645, and have the same functions as those described in the specification thereof.

FIG. 5 is a block diagram showing the control configuration of the duplex stencil printing device 1. As shown, the control means 129 are constituted by a well-known microcomputer comprising a CPU 130, ROM 131, RAM 132, a timer, not shown, and input/output ports, not shown. The control means 129 are provided in the interior of the device main body 11.

The CPU 130 controls the operations of the entire duplex stencil printing device 1. More specifically, the CPU 130 controls operations and so on of the drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, and the solenoid 123 for activating the switching member 10, on the basis of various signals from the operation panel 103, detection signals from the various sensors provided in the device main body 11, and an operating program read out from the ROM 131.

The operating program for the entire duplex stencil printing device 1 is stored in the ROM 131 and read out by the CPU 130 as needed. The RAM 132 functions to store the calculation results of the CPU 130 temporarily, to store data signals and ON/OFF signals, set and inputted from the various keys and sensors on the operating panel 103, as needed, and so on. The control means 129 additionally determine the rotary phase position of the print drum 12 on the basis of a home position signal output from the home position sensor 134 and a signal output from an encoder, not shown, provided in the print drum drive means 121. The control means 129 shown in FIG. 5 and the control means 129 shown in FIG. 7 are identical, and the two drawings are block diagrams thereof from different perspectives. In FIG. 7, "PSU" denotes a power supply unit. For ease of description, the CPU 130 will sometimes be referred to as the control means 129 below.

First through fifth examples of this embodiment will now be described. First, the problems to be solved by the first example of this embodiment will be disclosed.

As described above, when duplex printing is performed using a normal master perforation method with the constitution described above, the duplex-printed sheet P1 is stacked on the discharge tray 86 with the reverse side printed image 202*a* facing upward, as shown in FIGS. 10A and 10B. In other words, similarly to the duplex printing device disclosed in Japanese Unexamined Patent Application Publication 2003-200645 and Japanese Unexamined Patent Application Publication 2003-237207, the duplex printing master is created by first perforating the front side image, then perforating the reverse side image is perforated with a margin in between. When the perforated duplex printing master is used to perform duplex printing, the duplex-printed sheet is discharged onto the discharge tray with the reverse side printed image facing upward.

When a plurality of original pages are to be subjected to duplex printing and sorted into page order by hand, each set of printed sheets (stack of sheets printed from one perforated master) is removed from the discharge tray and sorted in order from the printed sheet set with the largest page number. However, the reverse side printed image (even page number) of each printed sheet faces upward, and hence to sort the sheets, each sheet must be turned over in turn, and to do this efficiently, sorting must be performed after turning all of the printed sheets over so that the pages do not fall out of order. It is extremely troublesome to turn all of the printed sheets over after printing.

If a horizontal stacking type sorter, not shown in the drawing, is connected to the duplex stencil printing device 1 so that sorting can be performed automatically, and the final page of the plurality of original pages that is subjected to duplex printing has an odd number, this page may be subjected to simplex printing in order to simplify the operation and reduce the total printing time. In this case, however, the final page is discharged and stacked on a sorter storage bin, not shown, of the sorter facing upward, and hence the pages fall out of order such that a blank page appears between the final page and the previous page thereto.

If a reverse stacking type sorter, not shown in the drawing, is connected to the duplex stencil printing device 1 so that sorting can be performed automatically, the sheets that are stacked onto the discharge tray with the reverse side printed image facing upward are turned over by the sorter, and hence the sheets are stacked in the plurality of sorter storage bins, provided in the vertical direction of the device, with the front side printed image facing upward. The duplex-printed sheets printed from the following original are stacked similarly, and hence the printed sheet sets sorted in the sorter storage bins have a misaligned page order of page 2, page 1, page 4, page 3, and so on. Hence, even if the sheets are turned over after being removed from the sorter storage bins, the pages remain out of order, and the correct page order cannot be obtained.

It is therefore a principle object of the first example to provide a duplex printing device in which manual sorting or automatic sorting using sorting means can be performed correctly and efficiently.

When duplex printing is performed on a plurality of original pages and sorting (page ordering) is performed by hand, as described above, each printed sheet set is removed from the discharge tray 86, and sorting is performed from the printed sheet set with the largest page number. However, the reverse side printed images (even page numbers) 202*a* of each printed sheet set face upward, and hence sorting can only be performed after turning all of the printed sheets over. When there is a large number of pages, this is extremely troublesome.

Figure 13A:
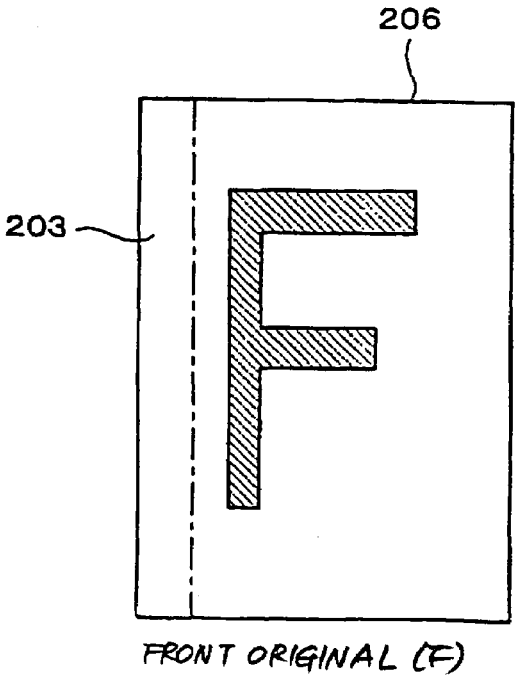
FIGS. 13A and 13B are plan views showing a first image original and a second image original.
Figure 13B:
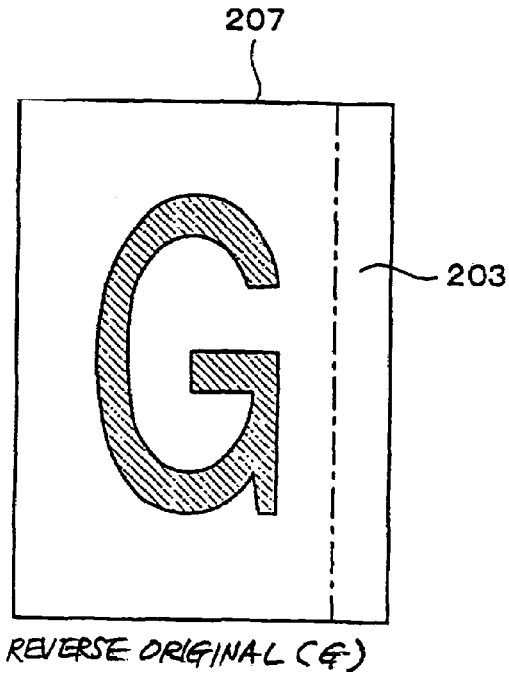

To solve this problem, in the first example first the reverse side image (second image) is perforated, and after inserting the predetermined gap 204, the front side image (first image) is perforated. In the above examples, the term "front" image was used for the front side image 201, and the term "reverse" image was used for the reverse side image 202, but as shown in FIGS. 13A and 13B, in this example the front side image will be described as the "F" image, and the reverse side image will be described as the "G" image.

Figure 14:
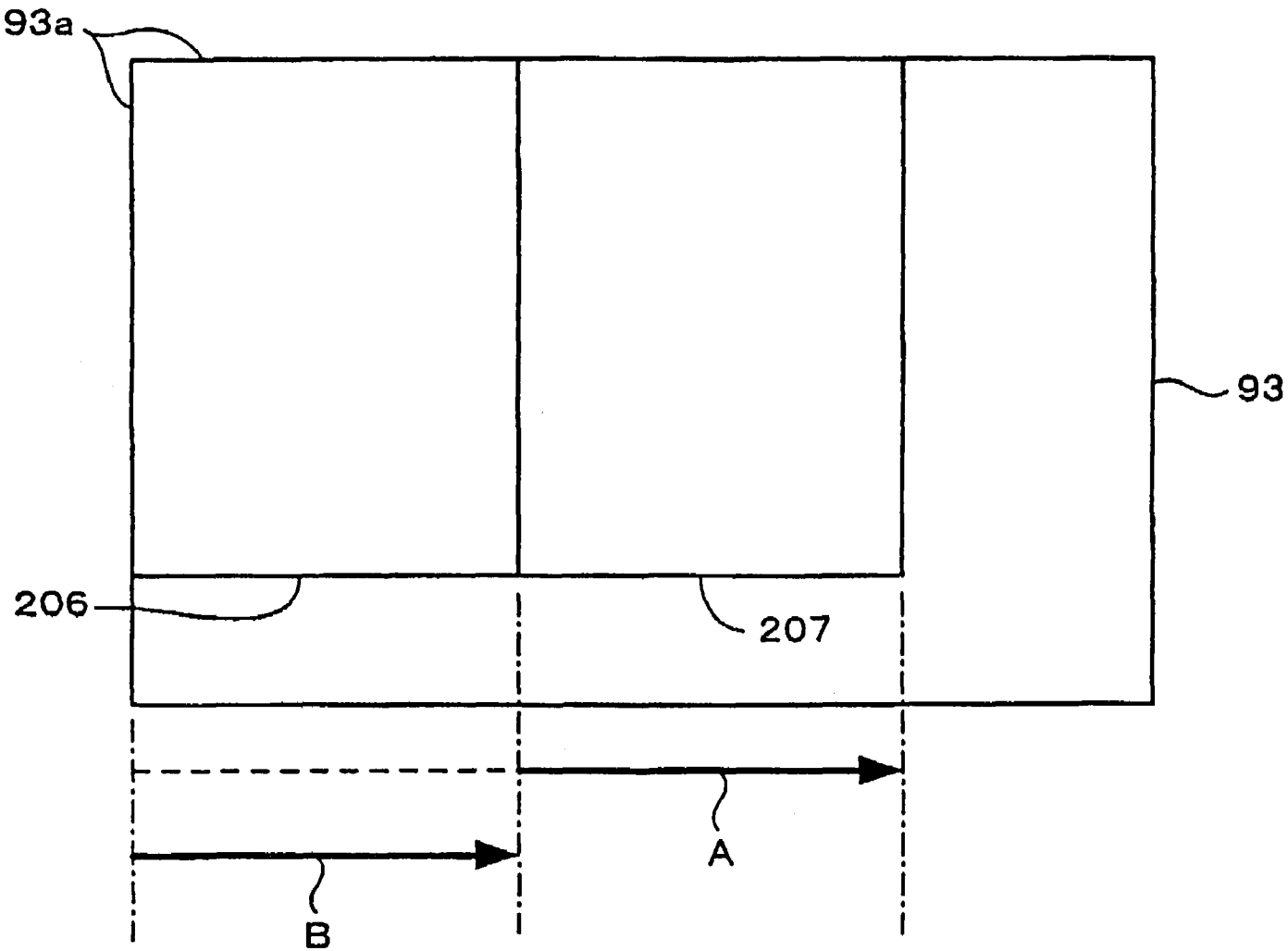
FIG. 14 is a plan view showing a state in which the first image original and second image original are set and read on a contact glass.

As shown in FIG. 14, a first image original 206 serving as a front side original and a second image original 207 serving as a reverse side original are set side by side in contact with each other on the contact glass 93. The reference symbol 93*a* denotes a setting reference position.

The control means 129 control the image reading portion 7 to first read the second image original 207 (arrow A), and then return the carriage to the home position to read the first image original 206 (arrow B). If the second image original 207 and first image original 206 are set in succession on the contact glass 93, a normal reading operation (in which the carriage performs continuous reading by moving from left to right) is performed.

Figure 15:
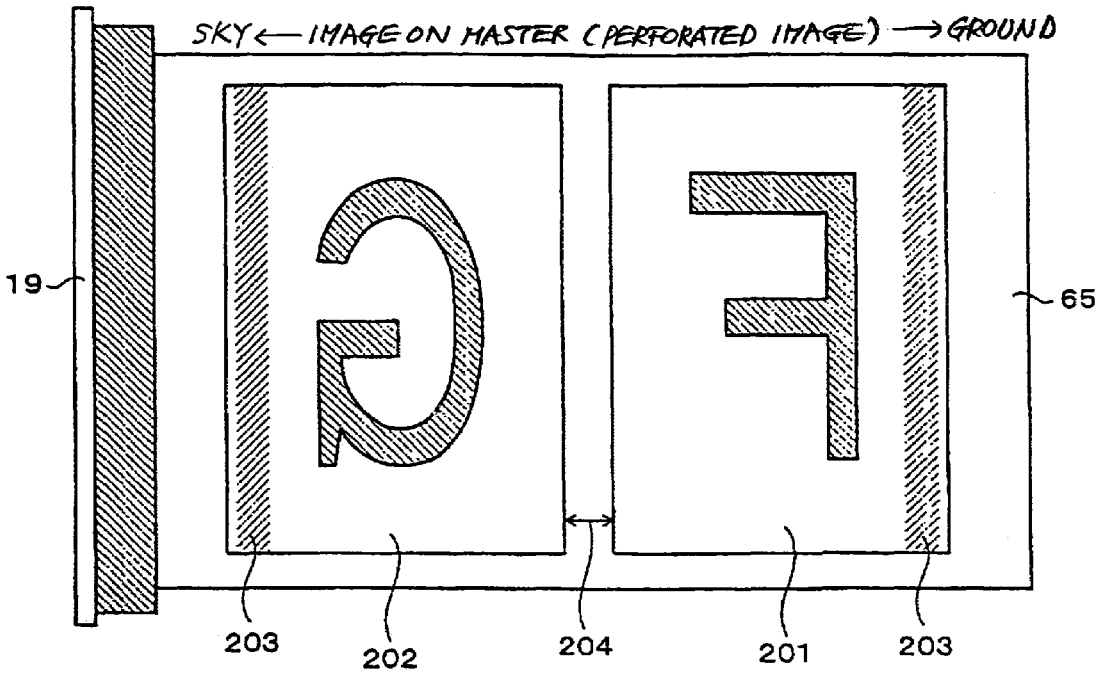
FIG. 15 is a plan view of a master perforated with a second image and a first image in succession.
Figure 16:
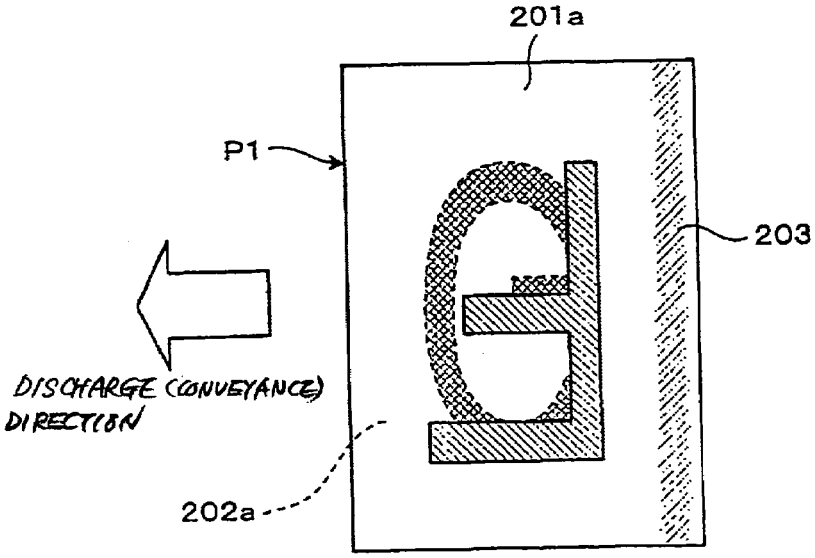
FIG. 16 is a plan view showing a state in which a duplex-printed sheet is discharged.
Figure 17A:
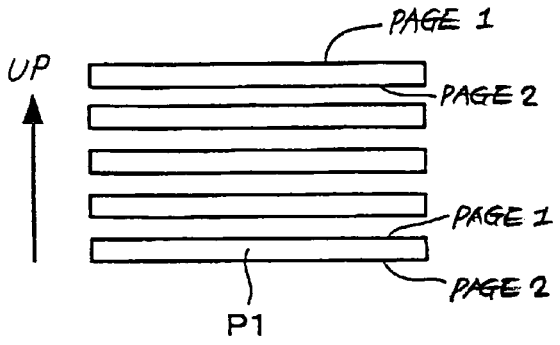
FIGS. 17A and 17B are pattern diagrams showing a state in which the duplex-printed sheet is discharged and stacked.
Figure 17B:
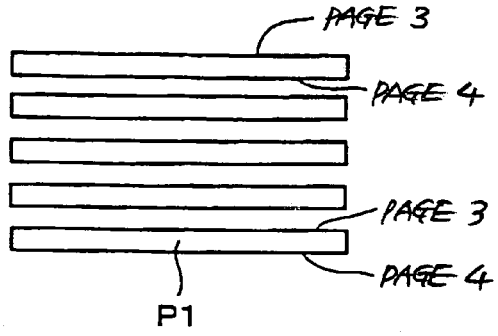

The master 64 is perforated parallel to the reading operation, and as shown in FIG. 15, the reverse side image 202 and front side image 201 are perforated in succession. The duplex printing master 65 perforated in this manner is wrapped around the outer peripheral surface of the print drum 12 so that duplex printing can be performed. As a result, as shown in FIG. 16, the duplex-printed sheet P1 is stacked onto the discharge tray 86 with the front side printed image (odd page number) 201*a* facing upward. Thus the even page numbers of each printed sheet set face upward as shown in FIGS. 17A and 17B, and hence sorting can be performed by hand without having to turn the printed sheets over. Note that in FIGS. 17A and 17B, the thickness of the sheets P1 has been increased for ease of understanding.

The same sorting state can be obtained by performing normal perforation (reading and perforating the first image original 206 and second image original 207 in succession), passing the first image through control of the cam plates, and printing the second image first.

Figure 19A:
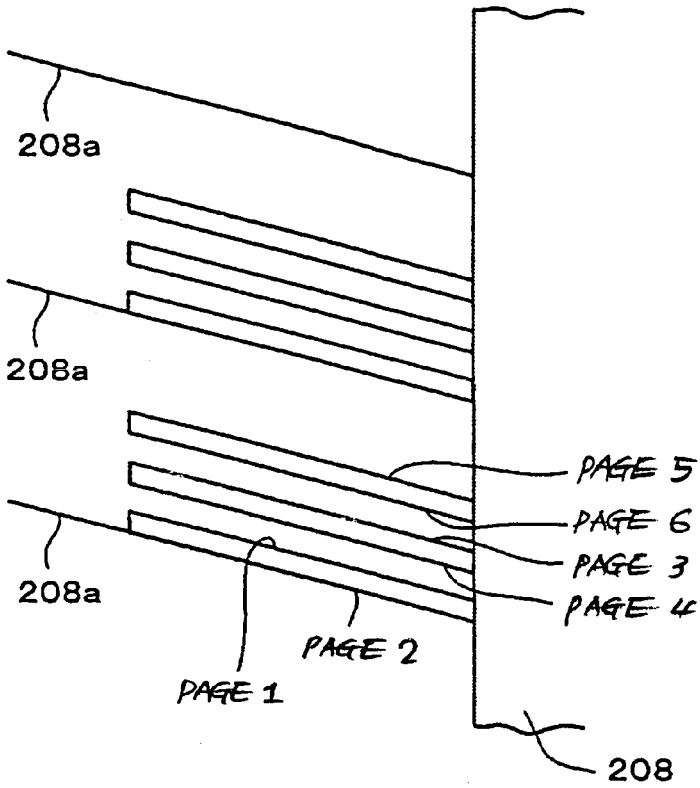
FIGS. 19A and 19B are pattern diagrams showing a state in which the duplex-printed sheet is stacked into sorter storage bins of the reverse stacking type sorter, FIG. 19A showing a case in which a normal perforation method is employed, and FIG. 19B showing a case in which the second image is perforated first.
Figure 19B:
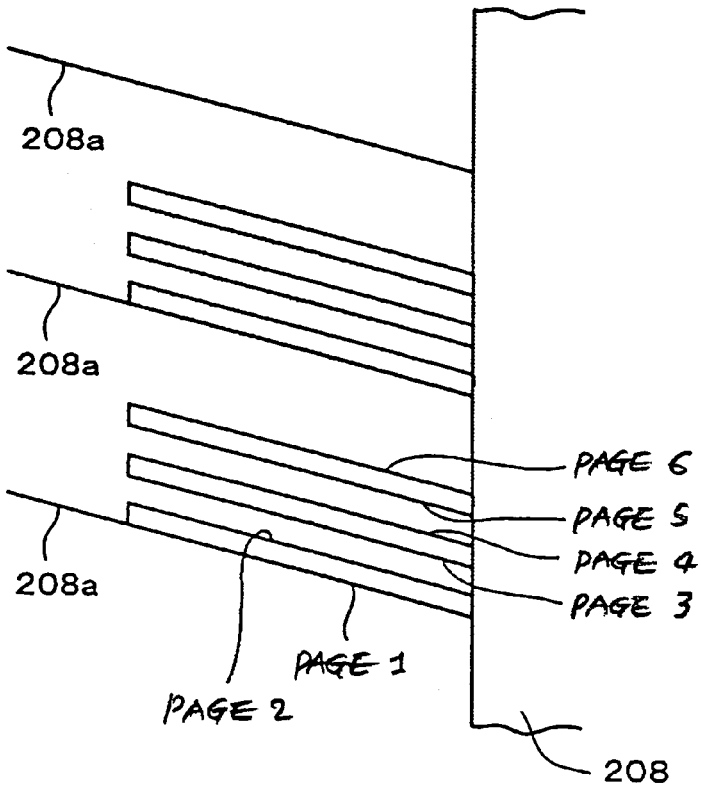

As shown in FIGS. 19A and 19B, when a reverse stacking type sorter 208 serving as post-processing and sorting means is connected to the device main body 11, and duplex printing is performed on the basis of a plurality of original pages using a normal perforation method, the reverse side printed image 202*a*, which faced upward on the discharge tray 86, is turned over as shown in FIG. 19A so that the sheets P1 are stacked in the sorter storage bins 208*a* with the even page numbers facing down. As a result, the page numbers become misaligned and cannot be sorted into page order.

Figure 18:
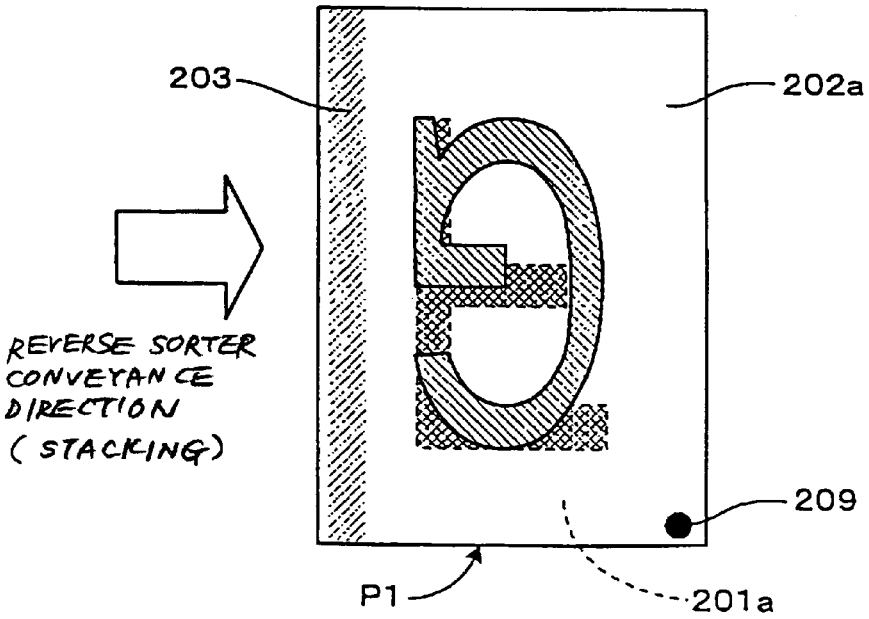
FIG. 18 is a plan view showing a state in which the duplex-printed sheet is stacked after being reversed by a reverse stacking type sorter.

When duplex printing is performed after plate mounting in the manner described above, the sheets are discharged onto the sorter storage bins 208*a* with the reverse side printed image 202*a* facing upward after being turned over, as shown in FIG. 18. Hence, as shown in FIG. 19B, the printed sheets stacked on the sorter storage bins 208*a* are aligned in page number order from the bottom, and by removing the sheets from the sorter storage bins 208*a* and turning the printed sheet sets over, the pages are aligned in order from the top. In FIG. 18, the reference numeral 209 denotes a sorter staple position.

When the reverse stacking type sorter 208 is connected, the sorting state shown in FIG. 19B can be obtained by performing normal perforation, passing the first image through control of the cam plates, and printing the second image first.

Next, referring to FIGS. 20, 21A, 21B, 22A, and 22B, a second example of this embodiment will be described.

As shown in FIG. 20, in this example, an image memory 174 is provided for storing image information relating to all of the originals. Image information is extracted from the image memory 174 two pages at a time, from the image information relating to the final original page, and perforation and printing are performed starting with the second image, which has the largest page number.

In FIG. 20, "various loads" is a collective term for control subject drive means comprising the respective drive means of the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, and the solenoid 123 for activating the switching member 10. "Various sensors" is a collective term for the various sensors described above provided in the duplex stencil printing device 1. The reference numeral 210 denotes a horizontal stacking type sorter 210 (also referred to hereafter simply as "sorter 210") connected mechanically via an intermediate conveyance device, which sorts the sheets P1 to be stacked on the discharge tray 86 without turning them over. The sorter 210 is connected communicably to the control means 129 via an external I/F (interface) 211. The bin unit elevator sorting device (2) and intermediate conveyance device (52) illustrated in FIGS. 1, 2, and so on of Japanese Unexamined Patent Application Publication H7-309520, for example, may be cited as specific examples of the sorter 210 and intermediate conveyance device.

Figure 21A:
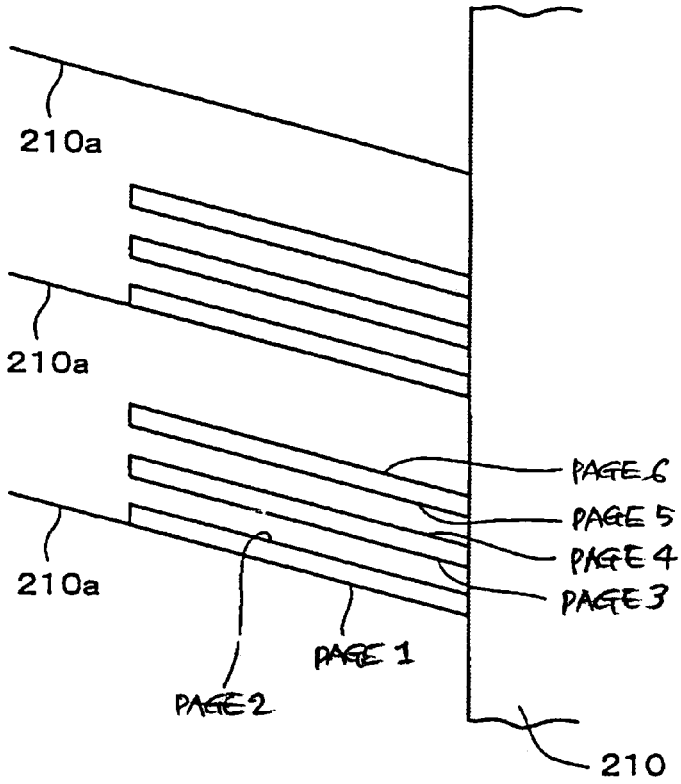
FIGS. 21A and 21B are pattern diagrams showing the state in which a duplex-printed sheet is stacked into sorter storage bins of a horizontal stacking type sorter in the second example of the first embodiment, FIG. 19A showing a case in which a normal perforation method is employed, and FIG. 19B showing a case in which the second image is perforated first.

When the sorter 210 is connected to the device main body 11 and perforation and duplex printing are performed according to a normal perforation method, the sheets are stacked on sorter storage bins 210*a* as is, with the reverse side printed image 202*a* facing upward, as shown in FIG. 21A. Hence the page numbers increase from bottom to top. As a result, the user must turn the printed sheet sets in the sorter storage bins 210*a* over once printing is complete.

The image memory 174 is able to temporarily store image data read by the image reading portion 7 relating to an original image set on the contact glass 93 via the ADF, not shown, or by a manual operation, and the addresses of the image memory 174 during temporary storage are determined in order of the read data. During reading in the duplex print mode, image data read from each of the originals to be used for duplex printing are stored temporarily in the image memory 174. For example, when the size of the sheet P is A4 portrait, and a plurality of A4 portrait originals is set on the ADF, the image data for each A4 portrait original are stored temporarily in the image memory 174.

Figure 22B:
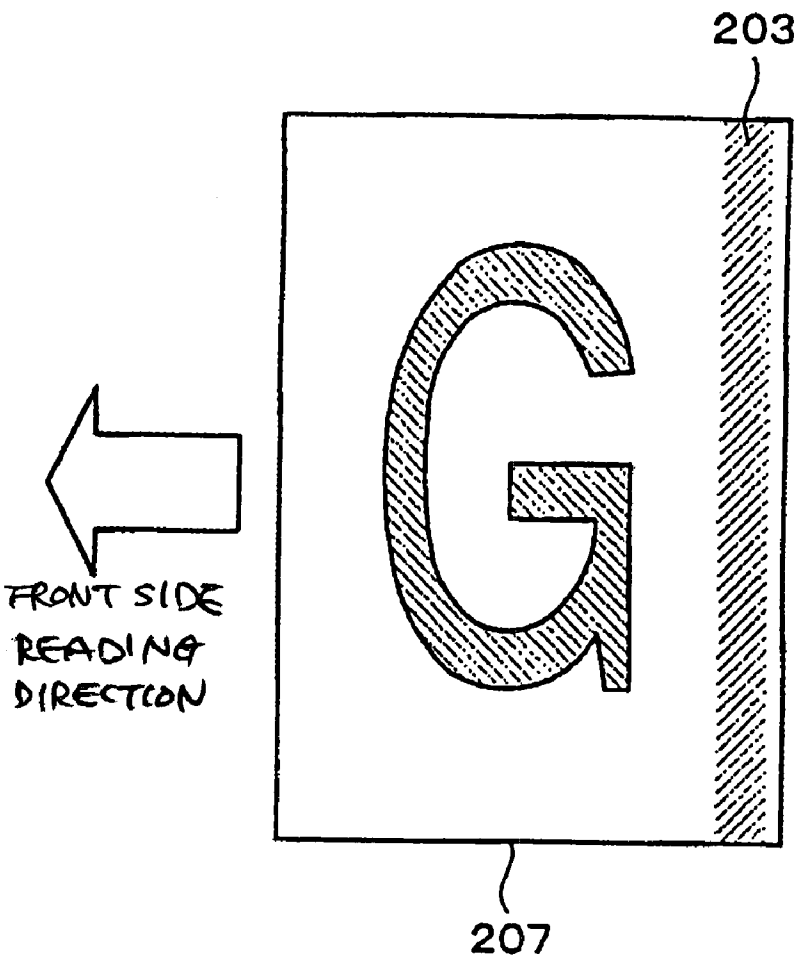
FIGS. 22A and 22B are plan views showing a state in which an original is set and read by an ADF.
Figure 22A:
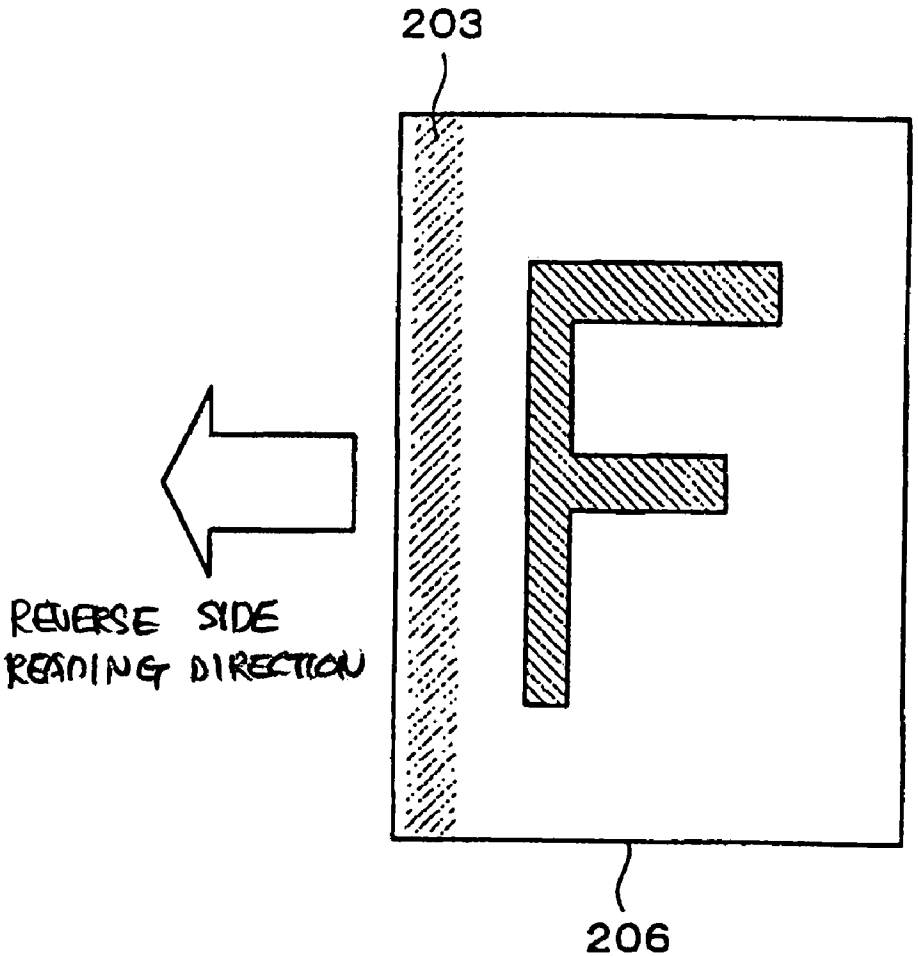

When the size of the sheet P is A4 portrait, and a plurality of A3 landscape originals (duplex single-sheet original) is set on the ADF, reading is performed for each A4 portrait original, and the corresponding image data are stored temporarily in the image memory 174. FIGS. 22A and 22B show a state in which the first image original 206 and second image original 207 are set on the ADF and read.

In this example, first all of the originals are read and stored temporarily in the image memory 174, whereupon the originals are read from the memory images stored in the image memory 174 and perforated two pages at a time from the final page with the largest page number so that the bottom page of the sheets P1 stacked on the sorter storage bins 210*a* of the horizontal stacking type sorter 210 is the final page. Perforation is performed as shown in FIG. 15, with the final page (second image, even page number) first, followed by the last page but one (first image, odd page number), and so on.

Figure 21B:
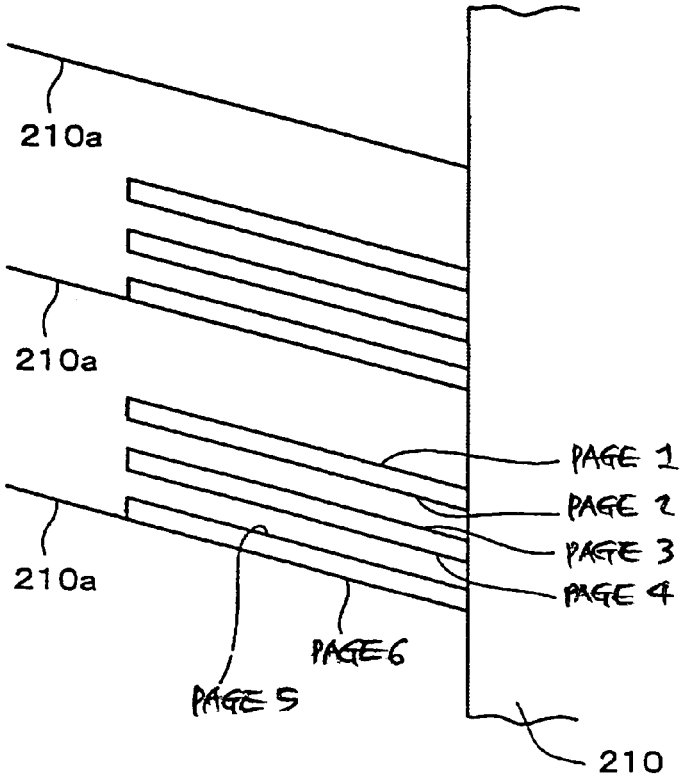

Duplex printing is then performed using the duplex printing master 65 perforated in the manner described above, and when sorting is performed in the horizontal stacking sorter 210, the printed sheet sets stacked in the sorter storage bins 210*a* are sorted such that the top sheet is the first page and the bottom sheet is the past page, as shown in FIG. 21B. As a result, the user does not have to turn the printed sheet sets over after printing. Even when sorting is performed manually, the tiresome turning over operation of the first example does not have to be performed.

By reading two pages at a time from among the memory images stored in the image memory 174, starting with the final page which has the largest page number, performing perforation from the first image which has the smallest page number, and controlling the cam plates such that printing is performed from the second image which has the largest page number, the printed sheets are stacked in a similar manner to that shown in FIG. 21B.

Obtaining image information relating to all of the originals for storage in the image memory 174 is not limited to reading the originals set on the ADF or image reading portion 7. As shown in FIG. 20, image data may be obtained from a PC (personal computer, to be referred to as "PC" or "personal computer" hereafter) 170 which is communicably connected to the device main body 11 online. The PC 170 serves as output means provided on the exterior of the device main body 11 of the duplex stencil printing device 1.

When perforation is performed through output of image data from the online PC 170, the image data are transmitted to the CPU 130 of the control means 129 in succession from the first page via an external I/F (interface) 171, a PC controller (personal computer controller) 172, and a video interface 173 (to be referred to as "video I/F 173" hereafter). The video I/F 173 is connected such that image data from the PC controller 172 can be used by the control means 129. Alternatively, an external connection device (host computer or the like) which is connected communicably by means of wireless communication through light (IrDA or the like) or radio waves (Bluetooth, a wireless LAN, or the like) may be used as the output means provided on the exterior of the device main body 11.

A third example of this embodiment will now be described with reference to FIG. 23.

When the number of originals is odd and the method of reading and perforating two pages at a time from the memory images stored in the image memory 174, starting with the final page having the largest page number, is employed, the final image read from the memory is a single page, and hence the front and reverse sides of the originals do not align.

In this example, the control means 129 determine the page numbers of all of the read originals, and if the final page has an odd page number, one page of dummy data is written after the image information of the final page such that the dummy data are set as the second image.

Figure 23:
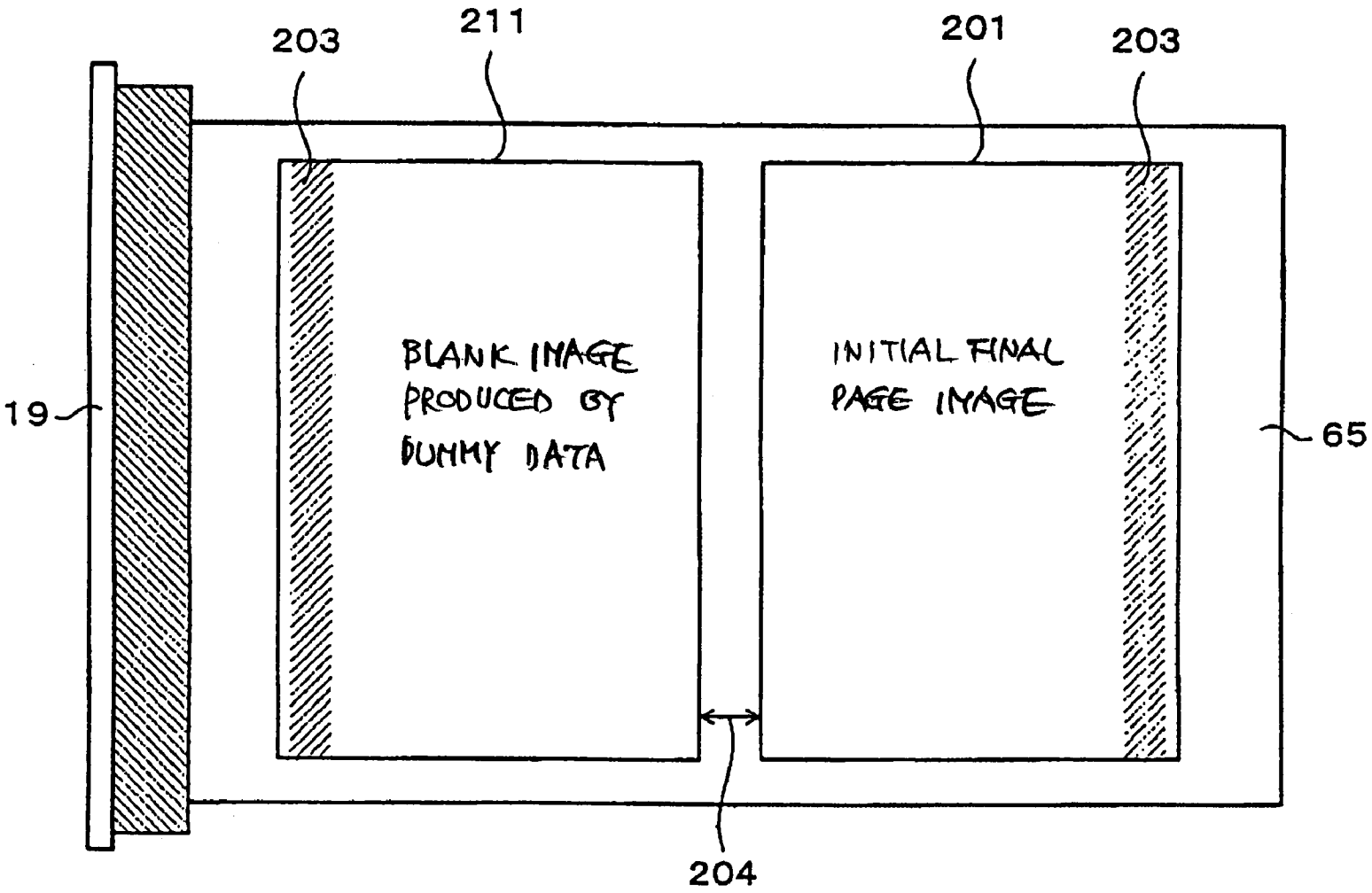
FIG. 23 is a plan view of a master in a third example of the first embodiment, which is perforated by setting a dummy original when the number of originals is an odd number.

As shown in FIG. 23, first a blank second image (reverse side image) 211 produced from the dummy data is perforated (in actuality, not perforated) on the master 64, and then the front side image 201 (first image) is perforated as the initial final page image.

Duplex printing is then performed using the duplex printing master 65 perforated in this manner such that when sorting is performed by the horizontal stacking sorter 210, the top page of the printed sheets stacked in the sorter storage bins 210*a* is the first page, and the bottom page is a blank page. Even when sorting is performed manually, the tiresome turning over operation of the first example is not necessary.

A fourth example of this embodiment will now be described with reference to FIG. 24.

This example features a two side image memory 175 having a memory size for storing the image information of the originals read in page order two pages at a time. The image information is extracted from the two side image memory 175, and perforation is performed from the second image having the largest page number. Moreover, printing is performed from the second image.

The reverse stacking sorter 208 functions to sort the sheets P1 to be stacked on the discharge tray 86 after reversing the sheets P1. The reverse stacking sorter 208 (also referred to simply as "sorter 208" hereafter) is connected communicably to the control means 129 via an external I/F 211. The devices illustrated in FIG. 1 of Japanese Unexamined Patent Application Publication 2001-146361 and FIG. 1 and so on of Japanese Unexamined Patent Application Publication H11-314834, for example, may be cited as specific examples of the sorter 208.

When the reverse stacking sorter 208 serving as post-processing and sorting means is connected to the device main body 11 and a plurality of original pages is subjected to duplex printing using a normal perforation method, the reverse side printed image 202*a*, which would have been stacked facing upward on the discharge tray 86, is turned over, and hence the sheets P1 are stacked in the sorter storage bins 208*a* with the even page numbers facing downward. As a result, the page order is misaligned, and the sheets P1 cannot be sorted into page order.

In this example, original data read by the image reading portion relating to an original image set on the contact glass 93 via the ADF, not shown, or by a manual operation are stored temporarily in the two side image memory 175, and the addresses during temporary storage are determined in order of the read data. During original reading in the duplex print mode, front side image data and reverse side image data are stored temporarily in the two side image memory 175.

For example, when the size of the sheet P is A4 portrait, and a plurality of A4 portrait sized originals is set on the ADF, the image data for each A4 portrait original are stored temporarily in the two side image memory 175. When the size of the sheet P is A4 portrait, and a plurality of A3 landscape originals (duplex single-sheet original) is set on the ADF, reading is performed for each A4 portrait original, and the corresponding image data are stored temporarily in the two side image memory 175.

When the size of the sheet P is A4 portrait, and two originals are set in series on the contact glass 93 of the image reading portion 7, the image data are stored temporarily for each A4 portrait original in the two side image memory 175.

When perforating a duplex original, first the reverse side image data are extracted from the two side image memory 175 during temporary storage and perforated, and after inserting the predetermined gap 204, the reverse side image data are extracted and perforated. Following perforation, the control means 129 delete the images stored in the two side image memory 175 in preparation for the next reading operation.

When duplex printing is performed using the duplex printing master 65 perforated in this manner, the duplex-printed sheet P1 is stacked on the discharge tray 86 with the front side printed image (odd page number) facing upward, and hence when sorting is performed by the reverse stacking sorter 208, page order misalignment is eliminated.

With this method, the memory size of the two side image memory 175 need only be sufficient for storing two originals for duplex printing, regardless of the number of originals. in this example, the maximum sheet size during duplex printing is A4 portrait, and hence the memory size need only be sufficient to store two A4 sized sheets of image data.

A similar sorting function can be obtained by extracting the first image with the smallest page number and the second image with the largest page number in succession from the two side image memory 175 and perforated them, and then controlling the cam plates such that the second image with the largest page number is printed first.

When the final page of the originals has an odd page number, the control means 129 write a page of dummy data following the image information of the final page, as shown in FIG. 23, such that the dummy data serve as the second image.

An ADF is used to perform original reading conveyance automatically, but ADFs employ a "page order reading method" and a "reverse page reading method" with different ways of conveying originals. Moreover, sorters have a "horizontal stacking type", a "reverse stacking type", and soon, as described above.

For example, when a "page order reading type" ADF and a "reverse stacking type" sorter are used, the first original is read and perforating is performed on the basis of the reverse side image data, and after inserting the predetermined gap, the second original is read and perforating is performed on the basis of the front side image data, whereby the bottom page of the sheets stacked on the sorter storage bins of the sorter is the front side printed image of the first original.

When duplex printing is performed using such a duplex printing master, the front side image is discharged facing upward. The discharged sheets are reversed by the sorter so that the bottom page of the sheets stacked on the sorter storage bins is the front side printed image of the first page. When an image is perforated and printed subsequently, printed sheets sorted and stacked in the sorter storage bins in page order can be obtained.

As another example, when a "reverse page reading type" ADF and a "horizontal stacking type" sorter are used, the final original is read and perforating is performed on the basis of the reverse side image data, and after inserting the predetermined gap, the next original is read and perforating is performed on the basis of the front side image data, whereby the top page of the sheets stacked on the sorter storage bins of the sorter is the front side printed image of the first original.

When duplex printing is performed using such a duplex printing master, the front side image is discharged facing upward. When the discharged sheets are conveyed to the sorter, the bottom page of the sheets stacked on the sorter storage bins is the reverse side printed image of the final page. When an image is perforated and printed subsequently, printed sheets sorted and stacked in the sorter storage bins in page order can be obtained.

Hence by storing the optimum relationship between the original reading method (ADF type etc.), the sorting method following duplex printing (sorter type etc.), the perforating order of the first image and second image, and the printing order of the first image and second image in the ROM 131 in advance, the ADF type being detected automatically or set on the operating panel 103, and the sorter type being detected automatically or set on the operating panel 103, the control means 129 may select the optimum perforating order and printing order based thereon (fifth example of this embodiment).

Second Embodiment

As described above in the summary of the invention and the first through fifth examples of the first embodiment, the simplex print mode display lamp 118*a* is illuminated in the initial set mode of the duplex stencil printing device 1, thereby notifying the user that the simplex print mode has been set. However, when a user who often performs duplex printing is in a hurry to perform duplex printing, for example, s/he may press the print start key 105 after setting the perforation and printing conditions without noticing that the simplex print mode display lamp 118*a* is illuminated, as a result of which wasteful simplex printing is performed in accordance with the simplex print mode setting. Alternatively, s/he may press the perforation start key 104 after setting the perforation conditions in order to perform duplex printing perforation, as a result of which erroneous simplex printing perforation is performed in accordance with the simplex print mode setting. This causes the wastage of a single master, which is currently an expensive item.

The principle feature of a first example of the second embodiment to be described below is a constitution for allowing a user to select and switch between the duplex print mode and simplex print mode as a preset initial set mode (default) when the power of the duplex stencil printing device 1 is switched on by a power switch, not shown, serving as power supplying means for supplying and cutting power to and from the duplex stencil printing device 1, or when mode clearing is performed by pressing the mode clear key 112 for canceling various modes executed by the duplex stencil printing device 1. As a result, wastage of the expensive master 64 due to a perforating error can be avoided, and conveyance jams of the sheets P can be prevented.

Figure 25:
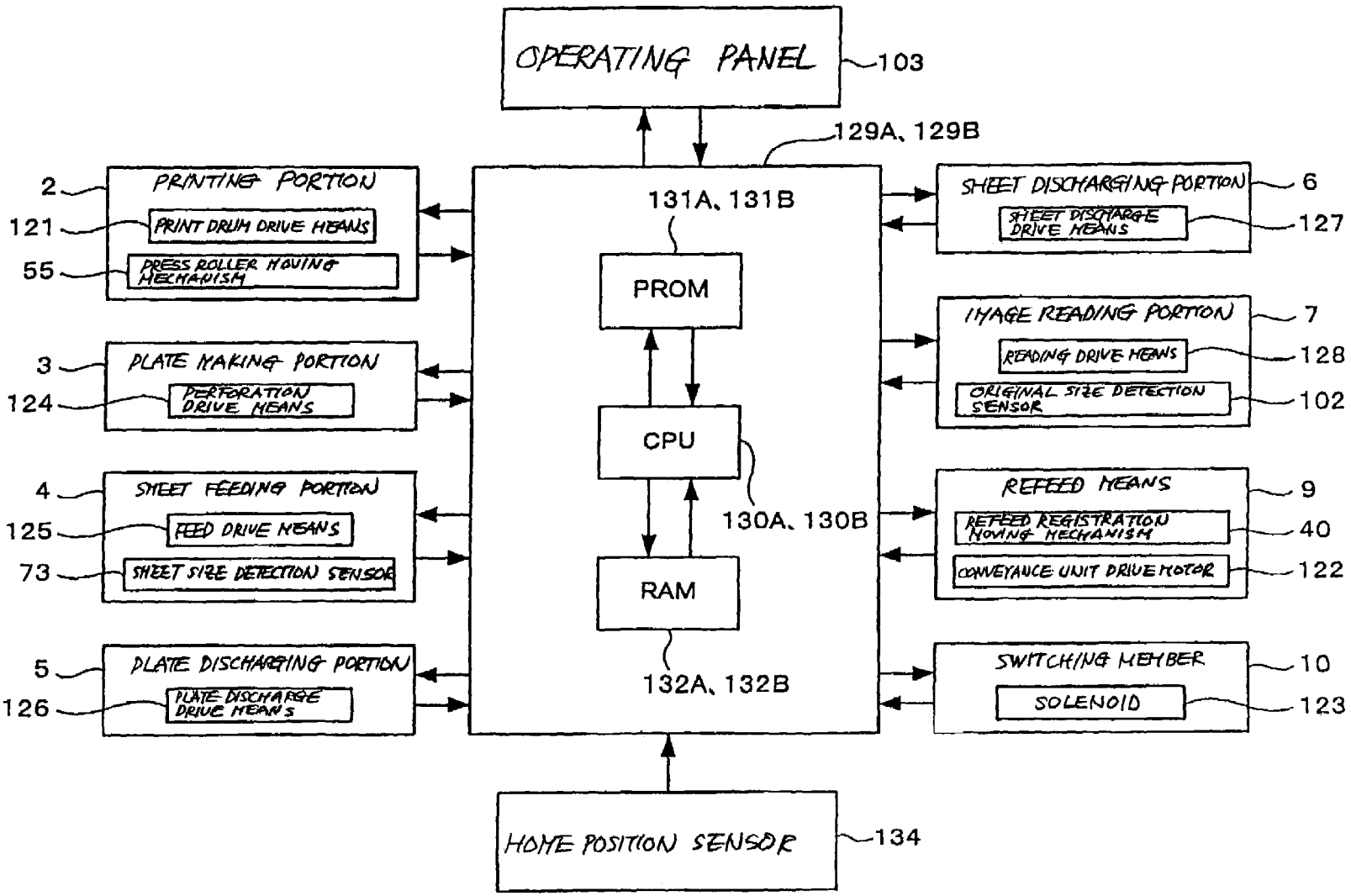
FIG. 25 is a block diagram showing a control constitution of first and second examples of a second embodiment.
Figure 26:
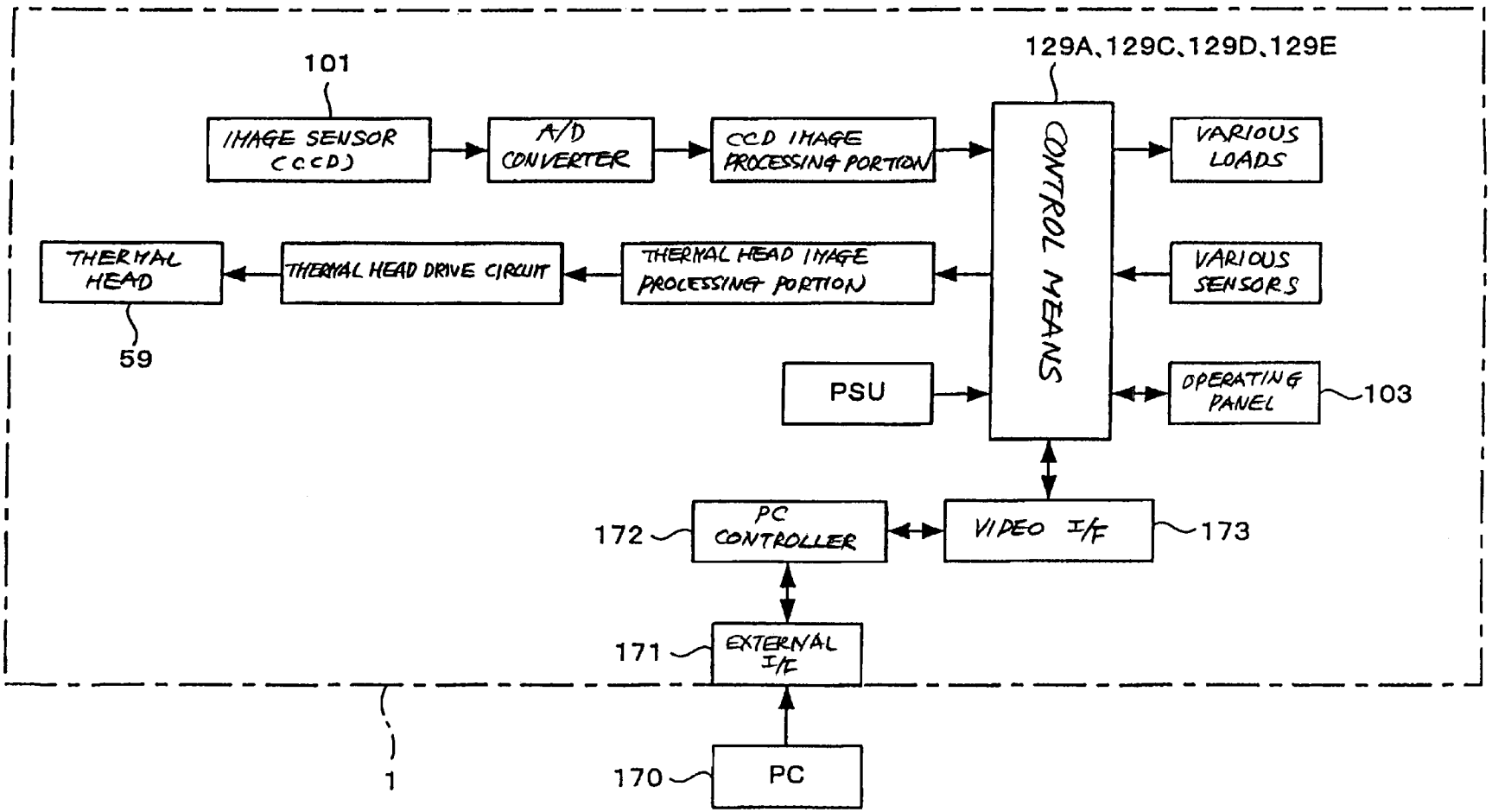
FIG. 26 is a block diagram showing a control constitution of the first and second examples of the second embodiment, and first, fourth, and fifth examples of a third embodiment.

As shown in FIGS. 25 and 26, the first example of the second embodiment differs from the fourth example of the first embodiment in that the reverse stacking sorter 208 is eliminated, initial set mode switching means, to be described below, enabling the duplex print mode and simplex print mode to be selected manually as the initial set mode (default) are newly added, the liquid crystal display 120 also functions as screen display means for displaying a warning on a liquid crystal screen indicating that the duplex print mode or simplex print mode has been set as the default following switching by the initial set mode switching means, and control means 129A are provided in place of the control means 129.

The initial set mode switching means are constituted by the numeral keypad 109, enter key 110, and program key 111, for example, and are also referred to as a "user set mode" based on an initial set mode switching signal generated when these keys are pressed in combination.

As shown in FIG. 25, the control means 129A are constituted by a microcomputer comprising in its interior a CPU 130A, PROM (programmable read-only memory) 131A, RAM 132A, a timer, not shown, and input/output ports, not shown. The control means 129A are provided in the interior of the device main body 11.

The CPU 130A (also referred to as "control means 129A" hereafter) differs mainly from the CPU 130 (control means 129) of the first embodiment in that the control functions of the control means 129 in the first through fifth embodiments are replaced by a first function for controlling a liquid crystal drive circuit, not shown, to display a message on the liquid crystal display 120 indicating the duplex print mode or simplex print mode on the basis of a signal relating to initial set mode switching, generated by the initial set mode switching means.

In addition, similarly to the CPU 130 (control means 129) of the first embodiment, the CPU 130A comprises a second function for controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, and the solenoid 123 for activating the switching member 10 such that perforation and printing operations in the duplex print mode are prohibited when the sheet size of the sheet P on the sheet feed tray 67, detected on the basis of a signal relating to setting of the duplex print mode through the duplex print mode key 117 or as the default mode, and a signal from the plurality of sheet size detection sensors 73, is greater than the preset sheet size (A4 portrait size in this embodiment), and for controlling the liquid crystal drive circuit to display a warning on the liquid crystal display 120 indicating that the duplex print mode cannot be used.

Here, "greater than the preset sheet size (A4 portrait size in this embodiment)" signifies that the sheet size differs from the preset sheet size (A4 portrait size in this embodiment), but does not signify a tolerable difference such as approximately 0.5 to 1 mm larger than A4 portrait size. Needless to say, when a sheet P having a smaller sheet size than the front side image 201 and reverse side image 202 on the duplex printing master 65 on the print drum 12 is used, ink seeps from the front side image 201 and so on as is well-known, exceeding the range of the small sheet P and contaminating the press roller 13 and so on or adhering to the sheet P such that a jam is caused. Hence in this case also, perforation and printing operations are prohibited. The usable sheet sizes in each of the duplex print mode and simplex print mode are stored in advance in the PROM 131A (the ROM 131 in the first embodiment) (likewise for the following examples of this embodiment).

Otherwise, the CPU 130A is identical to the CPU 130 (control means 129) of the first embodiment in that it controls the operations of the entire duplex stencil printing device 1 by controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, and the solenoid 123 for activating the switching member 10 on the basis of various signals from the operating panel 103, detection signals from the various sensors provided in the device main body 11, and the operating program called from the PROM 131A.

As well as the operating program for the entire duplex stencil printing device 1, programs and relationship data for effecting the unique functions of the CPU 130A described above are stored in the PROM 131A. These operating programs and so on are called by the CPU 130A as needed. The RAM 132A functions to store the calculation results of the CPU 130A temporarily, to store data signals and ON/OFF signals set and inputted from the various keys and sensors in the operating panel 103 as needed, and soon. Further, the CPU 130A learns the rotary phase position of the print drum 12 on the basis of a home position signal from the home position sensor 134 and a signal from an encoder, not shown, provided in the print drum drive means 121 (likewise in the following examples).

Figure 29:
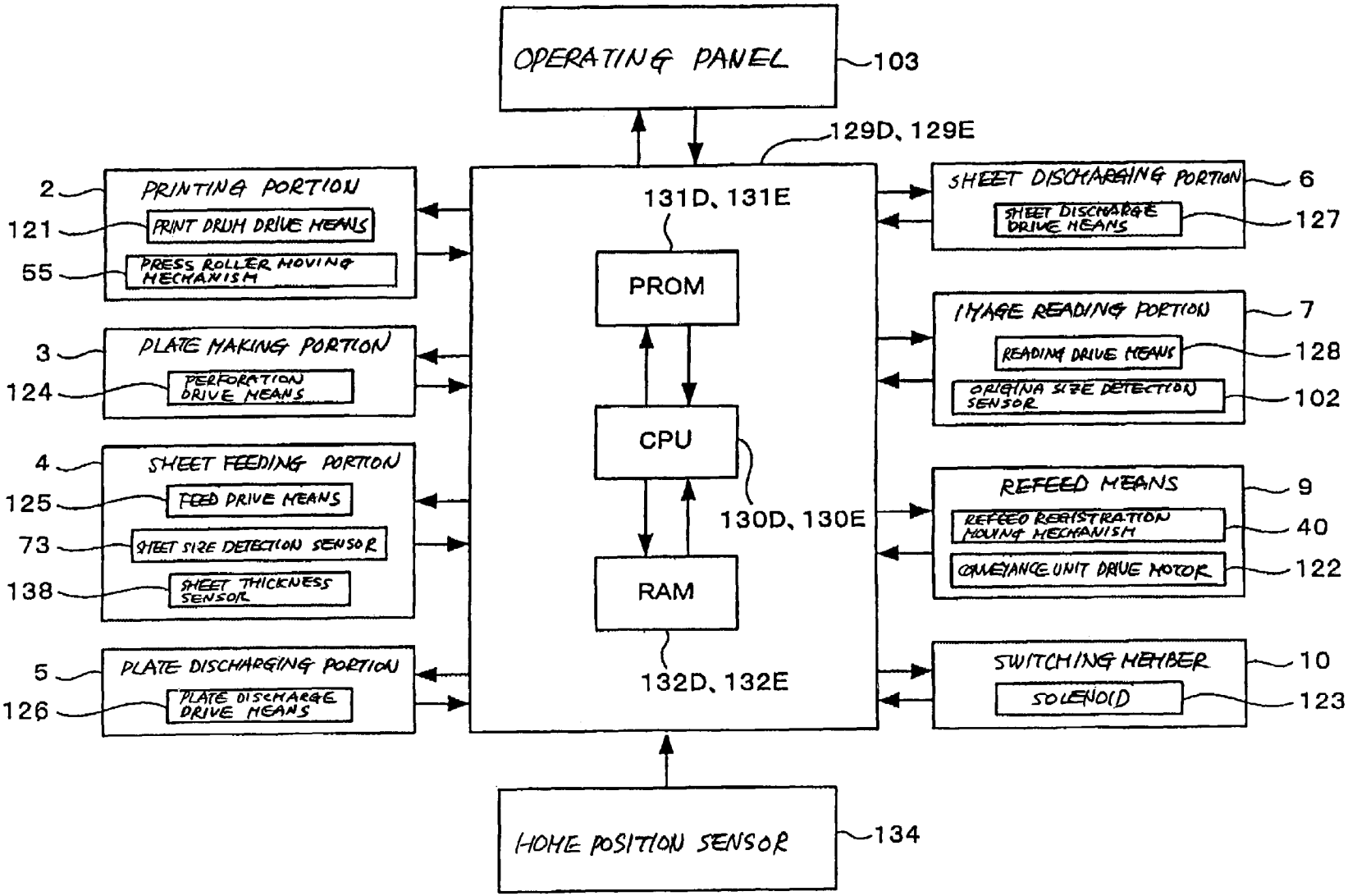
FIG. 29 is a block diagram showing a control constitution of fourth and fifth examples of the second embodiment.

The control means 129A shown in FIG. 29 and the control means 129A shown in FIG. 26 are identical, and the two drawings are block diagrams thereof from different perspectives. Borrowing the constitutions shown in FIGS. 20 and 24, the horizontal stacking sorter 210 or reverse stacking sorter 208 may be connected as needed to the duplex stencil printing device 1 shown in FIG. 26, and the control functions of the control means 129 in the first through fifth examples may be added as needed to the control means 129A through the external I/F 211 so that the control means 129A are constituted and operated accordingly.

Next, an operation of a first example of the second embodiment will be described.

It is assumed as a prerequisite for describing an operation of the first example of the second embodiment that a sheet P which is not suitable for duplex printing, for example A3 size (landscape) is stacked and set on the sheet feed tray 67 in this embodiment. Before performing duplex printing or simplex printing, for example when purchasing the duplex stencil printing device 1 or the like, first the user switches on the aforementioned power switch to supply power to the duplex stencil printing device 1. In so doing, a message such as "Simplex print mode is set. Duplex printing cannot be performed!" is displayed on the liquid crystal display 120, for example, to indicate that the simplex print mode has been set as the default "factory shipment mode".

The user uses the duplex print mode most frequently as an initial set mode, and therefore presses the program key 111 on the operating panel 103 to switch the initial set mode (default) from the simplex print mode to the duplex print mode. The user then inputs a numerical value such as "123" into the numeral keypad 109, and then confirms this by pressing the enter key 110. By pressing these keys in this order, and on the basis of an initial set mode switching signal generated by the code number "123", the CPU 130A performs write control to switch the initial set mode written in advance into the PROM 131A from the simplex print mode to the duplex print mode.

By means of this control performed by the CPU 130A, a message such as "Duplex print mode is set. Simplex printing cannot be performed!" is displayed on the liquid crystal display 120, for example, to indicate that the duplex print mode has been set as a "user set mode". When mode clearance is performed by switching the power switch on or pressing the mode clear key 112, the message "Duplex print mode is set. Simplex printing cannot be performed!" is displayed, and the duplex print mode display lamp 117*a* is illuminated.

By reading the message relating to the duplex print mode that is displayed on the liquid crystal display 120, or by noticing that the duplex print mode display lamp 117*a* is illuminated, the user is able to confirm and recognize that the duplex print mode has been set as the initial set mode. As a result, the default operating mode when the power of the duplex stencil printing device 1 is switched on by pressing the power switch or when the mode is cleared by pressing the mode clear key 112 is determined, and thus it becomes possible to avoid mistaking the duplex print mode for the simplex print mode. Accordingly, duplex printing perforation and duplex printing can be performed as desired without wasting the expensive master 64 and performing wasteful printing (simplex printing in the operative example above).

If printing is performed when a message indicating duplex print mode is displayed on the liquid crystal display 120 and the duplex print mode display lamp 117*a* is illuminated, or when the duplex print mode is set through the duplex print mode key 117, and the sheet size on the sheet feed tray 67 (A3 landscape size in this embodiment), detected on the basis of a signal relating to setting of the duplex print mode, a signal from the plurality of sheet size detection sensors 73, and a signal from detection means, not shown in the drawing, for detecting the set width of the side fences 72, is greater than the preset sheet size (A4 portrait size in this embodiment), a conveyance jam of the sheets P occurs. Therefore, the control means 129A control the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, and so on to prohibit perforation, plate mounting, and duplex printing in the duplex print mode (or a normal duplex printing operation).

As a result, when the user sets the thickness of the sheet P to be used by pressing the sheet thickness setting key 116, and then presses the perforation start key 104, the control means 129A ignore and invalidate the start signal transmitted and inputted from the perforation start key 104 such that a perforation operation in the duplex print mode, including a plate discharging operation, is not executed.

Simultaneously, the control means 129A control the aforementioned liquid crystal drive circuit to display a message on the liquid crystal display 120 such as "The sheet is larger than A4, and therefore duplex printing cannot be performed", which serves as a warning that the duplex print mode cannot be used. In accordance with the content of the display, the user may remove the A3 landscape size sheets P from the sheet feed tray 67, and replace them with A4 size sheets P.

When the user then sets the thickness of the sheet P to be used by pressing the sheet thickness setting key 116, and then presses the perforation start key 104, a start signal is generated, and then transmitted and inputted into the control means 129A, whereupon a command for starting a plate mounting and duplex printing operation is issued from the control means 129A. This operation is performed in an identical manner to the duplex printing operation performed by the duplex printing device (1) disclosed in Japanese Unexamined Patent Application Publication 2003-200645, including plate mounting and duplex printing (see paragraphs [0109] to [0125] of this publication) and trial duplex printing (see paragraphs [0126] to [0131] of this publication), and hence description thereof has been omitted.

If the user wishes to set the simplex print mode as the initial set mode, in contrast to the operations and control described in the example above, the "factory shipment mode" described above may be left as is.

Hence according to the first example, the user is able to determine at will the operating mode which will serve as a default when the power of the duplex stencil printing device 1 is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled. Accordingly, wastage of masters due to perforation errors during duplex printing can be eliminated, and jams and the like of the sheets during duplex printing can be prevented. Moreover, sheet conveyance jams caused by sheet size setting errors during duplex printing can be prevented.

If a device as large as the liquid crystal display 120 is deemed unnecessary to call the user's attention to warnings indicating that the duplex print mode cannot be used, then such warnings may be provided by having a simple LED, for example, flash or light up to serve as information notifying means instead of the liquid crystal display 120 (likewise in the following examples).

Similarly, if a device as large as the liquid crystal display 120 is deemed unnecessary to call the user's attention to whether the simplex print mode or duplex print mode has been set, then this may be confirmed by having the duplex print mode display lamp 117*a* light up or flash. In other words, when the power of the duplex stencil printing device 1 is switched on or during mode clearance, any notifying means may be used to notify the user of whether the simplex print mode or the duplex print mode has been set, for example notification through audio guidance, a buzzer which calls the user's attention to the message displayed on the liquid crystal display 120, or a combination of the liquid crystal display 120, flashing or illumination of the duplex print mode display lamp 117*a*, the aforementioned buzzer, and so on (likewise in the following examples).

The initial set mode switching means are not limited to the user set mode generated by the aforementioned combination of keys, and may take the form of a service set mode, in which a serviceperson sets the initial set mode, or a factory shipment set mode, in which the initial set mode is set during factory shipment, for example (likewise in the following examples).

Further, there are no limitations on the PROM 131A, and instead of a narrowly defined PROM which can only be programmed once, an EPROM that can be erased through ultraviolet rays and the like or an EEPROM that can be erased electrically may be used. In the service set mode or factory shipment set mode, relationship data and programs may be modified through ROM chip replacement instead of the PROM 131A (likewise in the following examples).

Figure 27:
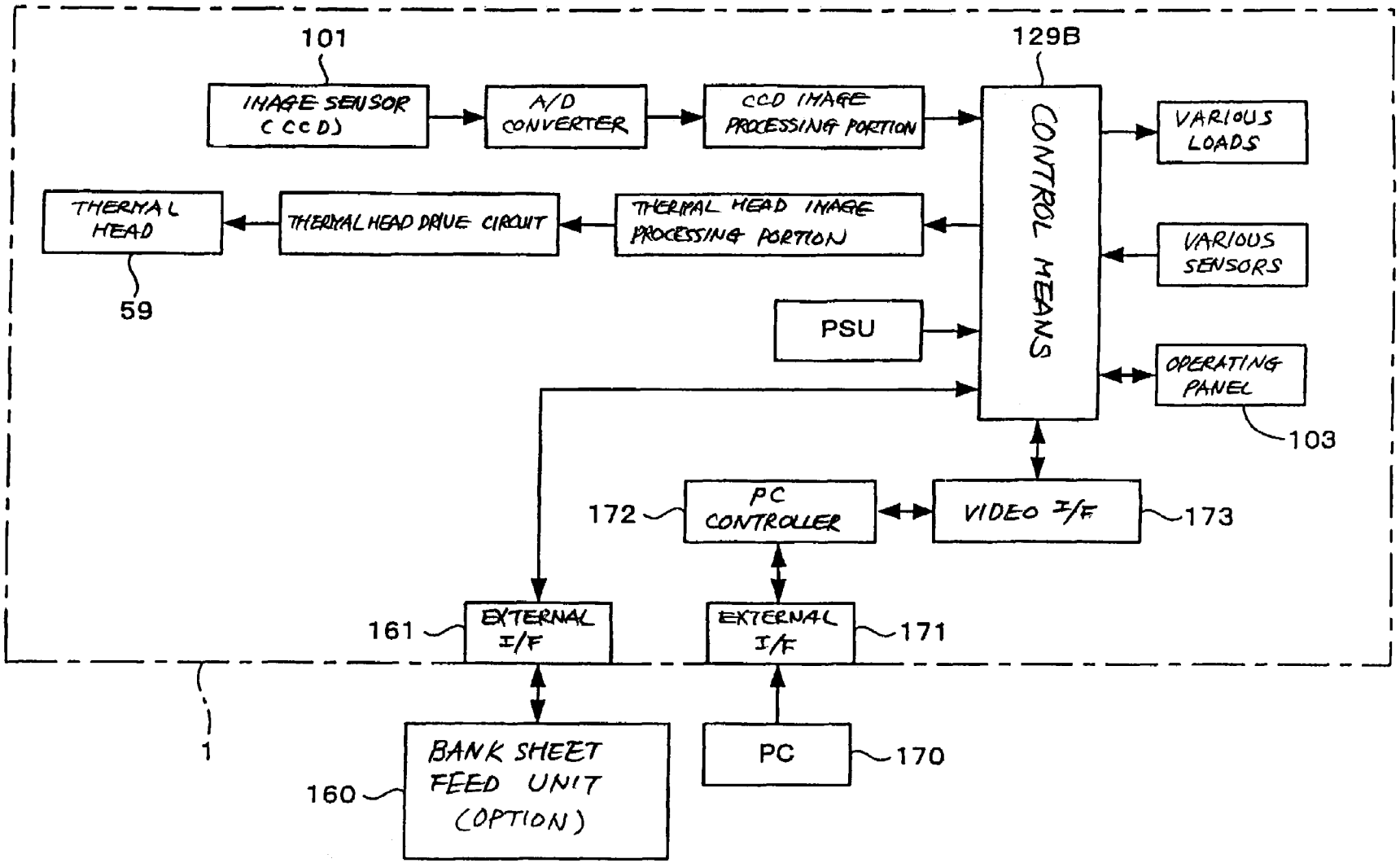
FIG. 27 is a block diagram showing a control constitution of the second example of the second embodiment.

A second example of the second embodiment is shown in FIGS. 25 and 27.

As shown in FIGS. 25 and 27, the second example differs mainly from the first example shown in FIGS. 25 and 26 in that a bank sheet feed unit 160 serving as bank sheet feeding means comprising a plurality of sheet feeding means for feeding sheets having a plurality of sheet sizes, which are stacked on a plurality of sheet feed tables, toward the printing portion 2 is connected to the duplex stencil printing device 1, and in that control means 129B are provided in place of the control means 129A.

The bank sheet feed unit 160 is optional, and functions as bank sheet feeding means for selecting one type of sheets P having a plurality of sheet sizes (in this example, two types of sheets P comprising A3 size and A4 size), and feeding this sheet between the print drum 12 and press roller 13. Referring back to FIG. 1, the bank sheet feed unit 160 is connected mechanically to the duplex stencil printing device 1 so as to be capable of feeding sheets via a sheet feeding path, not shown, which is connected to the sheet feed path between the separator roller 69 and registration roller pair 71 in the sheet feeding portion 4 so as to rise from the lower side of this sheet feeding path, and is also connected electrically so as to be capable of communication.

The bank sheet feeding portion (200) disclosed in FIGS. 1, 15, and so on of Japanese Unexamined Patent Application Publication 2000-108481 and Japanese Unexamined Patent Application Publication 2000-128398, proposed by the present applicant, may be cited as a specific example of the bank sheet feeding unit 160. The bank sheet feeding portion (200) has a well-known constitution comprising sheet feeding means (29-1), an upper bank sheet feeding portion (201) and sheet feeding means (29-2) serving as an upper level sheet feeding portion comprising a sheet size detection mechanism constituted by a sheet size detection sensor group (50-1) for detecting the size of the sheets on an upper tray (143) serving as a sheet feeding table and an upper bank which is similar to that disclosed in FIG. 14 of these publications, a lower bank sheet feeding portion (202) serving as a lower level sheet feeding portion comprising a sheet size detection mechanism constituted by a sheet size detection sensor group (50-2) for detecting the size of the sheets on a lower tray (143) serving as a sheet feeding table and a lower bank which is similar to that disclosed in FIG. 14 of these publications, a bank sheet feeding drive mechanism 125 for performing sheet feeding from the bank sheet feeding portion 200 shown in FIG. 16 of these two publications, and so on. A roller switching drive system for switching between intermediate conveyance rollers (55*a*, 55*b*) and the sheet feeding means (29), and so on are also provided.

The various sheet feeding means (29), (29-1), (29-2) correspond to the sheet feed roller 68 and separator roller 69 in the sheet feeding portion 4 shown in FIG. 1. Bank sheet feed control means (the bank sheet feed control device (148) described in the aforementioned publications), not shown, which is provided in the bank sheet feeding unit 160, is connected to the control means 129B via an external I/F 161 so that serial communication between the two control means is possible.

As shown in FIG. 25, the control means 129B is constituted by a microcomputer comprising in its interior a CPU 130B, PROM 131B, RAM 132B, a timer, not shown, and input/output ports, not shown. The control means 129B are provided in the interior of the device main body 11.

The CPU 130B (to be referred to hereafter as "control means 129B") differ from the CPU 130A (control means 129A) of the first example in comprising a third function for controlling the sheet feed drive means 125 of the sheet feeding portion 4, the bank sheet feed drive mechanism 125, and the aforementioned roller switching drive system to feed sheets having an identical or smaller size to the preset sheet size (A4 portrait in this embodiment) from the sheet feed tray 67, the upper tray (143), and the lower tray (145) to one of the sheet feed roller 68, sheet feeding means (29-1), and sheet feeding means (29-2), selected automatically, on the basis of a signal relating to setting of the duplex print mode from the duplex print mode key 117 or as the default mode, signals from the plurality of sheet size detection sensors 73 and the detection means, not shown, for detecting the set width of the side fences 72, and signals from the upper bank sheet size detection sensor group (50-1) and the lower bank sheet size detection sensor group (50-2).

Here, "sheets having an identical or smaller size to the preset sheet size (A4 portrait in this embodiment)" includes sheets of the same size as the preset sheet size (A4 portrait in this embodiment), and sheets of a sheet size that is slightly smaller than the preset sheet size to the extent that the press roller 13 and so on are not contaminated and jams do not occur.

Otherwise, the CPU 130B is substantially identical to the CPU 130A (control means 129A) of the first example in that it controls the operations of the entire duplex stencil printing device 1 by controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, etc. on the basis of various signals from the operating panel 103, detection signals from the various sensors provided in the device main body 11, and the operating program called from the PROM 131B.

More specifically, the CPU 130B (control means 129B) comprises the first function for controlling the liquid crystal drive circuit, not shown, to display a message on the liquid crystal display 120 indicating the duplex print mode or simplex print mode on the basis of a signal from the initial set mode switching means, and the second function for controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, and the solenoid 123 for activating the switching member 10 such that perforation and printing operations in the duplex print mode are prohibited when the detected sheet size is greater than the preset sheet size (A4 portrait size in this embodiment), and for controlling the liquid crystal drive circuit to display a warning on the liquid crystal display 120 indicating that the duplex print mode cannot be used.

The operations of the second example differ mainly from the operations of the first example simply in that a sheet size which is suitable for duplex printing (A4, for example) is selected automatically and fed from the bank sheet feeding unit 160. From the aforementioned control constitution and so on, a person skilled in the art could easily implement such an operation, and hence further description thereof has been omitted to avoid overlap.

Hence according to the second example, the sheet feeding portion 4 and bank sheet feeding unit 160 are provided, and sheets P of different sizes, including a sheet size (A4 or smaller) which is suitable for duplex printing, are set on the upper tray (143) and lower tray (145) of the bank sheet feeding unit 160. Thus, when switching the sheet size during duplex printing from the simplex print mode to the duplex print mode, for example, the control means 129B select automatically the tray on which sheets P of size A4 or smaller for duplex printing are set, from the upper tray (143) and lower tray (145) of the bank sheet feeding unit 160, and feed sheets from that tray in the manner described above. As a result, the sheets P on the sheet feed tray 67 do not have to be replaced, and sheet size selection can be performed easily, enabling an improvement in operability. At the same time, sheet jams and the like occurring when the user selects and sets the sheet size on the operating panel 103, for example, such that large sheets P exceeding the A4 size suitable for duplex printing are selected mistakenly, for example, can be forestalled.

Figure 28:
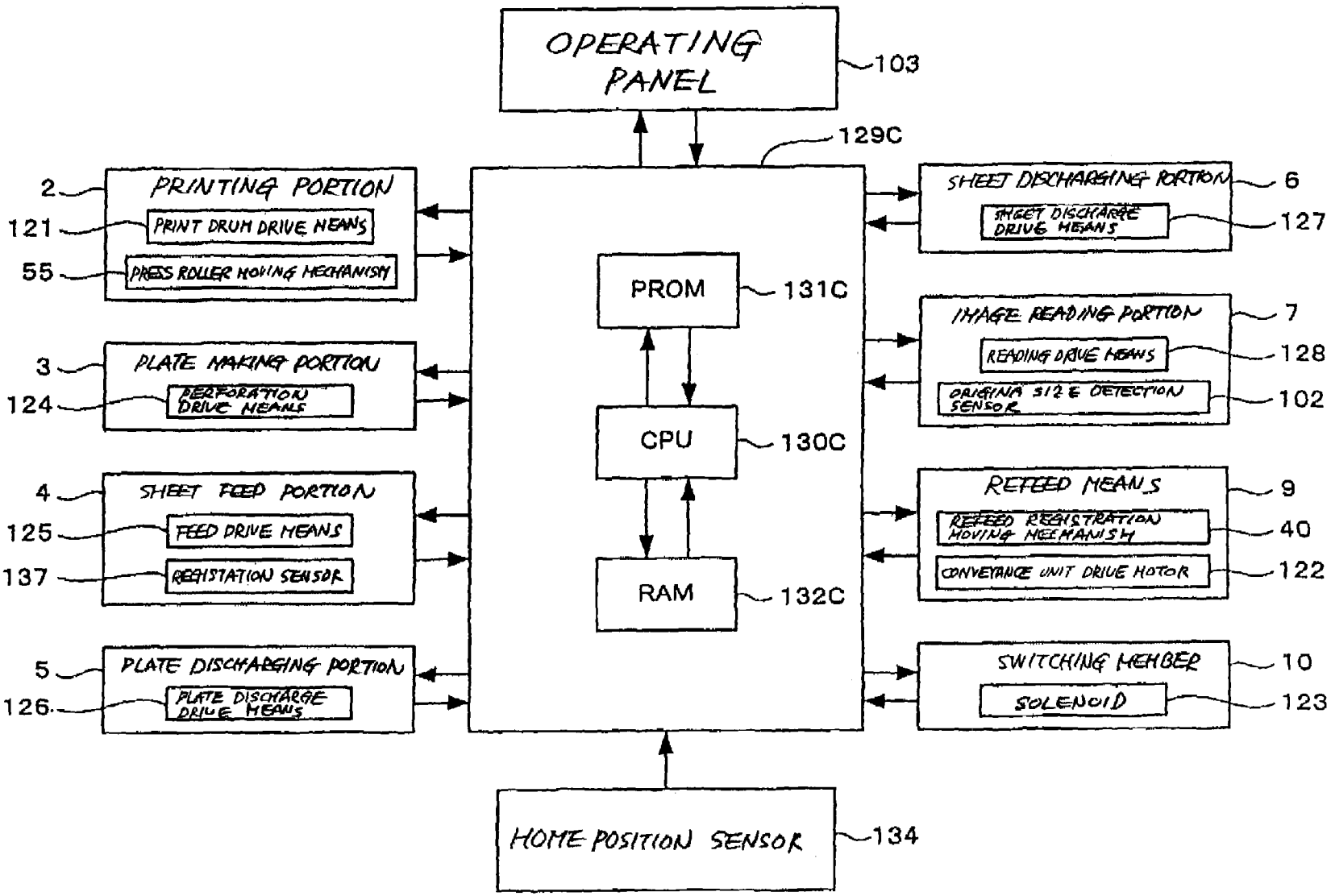
FIG. 28 is a block diagram showing a control constitution of a third example of the second embodiment.

As shown in FIGS. 26 and 28, a third example of the second embodiment differs from the first example shown in FIGS. 25 and 26 in that the plurality of sheet size detection sensors 73 are replaced by a registration sensor 137 (see FIG. 1) provided in the sheet feeding portion 4 as sheet length detecting means for detecting the length of the sheet P in the conveyance direction, and in that the control means 129A are replaced by control means 129C.

As shown in FIG. 28, the control means 129C are constituted by a microcomputer comprising in its interior a CPU 130C, PROM 131C, RAM 132C, a timer, not shown, and input/output ports, not shown. The control means 129A are provided in the interior of the device main body 11.

The CPU 130C (also referred to as "control means 129C" hereafter) differs from the CPU 130A of the first example in that the second function of the control means 129A is replaced by a third function. In the third function, the CPU 130C controls the sheet feed drive means 124 on the basis of a signal relating to setting of the duplex print mode from the duplex print mode key 117 or as the default mode such that the sheet feed roller 68 and separator roller 69 nip and convey one sheet P from the sheet feed tray 67. This control is performed after the duplex printing master 65, created upon activation of the plate making portion 3 in accordance with duplex printing perforation image data obtained upon activation of the image reading portion 7 or duplex printing perforation image data from the PC 170, is wrapped around the print drum 12. The CPU 130C then determines whether or not the sheet length is suitable for duplex printing during conveyance of the sheet P by comparing data relating to a sheet length detected by the registration sensor 137 and sheet length data preset in the PROM 131C. If it is determined that a duplex printing operation is impossible, the CPU 130C controls the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, and so on such that printing operations in the duplex print mode are prohibited. The CPU 130C also differs from the CPU 130A in comprising a function for performing such comparisons and determinations while giving priority to the data (signals) relating to the sheet length of the sheet P that is detected by the registration sensor 137 over the data (signals) relating to the sheet size of the sheet P that is selected and set through the selection setting keys 120*a*, 120*b*, 120*c*, 120*d* and direction keys 114 provided on the operating panel 103.

Otherwise, the control means 129C are substantially identical to the control means 129A of the first example. In other words, the CPU 130C controls the operations of the entire duplex stencil printing device 1 by controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, and the solenoid 123 for activating the switching member 10 on the basis of various signals from the operating panel 103, detection signals from the various sensors provided in the device main body 11, and the operating program called from the PROM 131C. More specifically, the CPU 130C (control means 129C) comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1, programs and relationship data for effecting the unique functions of the CPU 130C described above are stored in the PROM 131C (partially writably). These operating programs and so on are called by the CPU 130C as needed. The RAM 132C functions to store the calculation results of the CPU 130C temporarily, to store data signals and ON/OFF signals set and inputted from the various keys and sensors in the operating panel 103 as needed, and so on.

The control means 129C shown in FIG. 26 and the control means 129C shown in FIG. 28 are identical, and the two drawings are block diagrams thereof from different perspectives. Borrowing the constitutions shown in FIGS. 20 and 24, the horizontal stacking sorter 210 or reverse stacking sorter 208 may be connected as needed to the duplex stencil printing device 1 shown in FIG. 26, and the control functions of the control means 129 in the first through fifth examples may be added as needed to the control means 129C through the external I/F 211 so that the control means 129C are constituted and operated accordingly.

Next, an operation of the third example will be described, focusing on the differences with the first example.

When the power switch has been switched on by the user, a message such as "Duplex print mode is set. Simplex printing cannot be performed!" is displayed on the liquid crystal display 120, and the duplex print mode display lamp 117*a* is illuminated. When the duplex printing master 65 has been wrapped around the print drum 12 by means of similar operations to those described in the first example of the second embodiment, a single sheet P (normally a sheet P for plate mounting) is removed from the top of the sheet feed tray 67 by an operation of the sheet feed roller 68 and separator roller 69, under the control of the control means 129C, and conveyed. While the sheet P is under conveyance, data relating to the length of the sheet P conveyed by the registration roller pair 71 are detected by the registration sensor 137.

During conveyance of the sheet P by the registration roller pair 71 at a predetermined conveyance speed, the front end and rear end of the sheet P are detected by the registration sensor 137. The CPU 130C (control means 129C) measures the time from passage of the front end of the sheet P to detection of the rear end using the aforementioned timer, provided in the control means 129C, and calculates the length of the sheet P from the passage time thus measured and the predetermined conveyance speed of the registration roller pair 71. The control means 129C determine whether or not the sheet length is within a suitable range for duplex printing (A4 length in this embodiment) by comparing the data relating to the sheet length detected by the registration sensor 137 to sheet length data preset in the PROM 131C, and if it is determined that duplex printing cannot be performed (due to the sheet P being longer than A4 in the sheet conveyance direction), the control means 129C prohibit duplex printing operations, and display a warning such as "Duplex print mode cannot be used" on the liquid crystal display 120.

Considering the disposal position of the registration roller 137, at the point when duplex printing operations are prohibited, the rear end of the single sheet P (normally, a sheet P for plate mounting) has separated from the registration roller pair 71 and is placed on the refeed tray 8 for duplex printing, and hence the user may remove the sheet P by opening a front door cover disposed opposite the user of the duplex printing device 1.

Hence according to the third example, similar advantages to the first example are obtained. That is, the user is able to determine at will the operating mode which will serve as a default when the power of the duplex stencil printing device 1 is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled. Accordingly, wastage of masters due to perforation errors during duplex printing can be eliminated, and sheet jams and the like during duplex printing can be prevented even when the user selects and sets the sheet size mistakenly.

Note that the functions of the registration sensor 137 and CPU 130C (control means 129C) in the third example may of course be added to the first example or second example such that the first or second example is constituted to operate in a similar manner.

When applied to the first example, the plurality of sheet size detection sensors 73 are provided, and therefore a function for making comparisons and determinations while giving priority to data (signals) relating to the length of the sheet P detected by the registration sensor 137 over data (signals) relating to the size of the sheet P detected by the plurality of sheet size detection sensors 73 and so on should be added to the functions of the CPU 130C (control means 129C).

Similarly, when applied to the second example, the plurality of sheet size detection sensors 73, the upper bank sheet size detection sensor group (50-1), and the lower bank sheet size detection sensor group (50-2) are provided, and therefore a function for making comparisons and determinations while giving priority to data (signals) relating to the length of the sheet P detected by the registration sensor 137 over data (signals) relating to the size of the sheet P detected respectively by the plurality of sheet size detection sensors 73 and so on, the upper bank sheet size detection sensor group (50-1), and the lower bank sheet size detection sensor group (50-2) should be added to the functions of the CPU 130C (control means 129C).

As shown in FIGS. 26 and 29, a fourth example of the second embodiment differs from the first example shown in FIGS. 25 and 26 in that a sheet thickness sensor 138 (see FIG. 1) is provided in the sheet feeding portion 4 as sheet thickness detection means for detecting the thickness of the sheet P, and in that the control means 129A are replaced by control means 129D.

Examples of the sheet thickness sensor 138 include a type which measures the thickness of the sheet P by means of the transmittivity of light passing through the sheet P, a type which measures the thickness of the sheet P by measuring reflected waves from the sheet P using ultrasonic waves, and a type which measures the thickness of the sheet P by measuring the distance to the surface of the sheet P using laser light. Of these types, the type using the optical transmittivity has been put to practical use.

As shown in FIG. 29, the control means 129D are constituted by a microcomputer comprising in its interior a CPU 130D, PROM 131D, RAM 132J, a timer, not shown, and input/output ports, not shown. The control means 129D are provided in the interior of the device main body 11.

The CPU 130D (also referred to as "control means 129D" hereafter) differs mainly from the CPU 130A (control means 129A) of the first example in that the second function of the control means 129A is replaced by a second function in which the CPU 130D controls the sheet feed drive means 124 on the basis of a signal relating to setting of the duplex print mode from the duplex print mode key 117 or as the default mode such that the sheet feed roller 68 and separator roller 69 nip and convey one sheet P from the sheet feed tray 67. This control is performed after the duplex printing master 65, created upon activation of the plate making portion 3 in accordance with duplex printing perforation image data obtained upon activation of the image reading portion 7 or duplex printing perforation image data from the PC 170, is wrapped around the print drum 12. The CPU 130D then determines whether or not the sheet thickness is suitable for duplex printing during conveyance of the sheet P by comparing data relating to the thickness of the sheet P detected by the sheet thickness sensor 138 and sheet thickness data preset in the PROM 131D. If it is determined that a duplex printing operation is impossible, the CPU 130D controls the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, and so on such that printing operations in the duplex print mode are prohibited. The CPU 130D also differs from the CPU 130A in comprising a function for performing such comparisons and determinations while giving priority to the data (signals) relating to the thickness of the sheet P that is detected by the sheet thickness sensor 138 over the data (signals) relating to the thickness of the sheet P that is selected and set by the sheet thickness setting key 116.

Otherwise, the control means 129D are substantially identical to the control means 129A of the first example. In other words, the CPU 130D (control means 129D) controls the operations of the entire duplex stencil printing device 1 by controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, etc. on the basis of various signals from the operating panel 103, detection signals from the various sensors provided in the device main body 11, and the operating program called from the PROM 131D. More specifically, the CPU 130D (control means 129D) comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1, programs and relationship data for effecting the unique functions of the CPU 130D described above are stored in the PROM 131D (partially writably). These operating programs and soon are called by the CPU 130D as needed. The RAM 132J functions to store the calculation results of the CPU 130D temporarily, to store data signals and ON/OFF signals set and inputted from the various keys and sensors in the operating panel 103 as needed, and so on.

The control means 129D shown in FIG. 26 and the control means 129D shown in FIG. 29 are identical, and the two drawings are block diagrams thereof from different perspectives. Borrowing the constitutions shown in FIGS. 20 and 24, the horizontal stacking sorter 210 or reverse stacking sorter 208 may be connected as needed to the duplex stencil printing device 1 shown in FIG. 26, and the control functions of the control means 129 in the first through fifth examples may be added as needed to the control means 129D through the external I/F 211 so that the control means 129D are constituted and operated accordingly.

Next, an operation of the fourth example will be described, focusing on the differences with the first example. It is assumed as a prerequisite for describing an operation of the fourth example that an A4 portrait sized sheet P which is suitable for duplex printing is stacked and set on the sheet feed tray 67 in this embodiment.

When the power switch has been switched on by the user, a message such as "Duplex print mode is set. Simplex printing cannot be performed!" is displayed on the liquid crystal display 120, and the duplex print mode display lamp 117*a* is illuminated. When the duplex printing master 65 has been wrapped around the print drum 12 by means of similar operations to those described in the first example, a single A4 sheet P (normally a sheet P for plate mounting) is removed from the top of the sheet feed tray 67 by an operation of the sheet feed roller 68 and separator roller 69, under the control of the control means 129D, and conveyed. While the sheet P is being conveyed to the registration roller pair 71, the thickness of the sheet P is detected by the sheet thickness sensor 138. The control means 129D determine whether or not the sheet thickness is within a suitable range for duplex printing (in this embodiment, "normal" or "thin", but not "thick") by comparing the data relating to the thickness of the sheet P detected by the sheet thickness sensor 138 to sheet thickness data preset in the PROM 131D, and if it is determined that duplex printing cannot be performed, the control means 129C prohibit duplex printing operations, and display a warning such as "Duplex print mode cannot be used" on the liquid crystal display 120.

Hence according to the fourth example, similar advantages to the first example are obtained. That is, the user is able to determine at will the operating mode which will serve as a default when the power of the duplex stencil printing device 1 is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled. Accordingly, wastage of masters due to perforation errors during duplex printing can be eliminated, and sheet jams and the like during duplex printing can be prevented even when the user selects and sets the sheet thickness mistakenly through the sheet thickness setting key 116.

Note that the second function of the sheet thickness sensor 138 and the control means 129D in the fourth example may of course be added to the first through third examples such that the first through third examples are constituted to operate in a similar manner.

A fifth example of the second embodiment differs mainly from the fourth example shown in FIGS. 26 and 29 in that the control means 129D are replaced by control means 129E shown in FIG. 29.

The control means 129E are constituted by a microcomputer comprising in its interior a CPU 130E, PROM 131E, RAM 132E, a timer, not shown, and input/output ports, not shown. The control means 129E are provided in the interior of the device main body 11.

The CPU 130E (also referred to as "control means 129E" hereafter) differs mainly from the CPU 130D (control means 129D) of the fourth example in that the second function of the control means 129D is replaced by a function in which the CPU 130E controls the sheet feed drive means 124 on the basis of a signal relating to setting of the duplex print mode from the duplex print mode key 117 or as the default mode such that the sheet feed roller 68 and separator roller 69 nip and convey one sheet P from the sheet feed tray 67. This control is performed after the duplex printing master 65, created upon activation of the plate making portion 3 in accordance with duplex printing perforation image data obtained upon activation of the image reading portion 7 or duplex printing perforation image data from the PC 170, is wrapped around the print drum 12. The CPU 130E then compares data relating to the thickness of the sheet P detected by the sheet thickness sensor 138 and sheet thickness data preset in the PROM 131E during conveyance of the sheet P, and when the result of this comparison indicates a predetermined thickness or greater, the CPU 130E automatically switches the operating mode from the duplex print mode to the simplex print mode, and controls the stepping motor 52 of the press roller moving mechanism 55 to select the first print pressure range pattern in which print pressure is applied only to the front side area of the print drum 12, thereby executing printing of only the front side image 201 of the duplex printing master 65. The CPU 130E then controls the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, and so on such that printing operations in the duplex print mode are prohibited. The CPU 130E also differs from the CPU 130D in comprising a function for performing such comparisons and determinations while giving priority to the data (signals) relating to the thickness of the sheet P that is detected by the sheet thickness sensor 138 over the data (signals) relating to the thickness of the sheet P that is selected and set by the sheet thickness setting key 116.

Otherwise, the CPU 130E is substantially identical to the CPU 130D (control means 129D) of the fourth example. In other words, the CPU 130E controls the operations of the entire duplex stencil printing device 1 by controlling the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, etc. on the basis of various signals from the operating panel 103, detection signals from the various sensors provided in the device main body 11, and the operating program called from the PROM 131E. More specifically, the CPU 130E (control means 129E) comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1, programs and relationship data for effecting the unique functions of the CPU 130E described above are stored in the PROM 131E (partially writably). These operating programs and soon are called by the CPU 130E as needed. The RAM 132E functions to store the calculation results of the CPU 130E temporarily, to store data signals and ON/OFF signals set and inputted from the various keys and sensors in the operating panel 103 as needed, and so on.

The control means 129E shown in FIG. 26 and the control means 129E shown in FIG. 29 are identical, and the two drawings are block diagrams thereof from different perspectives. Borrowing the constitutions shown in FIGS. 20 and 24, the horizontal stacking sorter 210 or reverse stacking sorter 208 may be connected as needed to the duplex stencil printing device 1 shown in FIG. 26, and the control functions of the control means 129 in the first through fifth examples may be added as needed to the control means 129E through the external I/F 211 so that the control means 129E are constituted and operated accordingly.

Next, an operation of the fifth example will be described, focusing on the differences with the first example. It is assumed as a prerequisite for describing an operation of the fifth example that an A4 portrait sized sheet P which is suitable for duplex printing is stacked and set on the sheet feed tray 67 in this embodiment. It is also assumed that perforating of the duplex printing master 65 is performed by forming the front side image 201 (the word "front" serving as the first image) shown in FIG. 8 first. In the case of the duplex printing master 65 shown in FIG. 15, perforation is performed by forming the reverse side image 202 (the letter "G" serving as the first image) of the duplex printing master 65 first (likewise in the fifth example of the third embodiment, to be described below).

When the power switch has been switched on by the user, a message such as "Duplex print mode is set. Simplex printing cannot be performed!" is displayed on the liquid crystal display 120, and the duplex print mode display lamp 117*a* is illuminated. When the duplex printing master 65 has been wrapped around the print drum 12 by means of similar operations to those described in the first example, a single A4 sheet P is removed from the top of the sheet feed tray 67 by an operation of the sheet feed roller 68 and separator roller 69, under the control of the control means 129E, and conveyed. While the sheet P is being conveyed to the registration roller pair 71, the thickness of the sheet P is detected by the sheet thickness sensor 138. The control means 129E compare the data relating to the thickness of the sheet P detected by the sheet thickness sensor 138 to sheet thickness data preset in the PROM 131E, and when the result of this comparison indicates a predetermined thickness or greater, the control means 129E automatically switch the operating mode from the duplex print mode to the simplex print mode, and control the stepping motor 52 of the press roller moving mechanism 55 to select the first print pressure range pattern in which print pressure is applied only to the front side area of the print drum 12, thereby executing printing of only the front side image 201 of the duplex printing master 65. The control means 129E then control the various drive means provided in the printing portion 2, plate making portion 3, sheet feeding portion 4, plate discharging portion 5, sheet discharging portion 6, and image reading portion 7, the refeed registration moving mechanism 40 and conveyance unit drive motor 122 provided in the refeeding means 9, the solenoid 123 for activating the switching member 10, and so on such that printing operations in the duplex print mode are prohibited, and simultaneously display a warning such as "Duplex print mode cannot be used" on the liquid crystal display 120.

Hence according to the fifth example, similar advantages to the first example are obtained. That is, the user is able to determine at will the operating mode which will serve as a default when the power of the duplex stencil printing device 1 is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled. Accordingly, wastage of masters due to perforation errors during duplex printing can be eliminated, and even when the user selects and sets the sheet thickness mistakenly through the sheet thickness setting key 116, the printing operation is not halted suddenly, as in the fourth example of the second embodiment, and at least plate mounting is performed at the site of the front side image 201 of the duplex printing master 65 on the print drum 12, whereupon the printed sheet P is discharged to the discharge tray 86. Hence sheet jams and the like during printing can be forestalled.

Note that the second function of the sheet thickness sensor 138 and the control means 129E in the fifth example may of course be added to the first through third examples such that the first through third examples are constituted to operate in a similar manner.

Third Embodiment

Figure 30:
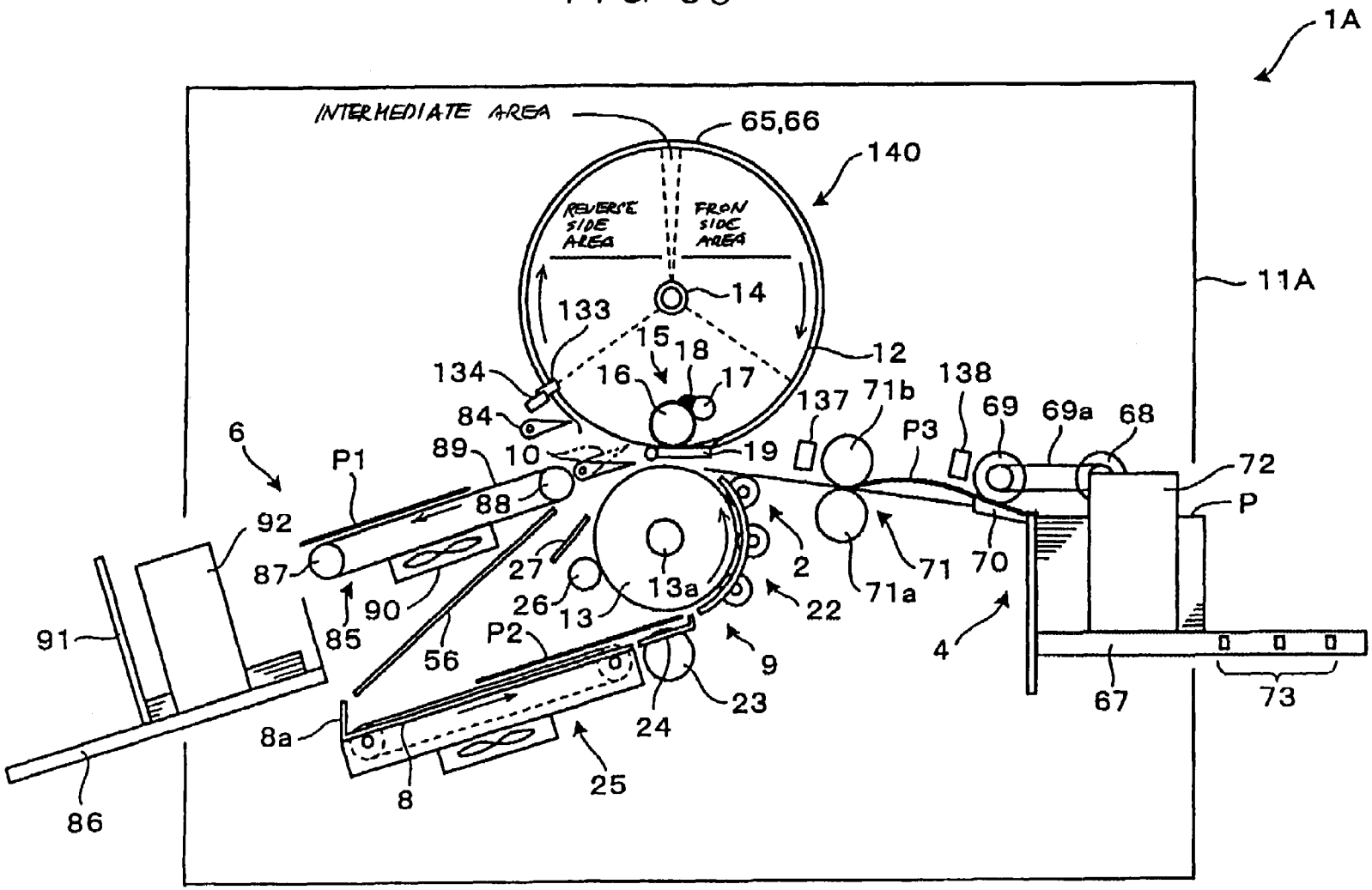
FIG. 30 is a front view of a duplex stencil printing device, illustrating the first through fifth examples of the third embodiment.
Figure 31:
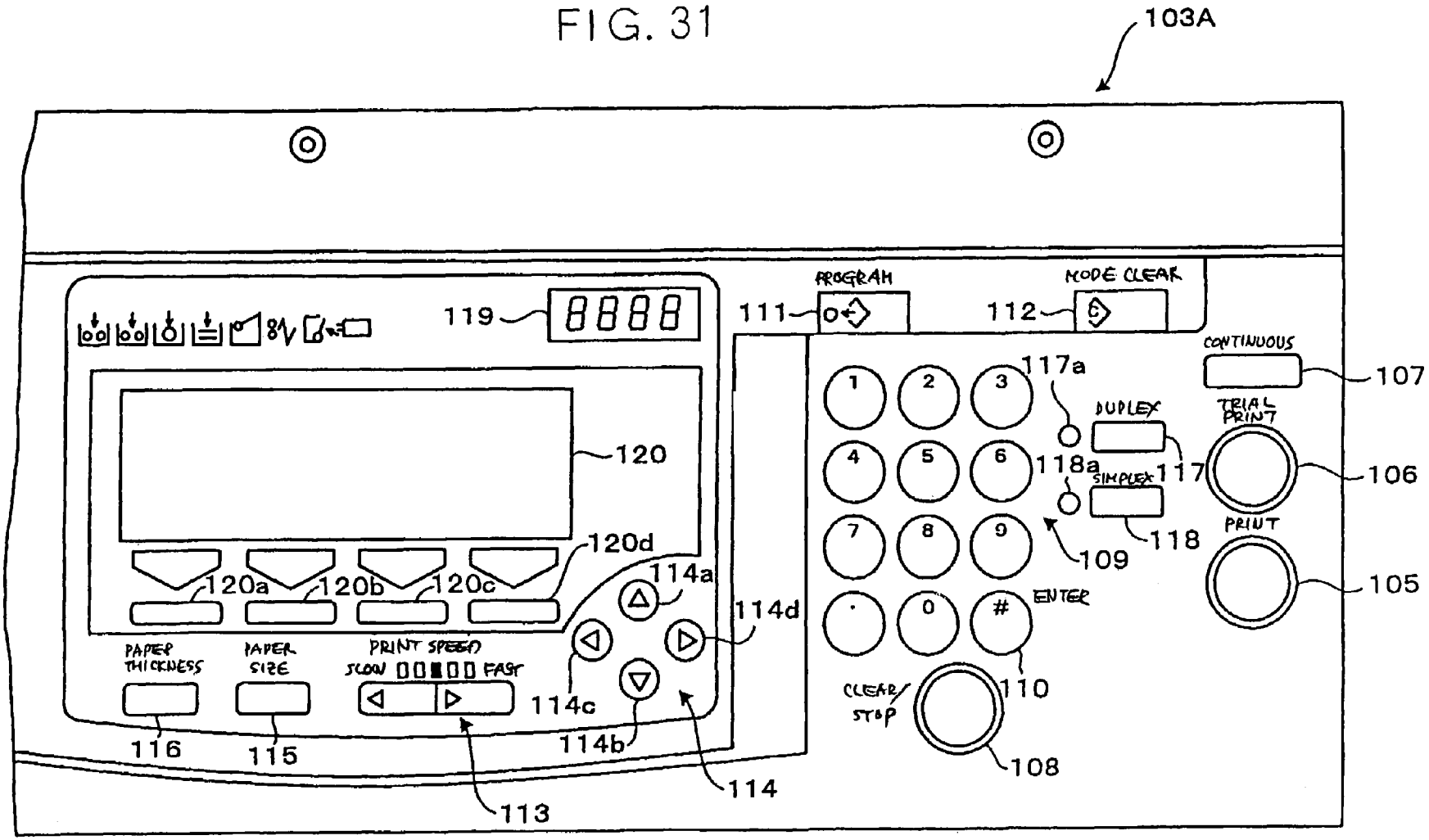
FIG. 31 is a plan view of the main parts of an operating panel of the duplex stencil printing device in FIG. 30.
Figure 32:
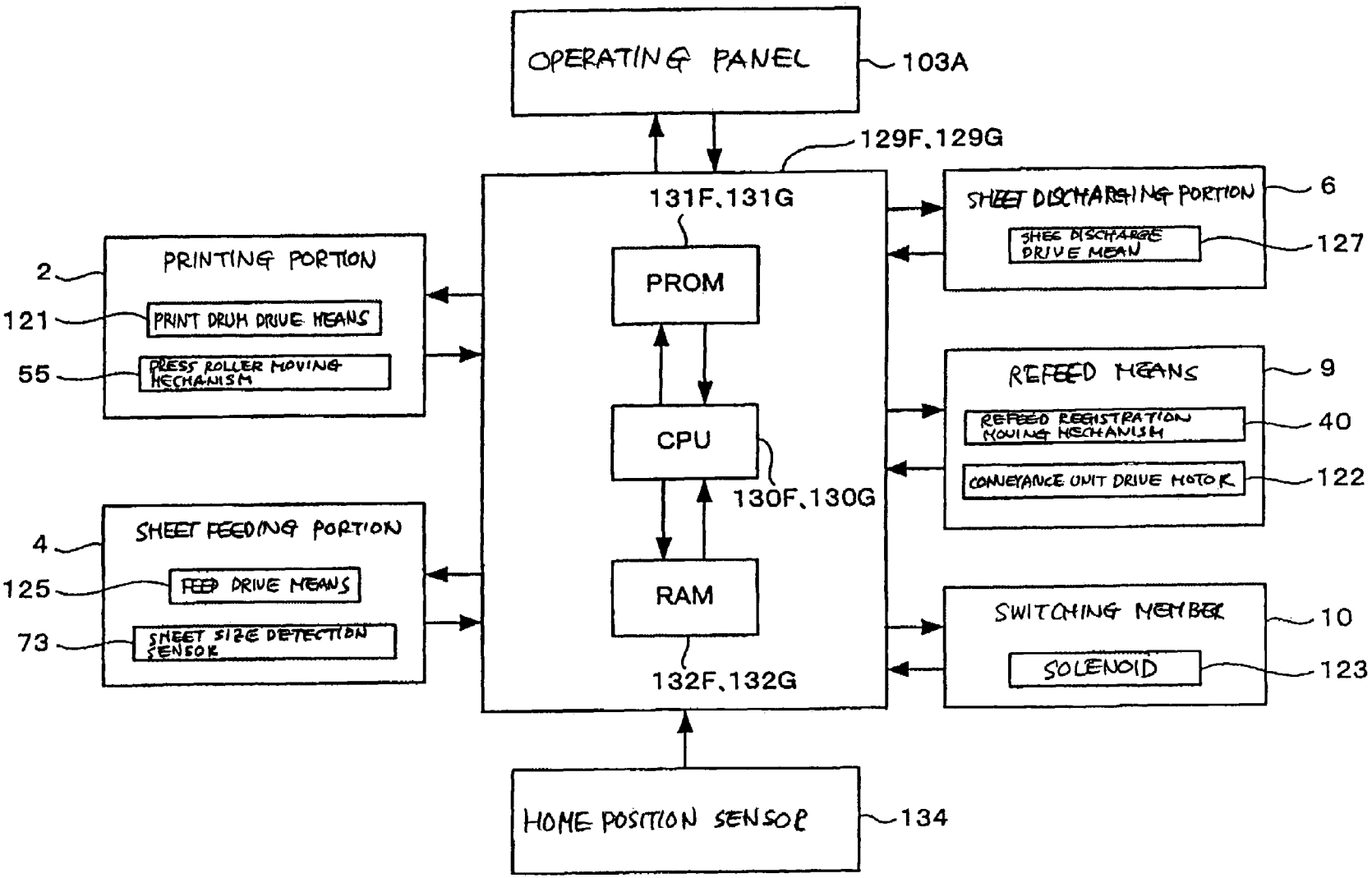
FIG. 32 is a block diagram showing a control constitution of the first and second examples of the third embodiment.

A first example of the third embodiment is illustrated in FIGS. 30 through 32.

The first example of the third embodiment differs mainly from the first example of the second embodiment in that the duplex stencil printing device 1 is replaced by a duplex stencil printing device 1A, a drum unit 140 is constituted by the print drum 12, ink supply means 15, and so on, which are formed integrally and mounted detachably in a device main body 11A of the duplex stencil printing device 1A, and a printing system is constituted with the duplex stencil printing device 1 shown in FIG. 1.

As shown in FIG. 30, the duplex stencil printing device 1A differs mainly from the duplex stencil printing device 1 in that the plate making portion 3, plate discharging portion 5, and image reading portion 7 are removed, the operating panel 103 is replaced by an operating panel 103A, the device main body 11 is replaced by the device main body 11A, and the control means 129A are replaced by control means 129F (see FIG. 32). Further, since the duplex stencil printing device 1A does not comprise a perforation or plate feeding function, it is not connected to the PC 170 serving as external output means.

The drum unit 140 may be attached and detached to and from the respective device main bodies 11A and 11 of the duplex stencil printing device 1A and duplex stencil printing device 1 via well-known attaching means. The duplex stencil printing device 1A and duplex stencil printing device 1 constitute a printing system via the drum unit 140 and so on for switching ink colors, for example (see, for example, the multicolor printing method and multicolor printing system disclosed in Japanese Unexamined Patent Application Publication H11-208085, proposed by the present applicant). Note that on the duplex stencil printing device 1A side, a multicolor duplex stencil printing device may be constituted by arranging two sets of the printing portion 2 and refeed means 9 shown in FIG. 30 in series in the sheet conveyance direction via an intermediate conveyance device, not shown.

The operating panel 103A differs from the operating panel 103 merely in that the perforation start key 104 serving as perforation activating means is removed, and is otherwise identical to the operating panel 103.

As shown in FIG. 32, the control means 129F are constituted by a microcomputer comprising in its interior the CPU 130, PROM 131F, RAM 132F, a timer, not shown, and input/output ports, not shown. The control means 129F are provided in the interior of the device main body 11A.

The CPU 130F (also referred to as "control means 129F" hereafter) differs from the CPU 130A (control means 129A) of the first example of the second embodiment in comprising a second function for controlling the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on such that printing operations in the duplex print mode are prohibited when the sheet size of the sheet P on the sheet feed tray 67, detected on the basis of a signal relating to the setting of duplex print mode through the duplex print mode key 117 or as the default mode, a signal from the plurality of sheet size detection sensors 73, and a signal from the detection means, not shown, for detecting the set width of the side fences 72, is greater than the preset sheet size (A4 portrait size in this embodiment), and for controlling the liquid crystal drive circuit to display a warning on the liquid crystal display 120 indicating that the duplex print mode cannot be used.

Otherwise, the CPU 130F is identical to the CPU 130A (control means 129A) of the first example of the second embodiment in that the CPU 130F controls the operations of the entire duplex stencil printing device 1A by controlling the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, etc. on the basis of various signals from the operating panel 103, detection signals from the various sensors provided in the device main body 11, and the operating program called from the PROM 131F. More specifically, similarly to the CPU 130A, the CPU 130F comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1A, programs and relationship data for effecting the unique functions of the CPU 130F described above are stored in the PROM 131F (partially writably). These operating programs and soon are called by the CPU 130F as needed. The RAM 132F functions to store the calculation results of the CPU 130F temporarily, to store data signals and ON/OFF signals set and inputted from the various keys and sensors in the operating panel 103A as needed, and so on.

Borrowing the constitutions shown in FIGS. 20 and 24, the horizontal stacking sorter 210 or reverse stacking sorter 208 may be connected as needed to the duplex stencil printing device 1A shown in FIG. 30, and the control functions of the control means 129 in the first through fifth examples may be added as needed to the control means 129F through the external I/F 211 so that the control means 129F are constituted and operated accordingly.

Next, an operation of the first example will be described.

It is assumed as a prerequisite for describing an operation of the first example that a sheet P which is not suitable for duplex printing, for example A3 size (landscape) is stacked and set on the sheet feed tray 67 in this embodiment. Before performing duplex printing or simplex printing, for example when purchasing the duplex stencil printing device 1A or the like, first the user switches on the aforementioned power switch to supply power to the duplex stencil printing device 1A. In so doing, a message such as "Simplex print mode is set. Duplex printing cannot be performed!" is displayed on the liquid crystal display 120, for example, to indicate that the simplex print mode has been set as the default "factory shipment mode".

The user uses the duplex print mode most frequently as an initial set mode, and therefore presses the program key 111 on the operating panel 103A to switch the initial set mode (default) from the simplex print mode to the duplex print mode. The user then inputs a numerical value such as "123" into the numeral keypad 109, and then confirms this by pressing the enter key 110. By pressing these keys in this order, and on the basis of an initial set mode switching signal generated by the code number "123", the CPU 130F performs write control to switch the initial set mode written in advance into the PROM 131F from the simplex print mode to the duplex print mode.

By means of this control performed by the CPU 130F, a message such as "Duplex print mode is set. Simplex printing cannot be performed!" is displayed on the liquid crystal display 120, for example, to indicate that the duplex print mode has been set as a "user set mode". When mode clearance is performed by switching the power switch on or pressing the mode clear key 112, the message "Duplex print mode is set. Simplex printing cannot be performed!" is displayed, and the duplex print mode display lamp 117*a* is illuminated.

By reading the message relating to the duplex print mode that is displayed on the liquid crystal display 120, or by noticing that the duplex print mode display lamp 117*a* is illuminated, the user is able to confirm and recognize that the duplex print mode has been set as the initial set mode. As a result, the default operating mode when the power of the duplex stencil printing device 1A is switched on by pressing the power switch or when the mode is cleared by pressing the mode clear key 112 is determined, and thus it becomes possible to avoid mistaking the duplex print mode for the simplex print mode. Accordingly, duplex printing can be performed as desired without performing wasteful printing (simplex printing in the operative example above).

If printing is performed when a message indicating duplex print mode is displayed on the liquid crystal display 120 and the duplex print mode display lamp 117*a* is illuminated, or when the duplex print mode is set through the duplex print mode key 117, and the sheet size on the sheet feed tray 67 (A3 landscape size in this embodiment), detected on the basis of a signal relating to setting of the duplex print mode, a signal from the plurality of sheet size detection sensors 73, and a signal from the detection means, not shown, for detecting the set width of the side fences 72, is greater than the preset sheet size (A4 portrait size in this embodiment), a conveyance jam of the sheets P occurs. Therefore, the control means 129F control the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on to prohibit plate mounting and duplex printing in the duplex print mode (or a normal duplex printing operation).

As a result, when the user sets the thickness of the sheet P to be used by pressing the sheet thickness setting key 116, and then presses the printing start key 105, the control means 129F ignore and invalidate the start signal transmitted and inputted from the printing start key 105 such that a perforation operation in the duplex print mode, including a plate discharging operation, is not executed.

Simultaneously, the control means 129F control the aforementioned liquid crystal drive circuit to display a message on the liquid crystal display 120 such as "The sheet is larger than A4, and therefore duplex printing cannot be performed", which serves as a warning that the duplex print mode cannot be used. In accordance with the content of the display, the user may remove the A3 landscape size sheets P from the sheet feed tray 67, and replace them with A4 size sheets P.

When the user then sets the thickness of the sheet P to be used by pressing the sheet thickness setting key 116, and then presses the printing start key 105, a printing start signal is generated, and then transmitted and inputted into the control means 129F, whereupon a command for starting a plate mounting and duplex printing operation is issued from the control means 129F. This operation is performed in an identical manner to the first example of the second embodiment described above, and hence description thereof has been omitted.

If the user wishes to set the simplex print mode as the initial set mode, in contrast to the operations and control described in the example above, the "factory shipment mode" described above may be left as is.

Hence according to the first example, the user is able to determine at will the operating mode which will serve as a default when the power of the duplex stencil printing device 1A is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled, and jams and the like of the sheets during duplex printing can be prevented. Moreover, sheet conveyance jams caused by sheet size setting errors during duplex printing can be prevented.

Figure 33:
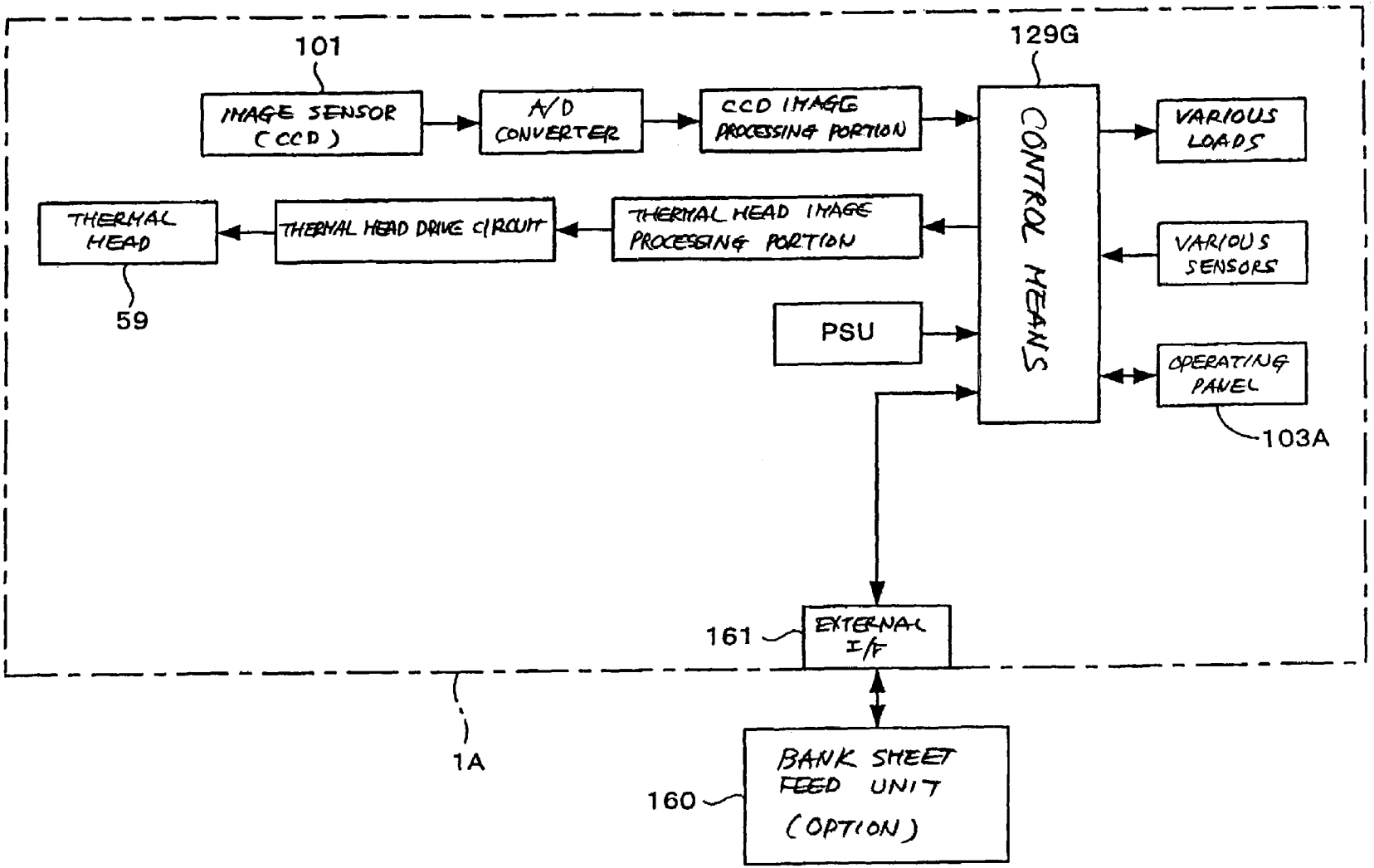
FIG. 33 is a block diagram showing a control constitution of the second example of the third embodiment.

A second example of the third embodiment is shown in FIGS. 32 and 33.

As shown in FIGS. 32 and 33, the second example differs mainly from the first example shown in FIGS. 30 through 32 in that the bank sheet feed unit 160 is connected to the duplex stencil printing device 1A, and in that control means 129G are provided in place of the control means 129F.

As shown in FIG. 32, the control means 129G is constituted by a microcomputer comprising in its interior a CPU 130G, PROM 131G, RAM 132G, a timer, not shown, and input/output ports, not shown. The control means 129G are provided in the interior of the device main body 11A.

In addition to the second function of the CPU 130F (control means 129F) of the first example, the CPU 130G (also referred to as "control means 129G" hereafter) comprise a second function for controlling the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on, and controlling the aforementioned liquid crystal drive circuit to display a warning on the liquid crystal display 120 indicating that the duplex print mode cannot be used, when the detected sheet size is greater than the preset sheet size (in this embodiment, A4 portrait size).

The CPU 130G comprises identical first and third functions to the CPU 130F (control means 129F) of the first example of the third embodiment. Otherwise, the CPU 130G is substantially identical to the CPU 130F (control means 129F) in that it controls the operations of the entire duplex stencil printing device 1A by controlling the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, etc. on the basis of various signals from the operating panel 103A, detection signals from the various sensors provided in the device main body 1A, and the operating program called from the PROM 131G.

The operations of the second example differ mainly from the operations of the first example simply in that a sheet size which is suitable for duplex printing (A4, for example) is selected automatically and fed from the bank sheet feeding unit 160. From the aforementioned control constitution and so on, a person skilled in the art could easily implement such an operation, and hence further description thereof has been omitted to avoid overlap.

Hence according to the second example, the sheet feeding portion 4 and bank sheet feeding unit 160 are provided, and sheets P of different sizes, including a sheet size (A4 or smaller) which is suitable for duplex printing, are set on the upper tray (143) and lower tray (145) of the bank sheet feeding unit 160. Thus, when switching the sheet size during duplex printing from the simplex print mode to the duplex print mode, for example, the control means 129G select automatically the tray on which sheets P of size A4 or smaller for duplex printing are set, from the upper tray (143) and lower tray (145) of the bank sheet feeding unit 160, and feed sheets from that tray in the manner described above. As a result, the sheets P on the sheet feed tray 67 do not have to be replaced, and sheet size selection can be performed easily, enabling an improvement in operability. At the same time, sheet jams and the like occurring during duplex printing when the user selects and sets the sheet size on the operating panel 103A, for example, such that large sheets P exceeding the A4 size suitable for duplex printing are selected mistakenly, for example, can be forestalled.

Figure 34:
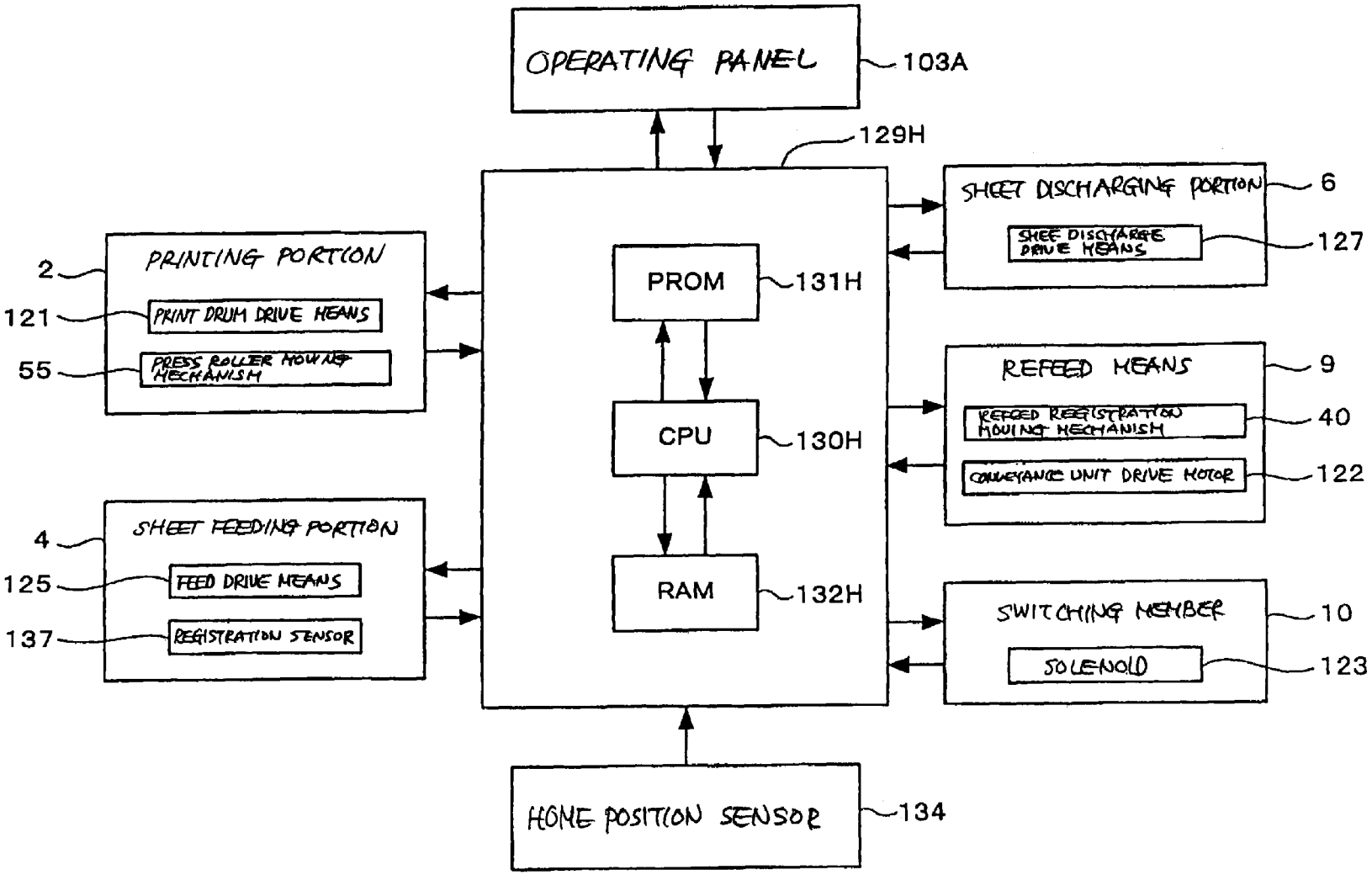
FIG. 34 is a block diagram showing a control constitution of the third example of the third embodiment.

As shown in FIG. 34, a third example of the third embodiment differs from the first example shown in FIGS. 30 through 32 in that the plurality of sheet size detection sensors 73 are replaced by the registration sensor 137 (see FIG. 30) provided in the sheet feeding portion 4, and in that the control means 129F are replaced by control means 129H.

As shown in FIG. 34, the control means 129H are constituted by a microcomputer comprising in its interior a CPU 130H, PROM 131H, RAM 132H, a timer, not shown, and input/output ports, not shown. The control means 129H are provided in the interior of the device main body 11A.

The CPU 130H (also referred to as "control means 129H" hereafter) differs from the CPU 130F of the first example in that the second function of the control means 129F is replaced by a third function. In the third function, the CPU 130H controls the sheet feed drive means 124 on the basis of a signal relating to setting of the duplex print mode through the duplex print mode key 117 or as the default mode such that the sheet feed roller 68 and separator roller 69 nip and convey one sheet P from the sheet feed tray 67. This control is performed when the drum unit 140 comprising the print drum 12, which is wrapped peripherally with the duplex printing master 65, created on the duplex stencil printing device 1 side of FIG. 1, is mounted on the device main body 11A. The CPU 130H then determines whether or not the sheet length is suitable for duplex printing during conveyance of the sheet P by comparing data relating to a sheet length detected by the registration sensor 137 and sheet length data preset in the PROM 131H. If it is determined that a duplex printing operation is impossible, the CPU 130H controls the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on such that printing operations in the duplex print mode are prohibited. The CPU 130H also differs from the CPU 130F in comprising a function for performing such comparisons and determinations while giving priority to the data (signals) relating to the sheet length of the sheet P that is detected by the registration sensor 137 over the data (signals) relating to the sheet size of the sheet P that is selected and set through the selection setting keys 120*a*, 120*b*, 120*c*, 120*d* and direction keys 114 provided on the operating panel 103A.

Otherwise, the control means 129H are substantially identical to the control means 129F of the first example. In other words, the CPU 130H controls the operations of the entire duplex stencil printing device 1A by controlling the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, etc. on the basis of various signals from the operating panel 103A, detection signals from the various sensors provided in the device main body 11A, and the operating program called from the PROM 131H. More specifically, the CPU 130H (control means 129H) comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1A, programs and relationship data for effecting the unique functions of the CPU 130H described above are stored in the PROM 131H (partially writably). These operating programs and so on are called by the CPU 130H as needed. The RAM 132H functions to store the calculation results of the CPU 130H temporarily, to store data signals and ON/OFF signals set and inputted from the various keys and sensors in the operating panel 103A as needed, and so on.

Borrowing the constitutions shown in FIGS. 20 and 24, the horizontal stacking sorter 210 or reverse stacking sorter 208 may be connected as needed to the duplex stencil printing device 1A shown in FIG. 26, and the control functions of the control means 129 in the first through fifth examples may be added as needed to the control means 129H through the external I/F 211 so that the control means 129H are constituted and operated accordingly.

Next, an operation of the third example will be described, focusing on the differences with the first example.

When the power switch has been switched on by the user, a message such as "Duplex print mode is set. Simplex printing cannot be performed!" is displayed on the liquid crystal display 120, and the duplex print mode display lamp 117*a* is illuminated. When the duplex printing master 65 has been wrapped around the print drum 12 by means of similar operations to those described in the first example of the third embodiment, a single sheet P (normally a sheet P for plate mounting) is removed from the top of the sheet feed tray 67 by an operation of the sheet feed roller 68 and separator roller 69, under the control of the control means 129H, and conveyed. While the sheet P is under conveyance, data relating to the length of the sheet P conveyed by the registration roller pair 71 are detected by the registration sensor 137.

During conveyance of the sheet P by the registration roller pair 71 at a predetermined conveyance speed, the front end and rear end of the sheet P are detected by the registration sensor 137. The CPU 130H (control means 129H) measures the time from passage of the front end of the sheet P to detection of the rear end using the aforementioned timer, provided in the control means 129H, and calculates the length of the sheet P from the passage time thus measured and the predetermined conveyance speed of the registration roller pair 71. The control means 129H determine whether or not the sheet length is within a suitable range for duplex printing (A4 length in this embodiment) by comparing the data relating to the sheet length detected by the registration sensor 137 to sheet length data preset in the PROM 131H, and if it is determined that duplex printing cannot be performed (due to the sheet P being longer than A4 in the sheet conveyance direction), the control means 129H prohibit duplex printing operations, and display a warning such as "Duplex print mode cannot be used" on the liquid crystal display 120.

Hence according to the third example, similar advantages to the first example are obtained. That is, the user is able to determine at will the operating mode which will serve as a default when the power of the duplex stencil printing device 1A is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled, and sheet jams and the like during duplex printing can be prevented. Moreover, sheet jams during printing can be forestalled even when the user selects and sets the sheet size mistakenly during duplex printing.

Note that the functions of the registration sensor 137 and CPU 130H (control means 129H) in the third example may of course be added to the first example or second example such that the first or second example is constituted to operate in a similar manner.

When applied to the first example, the plurality of sheet size detection sensors 73 are provided, and therefore a function for making comparisons and determinations while giving priority to data (signals) relating to the length of the sheet P detected by the registration sensor 137 over data (signals) relating to the size of the sheet P detected by the plurality of sheet size detection sensors 73 and so on should be added to the functions of the CPU 130H (control means 129H).

Similarly, when applied to the second example, the plurality of sheet size detection sensors 73, the upper bank sheet size detection sensor group (50-1), and the lower bank sheet size detection sensor group (50-2) are provided, and therefore a function for making comparisons and determinations while giving priority to data (signals) relating to the length of the sheet P detected by the registration sensor 137 over data (signals) relating to the size of the sheet P detected respectively by the plurality of sheet size detection sensors 73 and so on, the upper bank sheet size detection sensor group (50-1), and the lower bank sheet size detection sensor group (50-2) should be added to the functions of the CPU 130H (control means 129H).

Figure 35:
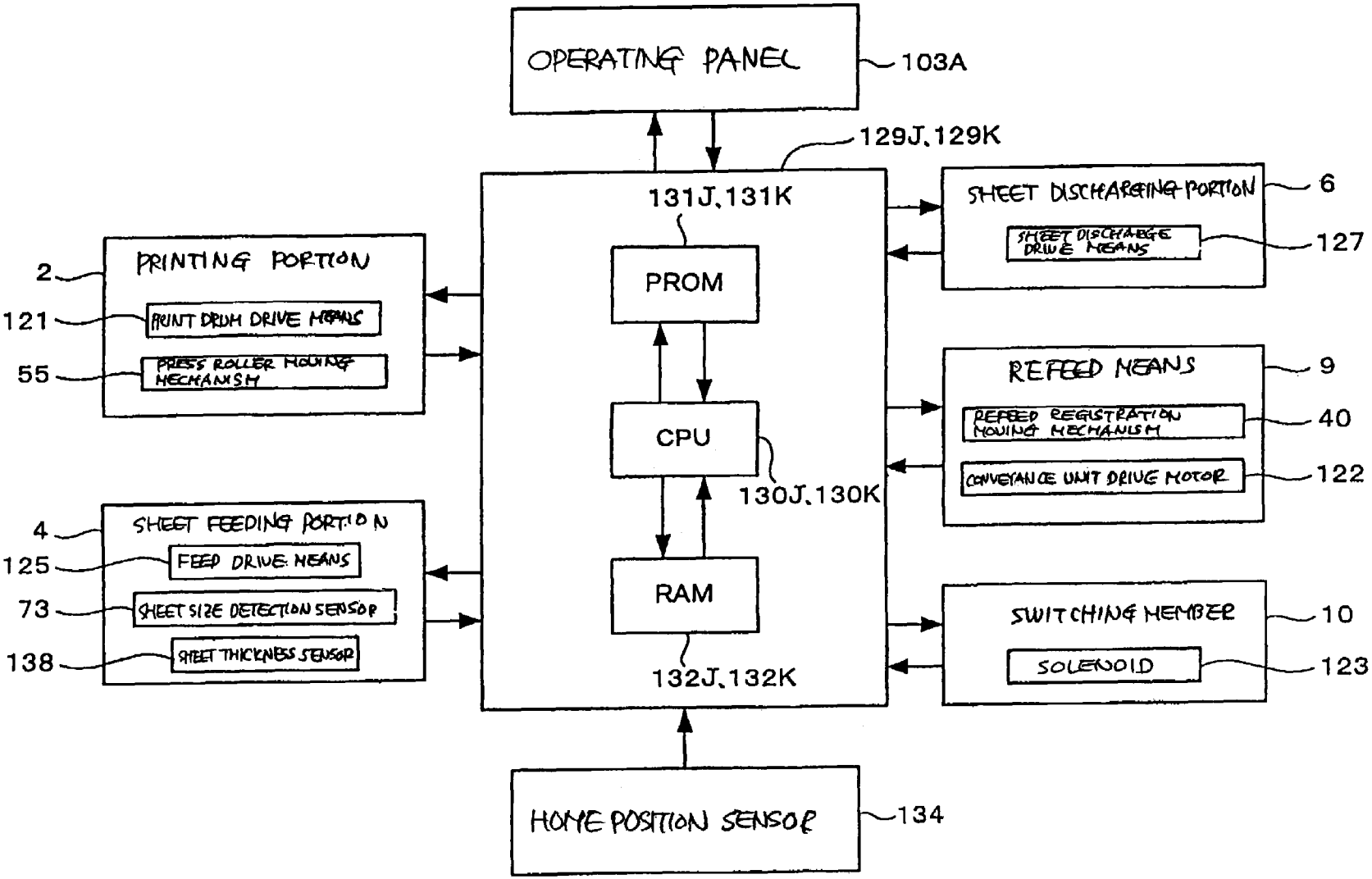
FIG. 35 is a block diagram showing a control constitution of the fourth and fifth examples of the third embodiment.

As shown in FIG. 35, a fourth example of the third embodiment differs from the first example shown in FIGS. 30 through 32 in that the sheet thickness sensor 138 (see FIG. 30) is provided in the sheet feeding portion 4, and in that the control means 129F are replaced by control means 129J.

As shown in FIG. 35, the control means 129J are constituted by a microcomputer comprising in its interior a CPU 130J, PROM 131J, the RAM 132J, a timer, not shown, and input/output ports, not shown. The control means 129J are provided in the interior of the device main body 11A.

The CPU 130J (also referred to as "control means 129J" hereafter) differs mainly from the CPU 130F (control means 129F) of the first example in that the second function of the control means 129F is replaced by a second function in which the CPU 130F controls the sheet feed drive means 124 on the basis of a signal relating to setting of the duplex print mode from the duplex print mode key 117 or as the default mode such that the sheet feed roller 68 and separator roller 69 nip and convey one sheet P from the sheet feed tray 67. This control is performed when the drum unit 140 comprising the print drum 12, which is wrapped peripherally with the duplex printing master 65, created on the duplex stencil printing device 1 side of FIG. 1, is mounted on the device main body 11A. The CPU 130J then determines whether or not the sheet thickness is suitable for duplex printing during conveyance of the sheet P by comparing data relating to the thickness of the sheet P detected by the sheet thickness sensor 138 and sheet thickness data preset in the PROM 131J. If it is determined that a duplex printing operation is impossible, the CPU 130J controls the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on such that printing operations in the duplex print mode are prohibited. The CPU 130J also differs from the CPU 130F in comprising a function for performing such comparisons and determinations while giving priority to the data (signals) relating to the thickness of the sheet P that is detected by the sheet thickness sensor 138 over the data (signals) relating to the thickness of the sheet P that is selected and set by the sheet thickness setting key 116.

Otherwise, the control means 129J are substantially identical to the control means 129F of the first example. In other words, the CPU 130J (control means 129J) controls the operations of the entire duplex stencil printing device 1A by controlling the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, etc. on the basis of various signals from the operating panel 103A, detection signals from the various sensors provided in the device main body 11A, and the operating program called from the PROM 131J. More specifically, the CPU 130J (control means 129J) comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1A, programs and relationship data for effecting the unique functions of the CPU 130J described above are stored in the PROM 131J (partially writably). These operating programs and soon are called by the CPU 130J as needed. The RAM 132J functions to store the calculation results of the CPU 130J temporarily, to store data signals and ON/OFF signals set and inputted from the various keys and sensors in the operating panel 103 as needed, and so on.

Borrowing the constitutions shown in FIGS. 20 and 24, the horizontal stacking sorter 210 or reverse stacking sorter 208 may be connected as needed to the duplex stencil printing device 1A shown in FIG. 26, and the control functions of the control means 129 in the first through fifth examples may be added as needed to the control means 129J through the external I/F 211 so that the control means 129J are constituted and operated accordingly.

Next, an operation of the fourth example will be described, focusing on the differences with the first example. It is assumed as a prerequisite for describing an operation of the fourth example that an A4 portrait sized sheet P which is suitable for duplex printing is stacked and set on the sheet feed tray 67 in this embodiment.

When the power switch has been switched on by the user, a message such as "Duplex print mode is set. Simplex printing cannot be performed!" is displayed on the liquid crystal display 120, and the duplex print mode display lamp 117*a* is illuminated. When the duplex printing master 65 has been wrapped around the print drum 12 by means of similar operations to those described in the first example of the third embodiment, a single A4 sheet P (normally a sheet P for plate mounting) is removed from the top of the sheet feed tray 67 by an operation of the sheet feed roller 68 and separator roller 69, under the control of the control means 129J, and conveyed. While the sheet P is being conveyed to the registration roller pair 71, the thickness of the sheet P is detected by the sheet thickness sensor 138. The control means 129J determine whether or not the sheet thickness is within a suitable range for duplex printing (in this embodiment, "normal" or "thin", but not "thick") by comparing the data relating to the thickness of the sheet P detected by the sheet thickness sensor 138 to sheet thickness data preset in the PROM 131J, and if it is determined that duplex printing cannot be performed, the control means 129J prohibit duplex printing operations, and display a warning such as "Duplex print mode cannot be used" on the liquid crystal display 120.

Hence according to the fourth example, similar advantages to the first example are obtained. That is, the user is able to determine at will the operating mode which will serve as a default when the power of the duplex stencil printing device 1A is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled, and sheet jams and the like during duplex printing can be prevented even when the user selects and sets the sheet thickness mistakenly through the sheet thickness setting key 116.

Note that the second function of the sheet thickness sensor 138 and the control means 129J in the fourth example may of course be added to the first through third examples such that the first through third examples are constituted to operate in a similar manner.

A fifth example of the third embodiment differs mainly from the fourth example shown in FIGS. 26 and 29 in that the control means 129J are replaced by control means 129K shown in FIG. 29.

The control means 129K are constituted by a microcomputer comprising in its interior a CPU 130K, PROM 131K, RAM 132K, a timer, not shown, and input/output ports, not shown. The control means 129K are provided in the interior of the device main body 11A.

The CPU 130K (also referred to as "control means 129K" hereafter) differs mainly from the CPU 130J (control means 129J) of the fourth example in that the second function of the control means 129J is replaced by a function in which the CPU 130K controls the sheet feed drive means 124 on the basis of a signal relating to setting of the duplex print mode from the duplex print mode key 117 or as the default mode such that the sheet feed roller 68 and separator roller 69 nip and convey one sheet P from the sheet feed tray 67. This control is performed when the drum unit 140 comprising the print drum 12, which is wrapped peripherally with the duplex printing master 65, created on the duplex stencil printing device 1 side of FIG. 1, is mounted on the device main body 11A. The CPU 130K then compares data relating to the thickness of the sheet P detected by the sheet thickness sensor 138 and sheet thickness data preset in the PROM 131K during conveyance of the sheet P, and when the result of this comparison indicates a predetermined thickness or greater, the CPU 130K automatically switches the operating mode from the duplex print mode to the simplex print mode, and controls the stepping motor 52 of the press roller moving mechanism 55 to select the first print pressure range pattern in which print pressure is applied only to the front side area of the print drum 12, thereby executing printing of only the front side image 201 of the duplex printing master 65. The CPU 130K then controls the various drive means provided in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on such that printing operations in the duplex print mode are prohibited. The CPU 130K also differs from the CPU 130J in comprising a function for performing such comparisons and determinations while giving priority to the data (signals) relating to the thickness of the sheet P that is detected by the sheet thickness sensor 138 over the data (signals) relating to the thickness of the sheet P that is selected and set by the sheet thickness setting key 116.

Otherwise, the CPU 130K is substantially identical to the CPU 130J (control means 129J) of the fourth example. In other words, the CPU 130K controls the operations of the entire duplex stencil printing device 1A by controlling the various drive means in the printing portion 2, sheet feeding portion 4, and sheet discharging portion 6, the refeed registration moving mechanism 40 and conveyance unit drive motor 122 in the refeeding means 9, the solenoid 123 for activating the switching member 10, etc. on the basis of various signals from the operating panel 103A, detection signals from the various sensors provided in the device main body 11A, and the operating program called from the PROM 131K. More specifically, the CPU 130K (control means 129K) comprises the first function for controlling the liquid crystal drive circuit, not shown, to display a message on the liquid crystal display 120 indicating the duplex print mode or simplex print mode on the basis of a signal from the aforementioned initial set mode switching means.

As well as the operating program for the entire duplex stencil printing device 1A, programs and relationship data for effecting the unique functions of the CPU 130K described above are stored in the PROM 131K (partially writably). These operating programs and soon are called by the CPU 130K as needed. The RAM 132K functions to store the calculation results of the CPU 130K temporarily, to store data signals and ON/OFF signals set and inputted from the various keys and sensors in the operating panel 103A as needed, and so on.

Borrowing the constitutions shown in FIGS. 20 and 24, the horizontal stacking sorter 210 or reverse stacking sorter 208 may be connected as needed to the duplex stencil printing device 1A shown in FIG. 30, and the control functions of the control means 129 in the first through fifth examples may be added as needed to the control means 129K through the external I/F 211 so that the control means 129K are constituted and operated accordingly.

Next, an operation of the fifth example will be described, focusing on the differences with the first example. It is assumed as a prerequisite for describing a operation of the fifth example that an A4 portrait sized sheet P which is suitable for duplex printing is stacked and set on the sheet feed tray 67 in this embodiment.

When the power switch has been switched on by the user, a message such as "Duplex print mode is set. Simplex printing cannot be performed!" is displayed on the liquid crystal display 120, and the duplex print mode display lamp 117*a* is illuminated. When the duplex printing master 65 has been wrapped around the print drum 12 by means of similar operations to those described in the first example, a single A4 sheet P is removed from the top of the sheet feed tray 67 by an operation of the sheet feed roller 68 and separator roller 69, under the control of the control means 129K, and conveyed. While the sheet P is being conveyed to the registration roller pair 71, the thickness of the sheet P is detected by the sheet thickness sensor 138. The control means 129K compare the data relating to the thickness of the sheet P detected by the sheet thickness sensor 138 to sheet thickness data preset in the PROM 131K, and when the result of this comparison indicates a predetermined thickness or greater, the control means 129K automatically switch the operating mode from the duplex print mode to the simplex print mode, and control the stepping motor 52 of the press roller moving mechanism 55 to select the first print pressure range pattern in which print pressure is applied only to the front side area of the print drum 12, thereby executing printing of only the front side image 201 of the duplex printing master 65. The control means 129K then control the various drive means in the printing portion 2, sheet feeding portion 4, and sheet discharging portion 6, the refeed registration moving mechanism 40 and conveyance unit drive motor 122 provided in the refeeding means 9, the solenoid 123 for activating the switching member 10, and so on such that printing operations in the duplex print mode are prohibited, and simultaneously display a warning such as "Duplex print mode cannot be used" on the liquid crystal display 120.

Hence according to the fifth example, similar advantages to the first example are obtained. That is, the user is able to determine at will the operating mode which will serve as a default when the power of the duplex stencil printing device 1A is switched on or mode clearance is performed, and is able to learn with certainty whether the simplex print mode or duplex print mode has been set according to the display on the liquid crystal display 120. As a result, situations in which the simplex print mode is mistaken for the duplex print mode can be forestalled, and even when the user selects and sets the sheet thickness mistakenly through the sheet thickness setting key 116, the printing operation is not halted suddenly, as in the fourth example of the third embodiment, and at least plate mounting is performed at the site of the front side image 201 of the duplex printing master 65 on the print drum 12, whereupon the printed sheet P is discharged to the discharge tray 86. Hence sheet jams and the like during printing can be forestalled.

The fifth example of the second embodiment and the fifth example of the third embodiment are not limited to the constitutional examples and operational examples described above, and may be configured as follows. When the control means 129E, 129K of the respective duplex stencil printing devices 1, 1A, having the duplex printing master 65 shown in FIG. 8 wrapped around the print drum 12, switch the operating mode automatically from the duplex printing mode to the simplex printing mode, the stepping motor 52 of the press roller moving mechanism 55 may be controlled to select the second print pressure range pattern, in which print pressure is applied only to the reverse side area of the print drum 12, such that only the reverse side image 202 (the word "reverse" serving as the second image) of the duplex printing master 65 is printed. Further, when the control means 129E, 129K of the respective duplex stencil printing devices 1, 1A, having the duplex printing master 65 shown in FIG. 15 wrapped around the print drum 12, switch the operating mode automatically from the duplex printing mode to the simplex printing mode, the stepping motor 52 of the press roller moving mechanism 55 may be controlled to select the second print pressure range pattern, in which print pressure is applied only to the reverse side area of the print drum 12, such that only the reverse side image 202 (the letter "F" serving as the second image) of the duplex printing master 65 is printed.

Note that the second function of the sheet thickness sensor 138 and the control means 129K in the fifth example may of course be added to the first through third examples such that the first through third examples are constituted to operate in a similar manner.

The multicolor printing system relating to the plate mounting device disclosed in Japanese Unexamined Patent Application Publication 2001-239736, proposed by the present applicant, may also be applied to the first through fifth examples of the third embodiment. In this case, the duplex printing master 55 has already been subjected to plate mounting onto the print drum 12 on the plate mounting device side, and hence during duplex printing or simplex printing on the side of the duplex stencil printing device 1A, trial printing or normal prescribed printing is performed from the first sheet.

Needless to say, the present invention may be applied to the embodiments described above, employing a reefed reverse action using a press roller, or to the duplex printing device disclosed in Japanese Unexamined Patent Application Publication 2003-200645 or Japanese Unexamined Patent Application Publication 2003-237207, and may also be applied to the duplex printing device and soon disclosed in Japanese Unexamined Patent Application Publication 2003-312914 (Japanese Patent Application 2002-120826), proposed by the present applicant.

According to the present invention as described above, the following effects are obtained.

(1) When the power of the duplex printing device is switched on or during mode clearance to clear the various modes that are executed by the duplex printing device, a preset initial set mode can be switched between a duplex print mode for performing a duplex printing operation and a simplex print mode for performing a simplex printing operation. By means of this constitution, the user can be prevented from mistaking the simplex print mode and duplex print mode, and sheets jams and so on during duplex printing can also be prevented.

(2) When the power of the duplex printing device is switched on or during mode clearance, the user can learn whether the duplex print mode or the simplex print mode, switched by means of the above constitution, has been set through notification means.

(3) When the power of the duplex printing device is switched on or during mode clearance, the user can learn whether the duplex print mode or the simplex print mode, switched by means of the above constitution, has been set through screen display means.

(4) When the duplex print mode is set and the sheet size detected by the sheet size detection means is greater than the preset sheet size, the control means prohibit printing operations in the duplex print mode, and either cause information notifying means to provide a warning indicating that the duplex print mode cannot be used, or cause the screen display means to display a warning indicating that the duplex print mode cannot be used. As a result, sheet jams and the like occurring during duplex printing can be prevented even when the user selects and sets the sheet size incorrectly during duplex printing.

(5) When the duplex print mode is set, the control means cause sheets of a size that is equal to or smaller than the preset sheet size to be selected and fed automatically from the bank sheet feeding means, and hence sheet jams occurring during duplex printing when the user selects the sheet size incorrectly such that large sheets which are unsuitable for duplex printing are selected can be forestalled.

(6) When the duplex print mode is set, the control means feed a single sheet using sheet feeding means for feeding sheets, and determine whether or not a duplex printing operation is possible by comparing the length of the sheet, detected by sheet length detection means during conveyance of the sheet, with preset sheet length data. When it is determined that a duplex printing operation is impossible, the control means prohibit printing operations in the duplex print mode by either causing the information notifying means to provide a warning indicating that the duplex print mode cannot be used, or causing the screen display means to display a warning indicating that the duplex print mode cannot be used, and hence sheet jams and the like occurring during duplex printing can be forestalled even when the user selects and sets the sheet size incorrectly during duplex printing.

(7) When the duplex print mode is set, the control means feed a single sheet using sheet feeding means for feeding sheets, and determine whether or not a duplex printing operation is possible by comparing the thickness of the sheet, detected by sheet thickness detection means during conveyance of the sheet, with preset sheet thickness data. When it is determined that a duplex printing operation is impossible, the control means prohibit printing operations in the duplex print mode by either causing the information notifying means to provide a warning indicating that the duplex print mode cannot be used, or causing the screen display means to display a warning indicating that the duplex print mode cannot be used, and hence sheet jams and the like occurring during duplex printing can be forestalled even when the user selects and sets the sheet size incorrectly during duplex printing.

(8) When the duplex print mode is set, the control means feed a single sheet using sheet feeding means for feeding sheets, and compare the thickness of the sheet, detected by the sheet thickness detection means during conveyance of the sheet, with preset sheet thickness data. When the result of the comparison indicates that the sheet is of a predetermined thickness or more, the control means automatically switch the operating mode from the duplex print mode to the simplex print mode, and control print pressure range varying means such that printing is performed according to a first print pressure range pattern or a second print pressure range pattern, thereby executing printing of a first image or a second image. The control means then prohibit further printing operations in the duplex print mode, and either cause the information notifying means to provide a warning indicating that the duplex print mode cannot be used, or cause the screen display means to display a warning indicating that the duplex print mode cannot be used. Hence, even when the user selects and sets the sheet thickness mistakenly during duplex printing, the printing operation is not halted suddenly, and at least plate mounting is performed at the site of the first image or second image of the duplex printing master on the print drum. Thus sheet jams and the like during printing can be forestalled.

(9) When the duplex print mode is set and the sheet size detected by the sheet size detection means is greater than the preset sheet size, the control means prohibit perforation operations and printing operations in the duplex print mode, and either cause information notifying means to provide a warning indicating that the duplex print mode cannot be used, or cause the screen display means to display a warning indicating that the duplex print mode cannot be used. As a result, wastage of masters due to perforation errors during duplex printing can be eliminated.

(10) When the duplex print mode is set, the control means cause sheets of a size that is equal to or smaller than the preset sheet size to be selected and fed automatically from the bank sheet feeding means. Hence, wastage of masters due to perforation errors during duplex printing can be eliminated, and sheet jams occurring during duplex printing when the user selects the sheet size incorrectly such that large sheets which are unsuitable for duplex printing are selected can be forestalled.

(11) When the duplex print mode is set and the duplex printing master is wrapped around the print drum, the control means feed a single sheet using sheet feeding means for feeding sheets, and determine whether or not a duplex printing operation is possible by comparing the length of the sheet, detected by sheet length detection means during conveyance of the sheet, with preset sheet length data. When it is determined that a duplex printing operation is impossible, the control means prohibit printing operations in the duplex print mode by either causing the information notifying means to provide a warning indicating that the duplex print mode cannot be used, or causing the screen display means to display a warning indicating that the duplex print mode cannot be used. Hence, wastage of masters due to perforation errors during duplex printing can be eliminated, and sheet jams and the like occurring during duplex printing can be forestalled even when the user selects and sets the sheet size incorrectly during duplex printing.

(12) When the duplex print mode is set and the duplex printing master is wrapped around the print drum, the control means feed a single sheet using sheet feeding means for feeding sheets, and determine whether or not a duplex printing operation is possible by comparing the thickness of the sheet, detected by sheet thickness detection means during conveyance of the sheet, with preset sheet thickness data. When it is determined that a duplex printing operation is impossible, the control means prohibit printing operations in the duplex print mode by either causing the information notifying means to provide a warning indicating that the duplex print mode cannot be used, or causing the screen display means to display a warning indicating that the duplex print mode cannot be used, and hence sheet jams and the like occurring during duplex printing can be forestalled even when the user selects and sets the sheet size incorrectly during duplex printing.

(13) When the duplex print mode is set and the duplex printing master is wrapped around the print drum, the control means feed a single sheet using sheet feeding means for feeding sheets, and compare the thickness of the sheet, detected by the sheet thickness detection means during conveyance of the sheet, with preset sheet thickness data. When the result of the comparison indicates that the sheet is of a predetermined thickness or more, the control means automatically switch the operating mode from the duplex print mode to the simplex print mode, and control print pressure range varying means such that printing is performed according to a first print pressure range pattern or a second print pressure range pattern, thereby executing printing of a first image or a second image. The control means then prohibit further printing operations in the duplex print mode, and either cause the information notifying means to provide a warning indicating that the duplex print mode cannot be used, or cause the screen display means to display a warning indicating that the duplex print mode cannot be used. Hence, even when the user selects and sets the sheet thickness mistakenly during duplex printing, the printing operation is not halted suddenly, and at least plate mounting is performed at the site of the first image or second image of the duplex printing master on the print drum. Thus sheet jams and the like during printing can be forestalled.

Various modifications will become possible for those skilled in the art after receiving the teachings of the present disclosure without departing from the scope thereof.

What is claimed is:

1. A duplex printing device in which a duplex printing master, on which a first image and a second image are perforated in series over the length of a single plate, or a simplex printing master, on which a third image having an image area equivalent to said first image and said second image is perforated over the length of a single plate, is wrapped around an outer peripheral surface of a print drum, thereby enabling a duplex printing operation in which one of said first image and said second image is printed by pressing a front side of a sheet against said duplex printing master on said print drum using pressing means which can be brought into and out of contact with said print drum, after which the other of said first image and said second image is printed by reversing and refeeding said sheet and pressing a reverse side of said sheet against said duplex printing master on said print drum using said pressing means, and a simplex printing operation in which said third image is printed by pressing one side of said sheet against said simplex printing master on said print drum, wherein a preset initial set mode can be switched between a duplex print mode for performing said duplex printing operation and a simplex print mode for performing said simplex printing operation when power is supplied to said duplex printing device, during mode clearance for clearing various modes executed by said duplex printing device.

2. The duplex printing device as claimed in claim 1, comprising notifying means for providing notification of whether said duplex print mode or said simplex print mode, switched by said constitution, is set during said power supply, said mode clearance.

3. The duplex printing device as claimed in claim 2, wherein said notifying means are constituted by screen display means for displaying a warning on a screen indicating that said duplex print mode or said simplex print mode is set.

4. The duplex printing device as claimed in claim 1, comprising:

sheet size detection means for detecting the size of sheets stacked on a sheet feeding table;

information notifying means for providing information; and control means for prohibiting a print operation in said duplex print mode when said duplex print mode is set and said sheet size, detected by said sheet size detection means, is greater than a preset sheet size, and providing a warning indicating that said duplex print mode cannot be used through said information notifying means, or displaying a warning indicating that said duplex print mode cannot be used through said screen display means.

5. The duplex printing device as claimed in claim 1, comprising:

bank sheet feeding means for selecting sheets having one of a plurality of sheet sizes stacked on a plurality of sheet feeding tables, and conveying said sheets between said print drum and said pressing means; and control means for causing said bank sheet feeding means to select and feed sheets having a sheet size which is equal to or smaller than said preset sheet size automatically when said duplex print mode is set.

6. The duplex printing device as claimed in claim 1, comprising:

sheet length detection means for detecting a length of a sheet in at least a conveyance direction of the sheet on an upstream side of said print drum and said pressing means in said sheet conveyance direction;

information notifying means for providing information; and control means for causing sheet feeding means for feeding sheets to feed a single sheet when said duplex print mode is set, determining whether or not said duplex printing operation is possible by comparing the length of said sheet, detected by said sheet length detecting means during conveyance of said sheet, to preset sheet length data, and when said duplex printing operation is impossible, prohibiting a printing operation in said duplex print mode, and providing a warning indicating that said duplex print mode cannot be used through said information notifying means, or displaying a warning indicating that said duplex print mode cannot be used through said screen display means.

7. The duplex printing device as claimed in claim 1, comprising:

sheet thickness detection means for detecting a thickness of a sheet on an upstream side of said print drum and said pressing means in a sheet conveyance direction;

information notifying means for providing information; and control means for causing sheet feeding means for feeding sheets to feed a single sheet when said duplex print mode is set, determining whether or not said duplex printing operation is possible by comparing the thickness of said sheet, detected by said sheet thickness detecting means during conveyance of said sheet, to preset sheet thickness data, and when said duplex printing operation is impossible, prohibiting a printing operation in said duplex print mode, and providing a warning indicating that said duplex print mode cannot be used through said information notifying means, or displaying a warning indicating that said duplex print mode cannot be used through said screen display means.

8. The duplex printing device as claimed in claim 1, comprising:

sheet thickness detection means for detecting a thickness of a sheet on an upstream side of said print drum and said pressing means in a sheet conveyance direction;

information notifying means for providing information;

print pressure range varying means capable of switching selectively between one of at least three print pressure range patterns comprising a first print pressure range pattern, in which print pressure is applied only to a first image area corresponding to said first image of said duplex printing master on said print drum, a second print pressure range pattern, in which print pressure is applied only to a second image area corresponding to said second image of said duplex printing master on said print drum, and a third print pressure range pattern, in which print pressure is applied over said first image area and said second image area; and control means for causing sheet feeding means for feeding sheets to feed a single sheet when said duplex print mode is set, comparing the thickness of said sheet, detected by said sheet thickness detection means during conveyance of the sheet, with preset sheet thickness data, and when the result of said comparison indicates that said sheet is of a predetermined thickness or more, automatically switching from said duplex print mode to said simplex print mode, controlling said print pressure range varying means such that printing is performed according to said first print pressure range pattern or said second print pressure range pattern, thereby executing printing of said first image or said second image, and then prohibiting further printing operations in said duplex print mode, and either causing said information notifying means to provide a warning indicating that said duplex print mode cannot be used, or causing said screen display means to display a warning indicating that said duplex print mode cannot be used.

9. The duplex printing device as claimed in claim 1, comprising perforating means for creating said duplex printing master and said simplex printing master.

10. The duplex printing device as claimed in claim 9, comprising:

sheet size detection means for detecting the size of sheets stacked on a sheet feeding table;

information notifying means for providing information; and control means for prohibiting a perforation operation and a print operation in said duplex print mode when said duplex print mode is set and said sheet size, detected by said sheet size detection means, is greater than a preset sheet size, and providing a warning indicating that said duplex print mode cannot be used through said information notifying means, or displaying a warning indicating that said duplex print mode cannot be used through said screen display means.

11. The duplex printing device as claimed in claim 9, comprising:

bank sheet feeding means for selecting sheets having one of a plurality of sheet sizes stacked on a plurality of sheet feeding tables, and conveying said sheets between said print drum and said pressing means; and control means for causing said bank sheet feeding means to select and feed sheets having a sheet size which is equal to or smaller than said preset sheet size automatically when said duplex print mode is set.

12. The duplex printing device as claimed in claim 9, comprising:

sheet length detection means for detecting a length of a sheet in at least a conveyance direction of the sheet on an upstream side of said print drum and said pressing means in said sheet conveyance direction;

information notifying means for providing information; and control means for causing sheet feeding means for feeding sheets to feed a single sheet when said duplex print mode is set and said duplex printing master is wrapped around said print drum, determining whether or not said duplex printing operation is possible by comparing the length of said sheet, detected by said sheet length detecting means during conveyance of said sheet, to preset sheet length data, and when said duplex printing operation is impossible, prohibiting a printing operation in said duplex print mode, and providing a warning indicating that said duplex print mode cannot be used through said information notifying means, or displaying a warning indicating that said duplex print mode cannot be used through said screen display means.

13. The duplex printing device as claimed in claim 9, comprising:

sheet thickness detection means for detecting a thickness of a sheet on an upstream side of said print drum and said pressing means in a sheet conveyance direction;

information notifying means for providing information; and control means for causing sheet feeding means for feeding sheets to feed a single sheet when said duplex print mode is set and said duplex printing master is wrapped around said print drum, determining whether or not said duplex printing operation is possible by comparing the thickness of said sheet, detected by said sheet thickness detecting means during conveyance of said sheet, to preset sheet thickness data, and when said duplex printing operation is impossible, prohibiting a printing operation in said duplex print mode, and providing a warning indicating that said duplex print mode cannot be used through said information notifying means, or displaying a warning indicating that said duplex print mode cannot be used through said screen display means.

14. The duplex printing device as claimed in claim 9, comprising:

sheet thickness detection means for detecting a thickness of a sheet on an upstream side of said print drum and said pressing means in a sheet conveyance direction;

information notifying means for providing information;

print pressure range varying means capable of switching selectively between one of at least three print pressure range patterns comprising a first print pressure range pattern, in which print pressure is applied only to a first image area corresponding to said first image of said duplex printing master on said print drum, a second print pressure range pattern, in which print pressure is applied only to a second image area corresponding to said second image of said duplex printing master on said print drum, and a third print pressure range pattern, in which print pressure is applied over said first image area and said second image area; and control means for causing sheet feeding means for feeding sheets to feed a single sheet when said duplex print mode is set, comparing the thickness of said sheet, detected by said sheet thickness detection means during conveyance of the sheet, with preset sheet thickness data, and when the result of said comparison indicates that said sheet is of a predetermined thickness or more, automatically switching from said duplex print mode to said simplex print mode, controlling said print pressure range varying means such that printing is performed according to said first print pressure range pattern or said second print pressure range pattern, thereby executing printing of said first image or said second image, and then prohibiting further printing operations in said duplex print mode, and either causing said information notifying means to provide a warning indicating that said duplex print mode cannot be used, or causing said screen display means to display a warning indicating that said duplex print mode cannot be used.

* * * * *

UNITED STATES PATENT AND TRADEMARK OFFICE

CERTIFICATE OF CORRECTION

PATENT NO. : 7,073,436 B2
APPLICATION NO. : 11/023671
DATED : July 11, 2006
INVENTOR(S) : Mituru Takahashi It is certified that error appears in the above-identified patent and that said Letters Patent is hereby corrected as shown below:

Column 8, line 64, change “soon” to --so on--.
Column 10, line 40, change “soon” to --so on--.
Column 27, line 52, change “Int his” to --In this--.
Column 34, line 39, change “soon” to --so on--.
Column 37, line 12, change “soon” to --so on--.
Column 48, line 3, change “soon” to --so on--.
Column 53, line 19, change “1A” to --11A--.
Column 57, line 8, change “soon” to --so on--.
Column 59, line 7, change “soon” to --so on--.
Column 59, line 23, change “a” to --an--.
Column 60, line 60, change “soon” to --so on--.
Column 63, line 49, change “in which” to --comprising--.

Signed and Sealed this

Eighteenth Day of September, 2007

JON W. DUDAS
*Director of the United States Patent and Trademark Office*